US007094525B2

(12) United States Patent
Yasuda et al.

(10) Patent No.: US 7,094,525 B2
(45) Date of Patent: Aug. 22, 2006

(54) SILVER HALIDE PHOTOGRAPHIC LIGHT-SENSITIVE MATERIAL

(75) Inventors: Shoji Yasuda, Kanagawa (JP); Kunio Ishigaki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/811,803

(22) Filed: Mar. 30, 2004

(65) Prior Publication Data

US 2004/0253555 A1 Dec. 16, 2004

(30) Foreign Application Priority Data

Mar. 31, 2003 (JP) ..... 2003-095122
Mar. 31, 2003 (JP) ..... 2003-095123

(51) Int. Cl.
*G03C 1/46* (2006.01)
*G03C 1/76* (2006.01)
*G03C 1/775* (2006.01)

(52) U.S. Cl. ..... 430/523; 430/531; 430/533; 430/536; 430/538; 430/502

(58) Field of Classification Search ..... 430/523, 430/531, 533, 536, 538, 502
See application file for complete search history.

(56) References Cited

U.S. PATENT DOCUMENTS

| | | | | |
|---|---|---|---|---|
| 4,173,480 | A | 11/1979 | Woodward | |
| 4,865,941 | A * | 9/1989 | Tamagawa et al. | 430/538 |
| 4,954,430 | A | 9/1990 | Ishigaki et al. | |
| 5,558,979 | A * | 9/1996 | Ishigaki et al. | 430/531 |
| 5,869,217 | A | 2/1999 | Aono | |
| 6,475,696 | B1 | 11/2002 | Majumdar et al. | |
| 6,562,561 | B1 | 5/2003 | Naoi | |

FOREIGN PATENT DOCUMENTS

| | | |
|---|---|---|
| EP | 1 408 372 A2 | 4/2004 |
| JP | 8-211547 A | 8/1996 |

* cited by examiner

*Primary Examiner*—Geraldine Letscher
(74) *Attorney, Agent, or Firm*—Birch, Stewart, Kolasch & Birch, LLP

(57) ABSTRACT

Disclosed is a silver halide photographic light-sensitive material having a support containing a filler and/or an undercoat layer containing a clay compound coated with an organic substance between the support and an emulsion layer or between the support and a back layer. The silver halide photographic light-sensitive material shows good dimensional stability in a processing system.

27 Claims, 1 Drawing Sheet

SILVER HALIDE PHOTOGRAPHIC LIGHT-SENSITIVE MATERIAL

This Nonprovisional application claims priority under 35 U.S.C. § 119(a) on Patent Application No(s). 2003-095122 and 2003-095123 filed in Japan on Mar. 31, 2003, the entire contents of which are hereby incorporated by reference.

BACKGROUND OF THE INVENTION

1. Field of the Invention

The present invention relates to a silver halide photographic light-sensitive material, in particular, a silver halide photographic light-sensitive material used for a photomechanical process and a photographic light-sensitive material used for IC printed boards.

2. Description of the Background

It is the integrated circuits (ICs) that support the today's highly information-oriented society from the aspect of hardware. It can be said that ICs are used because of their characteristics such as high processing speed, high reliability, low power consumption, low price, high functionality, light weight and small size. Meanwhile, for photographic light-sensitive materials, for example, light-sensitive materials for making printing plates, especially those used for IC printed boards, high reliability is required, and they play an important role. For example, a circuit pattern is prepared with the aid of computer-aided design (CAD), and a photographic light-sensitive material is exposed in this pattern in a full scale or reduced scale, developed and fixed to prepare a negative. A copper plate (or copper foil) applied with a resist is exposed using this negative as a mask by contact exposure or projection exposure in a reduced size usually using a mercury lamp as a light source so that the resist should be chemically denatured by ultraviolet rays emitted by the mercury lamp. There are a negative type resist and a positive type resist. In the former type, a portion irradiated with ultraviolet rays is not dissolved and remains in the subsequent development step, and a portion not irradiated with ultraviolet rays is dissolved in a developer. The reverse is applied to the positive type resist. In the both cases, for use of a negative of photographic light-sensitive material as a mask in contact exposure or projection exposure in a reduced size on a copper plate (or copper foil) applied with a resist, reproducibility of the negative image on the photographic light-sensitive material (stability for the development) and dimensional stability of the light-sensitive material during passage of time after the production of the negative image are important.

In photomechanical processes used in the field of graphic arts, used is a method in which photographic images of continuous tone are converted into so-called dot images in which variable image density is represented by sizes of dot areas, and such images are combined with photographed images of characters or line originals to produce printing plates. For silver halide photographic light-sensitive materials used for such a purpose, ultrahigh contrast photographic characteristic enabling clear distinction between image portions and non-image portions has been required in order to obtain favorable reproducibility of characters, line originals and dot images. Silver halide photographic light-sensitive materials having such an ultrahigh photographic characteristic have a characteristic that they shows higher density (higher practice density) compared with low contrast materials even when laser exposure is performed with exposure giving the same half tone percentage. Therefore, for use in IC printed boards, suitability of resist for exposure is markedly improved.

As a system responding to such a requirement, there has been known the so-called lithographic development method, in which a silver halide light-sensitive material comprising silver chlorobromide is treated with a hydroquinone developer having an extremely low effective concentration of sulfite ions to form images of high contrast. However, in this method, the developer is extremely unstable against oxidation by air since the sulfite ion concentration in the developer is extremely low, and therefore a lot of developer must be replenished in order to stably maintain the developer activity.

As image forming systems in which the instability of the image formation according to the lithographic development method is eliminated and light-sensitive materials are processed with a developer showing good storage stability to obtain ultrahigh contrast photographic characteristic, there can be mentioned, for example, those described in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746 and so forth. These are systems in which a silver halide photographic light-sensitive material of surface latent image type containing a hydrazine derivative is processed with a developer containing hydropuinone/metol or hydroquinone/phenidone as main developing agents and 0.15 mol/l or more of sulfite preservative and having pH of 11.0 to 12.3 to form ultrahigh contrast negative images having a gamma of 10 or higher. According to these systems, photographic characteristics of ultrahigh contrast and high practice density can be obtained, and because sulfite can be added to the developer at a high concentration, stability of the developer to air oxidation is markedly improved compared with conventional lithographic developers.

In order to form sufficiently ultrahigh contrast images with use of a hydrazine derivative, it is necessary to perform processing with a developer having pH of 11 or higher, usually 11.5 or higher. Although it has become possible to increase the stability of the developer by use of a sulfite preservative at a high concentration, it is necessary to use such a developer of high pH as described above in order to obtain ultrahigh contrast photographic images, and the developer is likely to suffer from air oxidation and hence instable even with the presence of the preservative. Therefore, various attempts have been made in order to realize ultrahigh contrast images with a lower pH to further improve stability of the developer.

For example, U.S. Pat. No. 4,269,929 (Japanese Patent Laid-open Publication (Kokai, henceforth referred to as "JP-A") No. 61-267759), U.S. Pat. No. 4,737,452 (JP-A-60-179734), U.S. Pat. Nos. 5,104,769, 4,798,780, JP-A-1-179939, JP-A-1-179940, U.S. Pat. Nos. 4,998,604, 4,994,365 and JP-A-8-272023 disclose methods of using a highly active hydrazine derivative and a nucleation accelerator in order to obtain ultrahigh contrast images of high practice density by using a developer having pH of less than 11.0. However, silver halide photographic light-sensitive materials used for such image-forming systems have a problem concerning processing stability such as fluctuation of sensitivity caused by change of activities of the hydrazine derivative and the nucleation accelerator due to exhaustion of processing solutions, and therefore a stable image formation system providing high practice density has been desired, especially for photographic light-sensitive materials for IC printed boards.

Meanwhile, silver halide photographic light-sensitive materials are generally produced by applying at least one photographic light-sensitive layer on a plastic film support consisting of a fibrous material type polymer, of which typical example is triacetyl cellulose, or a polyester type polymer, of which typical example is polyethylene terephthalate. Since the polyethylene terephthalate films have or show superior mechanical properties, dimensional stability and high productivity, they are considered to be able to replace triacetyl cellulose, and they are used for silver halide photographic light-sensitive materials for use in bright rooms, scanners, facsimiles, IC printed boards and so forth. However, lengths of polyethylene terephthalate films change due to moisture absorption or dehydration caused depending on the environmental humidity, and thus their dimensional stability is insufficient. As a technique for improving this problem, JP-A-63-304249 and so forth disclose a technique of providing a polyvinyl chloride barrier layer in order to reduce the dimensional change caused by moisture absorption of a support. However, when the chlorine-containing layer is provided on a support, there arise problems, that is, dechlorination gradually advances during storage for a long period of time and thereby images cause yellowing, dimensional change is caused during a further longer period of time, and so forth. Therefore, a technique for suppressing dimensional change due to humidity change has been desired.

In view of these problems of the conventional techniques, an object of the present invention is to provide a silver halide photographic light-sensitive material that shows good dimensional stability in a stable processing system.

SUMMARY OF THE INVENTION

As a result of various researches of the inventors of the present invention, it was found that the aforementioned object could be achieved by a silver halide photographic light-sensitive material having at least one silver halide emulsion layer on a support, wherein the support contains a filler (first invention). It was also found that the aforementioned object could be achieved by a silver halide photographic light-sensitive material having at least one silver halide emulsion layer on a support and a back layer on the side of the support opposite to the side having the emulsion layer (emulsion side), which has an undercoat layer containing a clay compound coated with an organic substance between the support and the emulsion layer or between the support and the back layer (second invention).

BEST MODE FOR CARRYING OUT THE INVENTION

Figure 1:
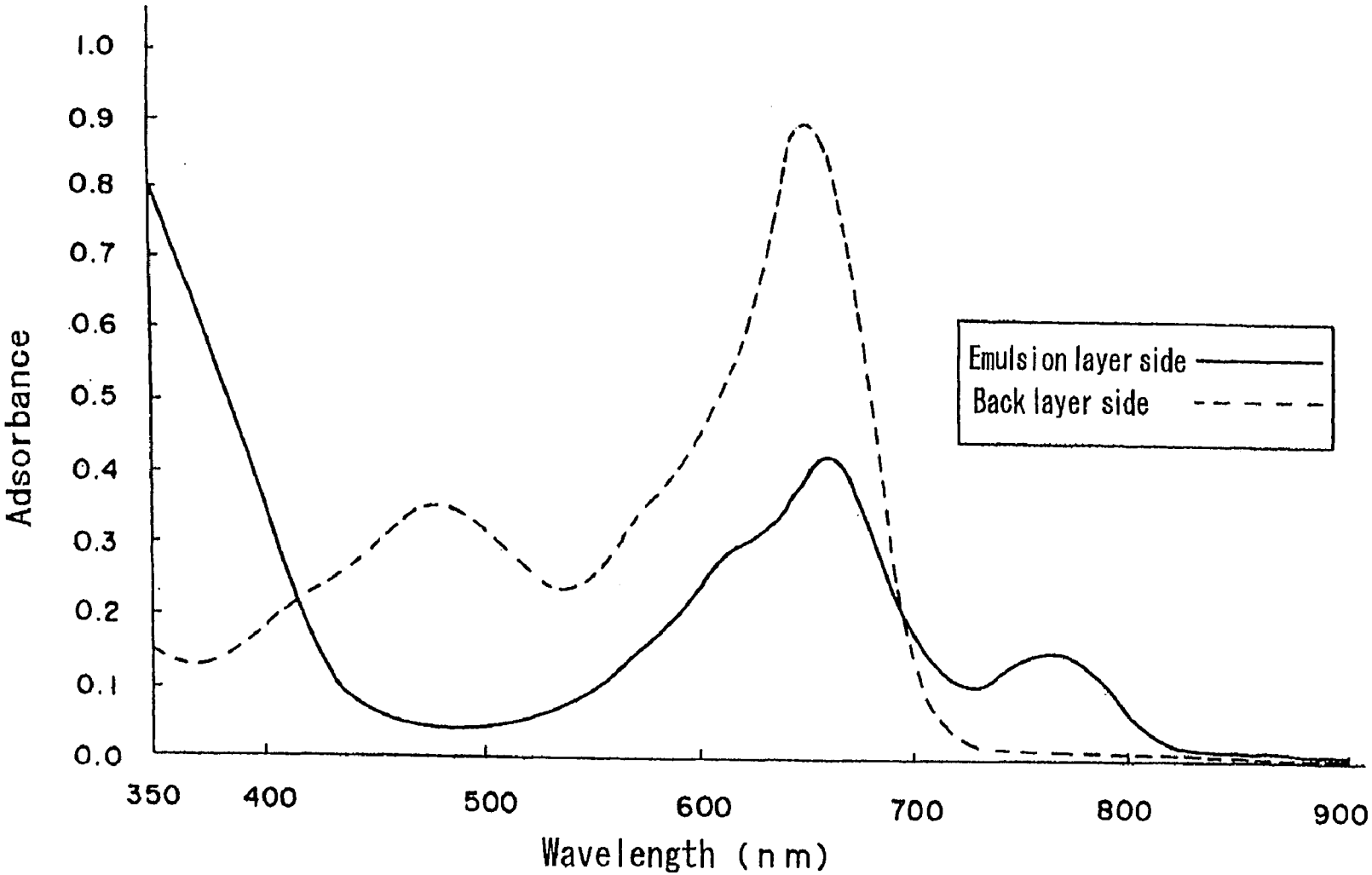
FIG. 1 shows absorption spectra for emulsion layer side and back layer side of a silver halide photographic light-sensitive material according to an embodiment of the present invention. The longitudinal axis represents absorbance (graduated in 0.1), and the transverse axis represents wavelength of from 350 nm to 900 nm. The solid line represents the absorption spectrum of the emulsion layer side, and the broken line represents the absorption spectrum of the back layer side.

The silver halide photographic light-sensitive material of the present invention will be explained in detail hereafter. In the present specification, ranges indicated with "to" mean ranges including the numerical values before and after "to" as the minimum and maximum values, respectively.

The first invention will be explained first. The first invention according to the present invention is characterized in that, in a silver halide photographic light-sensitive material having at least one silver halide emulsion layer on a support, the support contains a filler.

In the present invention, as the filler contained in the support, it is preferable to use, in particular, a compound obtained by allowing organic onium ions to act on a clay compound, swellable mineral etc. (henceforth referred to as an "organic onium-treated compound").

The clay compound, swellable mineral etc. treated with organic onium ions have a structure completely different from the aggregated structure of a micrometer size composed of many stacked layers, which is possessed by the clay compound, swellable mineral etc. before the treatment. That is, if the clay compound, swellable mineral etc. are treated with organic onium ions, the organic onium ions having affinity for resins are introduced between the layers. This expands spacings between the layers of the clay compound, swellable mineral etc. treated with the organic onium ions, and they can disperse in a resin in the forms of extremely fine independent thin leaves and thus exhibit extremely superior dispersibility. In the present invention, if the organic onium-treated compound is used as a filler the filler in the form of thin leaf can be favorably dispersed, and a non-magnetic support having superior surface smoothness can be obtained.

The aforementioned clay compound, swellable mineral etc. mainly consist of silicon oxide tetrahedron sheets and metal hydroxide octahedron sheets, and examples thereof include smectite group clay minerals, swellable mica, swellable vermiculite and so forth.

The aforementioned smectite group clay minerals are represented by the formula: $X_{0.2\text{-}0.6}Y_{2\text{-}3}Z_4O_{10}(OH)_2.nH_2O$ (wherein X consists of one or more kinds selected from the group consisting of K, Na, 1/2Ca and 1/2Mg, Y consists of one or more kinds selected from the group consisting of Mg, Fe, Mn, Ni, Zn, Li, Al and Cr, Z consists of one or more kinds selected from the group consisting of Si and Al, $H_2O$ represents a water molecule binding to an ion between the layers, and n markedly varies depending on the ion between layers and relative humidity), and it is a natural substance or synthetic substance. Specific examples of the smectite group clay minerals include, for example, montmorillonite, beidellite, nontronite, saponite, iron saponite, hectorite, sauconite, stevensite, bentonite etc., substituted products thereof, derivatives thereof and mixtures thereof.

The swellable mica is represented by the formula: $X_{0.5\text{-}1.0}Y_{2\text{-}3}(Z_4O_{10})(F,OH)_2$ (wherein X consists of one or more kinds selected from the group consisting of Li, Na, K, Rb, Ca, Ba and Sr, Y consists of one or more kinds selected from the group consisting of Mg, Fe, Ni, Mn, Al and Li, and Z consists of one or more kinds selected from the group consisting of Si, Ge, Al, Fe and B), and it is a natural substance or synthetic substance. This substance has a property of swelling in water, a polar solvent miscible with water in an arbitrary proportion and a mixed solvent of water and the polar solvent, and examples thereof include, for example, Li type teniolite, Na type teniolite, Li type tetrasilicic mica, Na type tetrasilicic mica etc., substituted products thereof, derivatives thereof and mixtures thereof. The swellable vermiculite includes the tritetrahedron type and the ditetrahedron type and is represented by the formula: $(Mg,Fe,Al)_{2\text{-}3}(Si_{4\text{-}x}Al_x)O_{10}(OH)_2.(M^+,1/2M^{2+})_x.nH_2O$ (wherein M represents an exchangeable cation of alkali metal or alkaline earth metal such as Na and Mg, X is 0.6 to 0.9, and n is 3.5 to 5).

As for the aforementioned clay compound, swellable mineral etc., two or more kinds of them may be used in combination. As for the crystal structure of the clay compound, swellable mineral etc., those having a high purity in which the layers are regularly stacked in the direction of the c-axis are desirable. However, the so-called mixed-layer minerals in which crystal period is disturbed, and multiple kinds of crystal structures are mixed may also be used.

The organic onium ion used for the present invention has the structure exemplified by ammonium ion, phosphonium ion, sulfonium ion and an onium ion derived from a heteroaromatic ring. With existence of the onium ion, an organic structure exhibiting a small intermolecular force can be introduced between layers of clay compounds etc. and thereby affinity of clay compounds etc. for a resin can be increased. Examples of the organic onium ion include alkylamine ions such as laurylamine ion and myristylamine ion, ammonium ions having both of an alkyl group and a glycol chain such as diethylmethyl(polypropylene oxide)ammonium ion and dimethylbis(polyethylene glycol)ammonium ion and so forth.

As for the compound used in the present invention for supplying organic onium ions include, for example, tetraethylammonium chloride, n-dodecyltrimethylammonium chloride and dimethyldistearylammonium chloride can be used as a supply source of ammonium ions, ethyltriphenylphosphonium chloride, tetra-n-butylphosphonium bromide and tetraethylphosphonium bromide can be used as a supply source of phosphonium ions, and trimethylsulfonium iodide and triphenylsulfonium bromide can be used as a supply source of sulfonium ions.

The clay compound etc. treated with organic onium ions can be produced by a known technique for reacting organic onium ions with layered clay minerals containing negative layer lattices and exchangeable cations (Japanese Patent Publication (Kokoku, henceforth referred to as "JP-B") No. 61-5492, JP-A-60-42451 etc.).

As the support usable for the present invention, known materials, for example, biaxially stretched polyethylene naphthalate, polyethylene terephthalate, polyamide, polyimide, polyamidoimide, aromatic polyamide, polybenzoxidazole, glass plate, cellulose acetate, cellulose nitrate and so forth, can be used. Preferred are polyester films such as polyethylene terephthalate films. The support is suitably chosen from these according to the purpose of use of the silver halide photographic light-sensitive material.

Further, a support consisting of the styrene type polymer having a syndiotactic structure described in JP-A-7-234478 or U.S. Pat. No. 5,558,979 can also be preferably used. Such a support may be subjected beforehand to a corona discharge treatment, plasma treatment, treatment for easy adhesion, heat treatment etc.

The average center surface roughness (JIS B0660-1998, ISO 4287-1997) of the emulsion layer side of the support usable for the present invention is preferably in the range of 2 to 10 nm, more preferably 3 to 9 nm, at a cutoff value of 0.25 mm, and the roughness may be different for the both sides of the support. The preferred thickness of the support of the silver halide photographic light-sensitive material of the present invention is 3 to 80 μm.

In the present invention, the method for preparing the support is not particularly limited except that a filler should be added to the resin constituting the support and dispersed therein. However, it is preferable to adjust mechanical strength of the support along the longitudinal direction and the transverse direction. Specifically, when a resin added with a filler is formed in the shape of film (film formation), the film is preferably stretched along the longitudinal direction and the transverse direction. The Young's modulus of the support used in the present invention is preferably 4400 to 15000 Mpa, more preferably 5500 to 11000 MPa, for the both of the longitudinal direction and the transverse direction, and the Young's modulus may be different for the longitudinal direction and the transverse direction.

The filler contained in the support used in the silver halide photographic light-sensitive material of the present invention preferably has an aspect ratio of 50 to 10000, more preferably 60 to 5000, further preferably 70 to 1000. The "aspect ratio" used herein means a ratio of the average particle size and thickness of the filler (average particle size/thickness). If the aspect ratio is less than in 50, the effect of the tabular particles cannot be obtained, and if the aspect ratio exceeds 10000, the support surface tends to become unduly rough.

In the silver halide photographic light-sensitive material of the present invention, the thickness of the filler contained in the support used is preferably 0.5 to 5 nm, more preferably 0.7 to 4 nm, further preferably 0.8 to 2 nm. If the thickness of the filler is less than 0.5 nm, it can no longer exist as tabular particles, and the thickness of the filler exceeds 5 nm, the support surface tends to become unduly rough.

The average particle size of the aforementioned filler is preferably 25 to 10000 nm. If it is within this range, the effect of the tabular particles can be obtained, and a support having superior surface smoothness can be obtained.

In the present invention, the material of the filler contained in the support is not particularly limited, and those satisfying the aforementioned requirements of thickness and aspect ratio can be used. Specifically, clay compounds, swellable minerals etc. as they are and those materials coated with an organic compound can be used.

In the present invention, when a clay compound, swellable mineral etc. coated with an organic compound is used as the filler, the thickness and aspect ratio of the filler contained in the support can be adjusted by dispersing the particles using a dispersing machine that can apply a high shearing force such as a homomixer when the clay compound etc. is coated with an organic compound.

Hereafter, the second invention according to the present invention will be explained. The silver halide photographic light-sensitive material according to the second invention is characterized by having an undercoat layer containing a clay compound coated with an organic substance between the support and the emulsion layer or between the support and the back layer.

The clay compound coated with an organic substance contained in the undercoat layer preferably has an aspect ratio of 50 to 10000 and a thickness of 0.5 to 5 nm, and examples thereof include, for example, a compound obtained by allowing organic onium ions to act on a layered silicate compound.

In the present invention, the reason why the inclusion of a clay compound coated with an organic substance in the undercoat layer provides the desired effect is considered as follows. It is considered that the motility (ease of moving) of the filler is reduced when the resin component absorbs to the filler in the undercoat layer, and thereby the dimensional stability of the undercoat layer and as a result, the whole light-sensitive material, is improved. In this respect, a higher dispersibility of the filler contained in the undercoat layer provides more increased resin component absorbing to the filler, i.e., polymer hard to move, so that the dimensional stability can be further improved.

In the silver halide photographic light-sensitive material of the present invention, the organic onium-treated compound has a structure completely different from the aggregated structure of a micrometer size composed of many stacked layers, which is possessed by the layered silicate compound before the treatment. That is, if the layered silicate compound is treated with organic onium ions, the organic onium ions having affinity for resins are introduced between the layers. This expands spacings between the layers of the layered silicate compound, and they can disperse in a resin in the forms of extremely fine independent thin leaves and thus exhibit extremely superior dispersibility.

In the present invention, by providing an undercoat layer containing the organic onium-treated compound having superior dispersibility as a filler as described above, a silver halide photographic light-sensitive material showing little fluctuation in thermal expansion coefficient and humidity expansion coefficient and thus showing superior dimensional stability can be obtained.

The aforementioned layered silicate compound mainly consist of silicon oxide tetrahedron sheets and metal hydroxide octahedron sheets, and examples thereof include smectite group clay minerals, swellable mica, swellable vermiculite and so forth. The details of these materials and the organic onium ion are similar to those explained for the aforementioned first invention.

As for the aforementioned layered silicate compound, two or more kinds of it may be used in combination. As for the crystal structure of the layered silicate compound, those having a high purity in which the layers are regularly stacked in the direction of the c-axis are desirable. However, the so-called mixed-layer minerals in which crystal period is disturbed, and multiple kinds of crystal structures are mixed may also be used.

The preferred ranges of the thickness and aspect ratio of the clay compound coated with an organic substance are the same as the preferred ranges of the thickness and aspect ratio of the filler used in the aforementioned first invention. In the present invention, the thickness and aspect ratio of the clay compound coated with an organic substance contained in the undercoat layer can be adjusted by dispersing the particles using a dispersing machine that can apply a high shearing force such as a homomixer when the clay compound is coated with the organic compound.

As a binder for the undercoat layer, a solvent-soluble substance such as a polyester resin, polyamide resin, polyamidoimide resin, polyurethane resin, vinyl chloride type resin, vinylidene chloride resin, phenol resin, epoxy resin, urea resin, melamine resin, formaldehyde resin, silicone resin, starch, denatured starch compound, alginic acid compound, casein, gelatin, pullulan, dextran, chitin, chitosan, rubber latex, gum arabic, gumweed, natural gum, dextrin, denatured cellulosic resin, polyvinyl alcohol type resin, polyethylene oxide, polyacrylic acid type resin, polyvinylpyrrolidone, polyethyleneimine, polyvinyl ether, polymaleate copolymer, polyacrylamide and alkyd resin can be used. It is particularly preferred that carboxyl groups and sulfonic acid metal salt groups are introduced into the binders mentioned above for the purpose of further improving adhesion.

Examples of the support usable for the second invention include, for example, baryta paper, polyethylene-coated paper, polypropylene synthetic paper, glass plate, cellulose acetate, cellulose nitrate, and polyester films such as polyethylene terephthalate film. Further, a support consisting of the styrene type polymer having a syndiotactic structure described in JP-A-7-234478 or U.S. Pat. No. 5,558,979 can also be preferably used.

The following explanations are commonly applicable to the first invention and the second invention.

The silver halide of the silver halide emulsion used for the silver halide photographic light-sensitive material of the present invention is not particularly limited, and silver chloride, silver chlorobromide, silver bromide, silver chloroiodobromide or silver iodobromide can be used. In particular, silver chlorobromide or silver chloroiodobromide having a silver chloride content of 30 mol % or more is preferably used. Although the form of silver halide grain may be any of cubic, tetradecahedral, octahedral, variable and tabular forms, a cubic form is most preferred. The silver halide grains preferably have a mean grain size of 0.1 to 0.7 μm, more preferably 0.1 to 0.5 μm, and preferably has a narrow grain size distribution in terms of a variation coefficient of grain size, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared by using the methods described in P. Glafkides, Chimie et Physique Photographique, Paul Montel (1967); G. F. Duffin, Photographic Emulsion Chemistry, The Focal Press (1966); V. L. Zelikman et al, Making and Coating Photographic Emulsion, The Focal Press (1964) and so forth.

That is, any of an acidic process and a neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one type of the double jet method, a method of maintaining the pAg constant in the liquid phase where silver halide is produced, that is, the so-called controlled double jet method, may also be used. Further, it is particularly preferable to form grains using the so-called silver halide solvent such as ammonia, thioether or tetra-substituted thiourea. More preferred as the silver halide solvent is a tetra-substituted thiourea compound, and it is described in JP-A-53-82408 and JP-A-55-77737. Preferred examples of the thiourea compound include tetramethylthiourea and 1,3-dimethyl-2-imidazolidinethione. While the amount of the silver halide solvent to be added may vary depending on the kind of the compound used, the desired grain size and halide composition of silver halide to be desired, it is preferably in the range of from $10^{-5}$ to $10^{-2}$ mol per mol of silver halide.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

In order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, JP-B-48-36890 and JP-B-52-16364, or a method of changing the concentration of the aqueous solution as described in U.S. Pat. No. 4,242,445 and JP-A-55-158124.

The silver halide emulsion used for the present invention preferably contains a metal complex having one or more cyanide ligands in an amount of $1\times10^{-6}$ mol or more, more preferably $5\times10^{-6}$ to $1\times10^{-2}$ mol, particularly preferably $5\times10^{-6}$ to $5\times10^{-3}$ mol, in the silver halide per mol of silver.

The metal complex having one or more cyanide ligands used for the present invention is added in the form of a water-soluble complex salt. Particularly preferred complexes include hexa-coordinated complexes represented by the following formula.

$$[M(CN)_{n1}L_{6-n1}]^{n-}$$

In the formula, M represents a metal belonging to any one of Groups V to VIII, and Ru, Re, Os and Fe are particularly preferred. L represents a ligand other than CN, and halide ligand, nitrosyl ligand, thionitrosyl ligand and so forth are preferred. n1 represents an integer of 1 to 6, and n represents 0, 1, 2, 3 or 4. n1 is preferably 6. In these compounds, the counter ion does not play any important role, and an ammonium ion or alkali metal ion is used.

Specific examples of the complexes used for the present invention are mentioned below. However, complexes that can be used for the present invention are not limited to these.

$[Re(NO)(CN)_5]^{2-}$ $[Re(O)_2(CN)_4]^{3-}$ $[Os(NO)(CN)_5]^{2-}$ $[Os(CN)_6]^{4-}$ $[OS(O)_2(CN)_4]^{4-}$ $[Ru(CN)_6]^{4-}$ $[Fe(CN)_6]^{4-}$

Although the metal complex used for the present invention may present at any site of silver halide grains, it preferably exists in the inside of silver halide grains. It is preferably exist in the inside of silver halide grains containing 99 mol % or less, preferably 95 mol % or less, more preferably 0 to 95 mol %, of silver of the silver halide crystals. To obtain such a structure, the light-sensitive silver halide grains are preferably formed so that they should contain multiple layers.

The silver halide emulsion used for the present invention preferably contains, besides the metal complex having one or more cyanide ligands, a rhodium compound, iridium compound, rhenium compound, ruthenium compound, osmium compound or the like in order to achieve high contrast and low fog.

As the rhodium compound used for the present invention, a water-soluble rhodium compound can be used. Examples thereof include rhodium(III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaaminerhodium(III) complex salt and trioxalatorhodium(III) complex salt. The rhodium compound is dissolved in water or an appropriate solvent prior to use, and a method commonly used for stabilizing the rhodium compound solution, that is, a method of adding an aqueous solution of hydrogen halide (e.g., hydrochloric acid, hydrobromic acid or hydrofluoric acid) or an alkali halide (e.g., KCl, NaCl, KBr or NaBr), may be used. In place of using a water-soluble rhodium, separate silver halide grains that have been previously doped with rhodium may be added and dissolved at the time of preparation of silver halide.

The rhenium, ruthenium or osmium compound used for the present invention is added in the form of a water-soluble complex salt described in JP-A-63-2042, JP-A-1-285941, JP-A-2-20852, JP-A-2-20855 and so forth. Particularly preferred examples are six-coordinate complex salts represented by the following formula:

$$[ML_6]^{n-}$$

In the formula, M represents Ru, Re or Os, L represents a ligand, and n represents 0, 1, 2, 3 or 4. In these complex salts, the counter ion plays no important role and an ammonium or alkali metal may be used. Preferred examples of the ligand include a halide ligand, a nitrosyl ligand, a thionitrosyl ligand and so forth. Specific examples of the complex that can be used for the present invention are shown below. However, the complexes that can be used for the present invention are not limited to these examples.

$[ReCl_6]^{3-}$ $[ReBr_6]^{3-}$ $[ReCl_5(NO)]^{2-}$ $[Re(NS)Br_5]^{2-}$ $[RuCl_6]^{3-}$ $[RuCl_4(H_2O)_2]^{-}$ $[RuCl_5(NO)]^{2-}$ $[RuBr_5(NS)]^{2-}$ $[Ru(CO)_3Cl_3]^{2-}$ $[Ru(CO)Cl_5]^{2-}$ $[Ru(CO)Br_5]^{2-}$ $[OsCl_6]^{3-}$ $[OsCl_5(NO)]^{2-}$ $[Os(NS)Br_5]^{2-}$

The amount of these compounds is preferably $1\times10^{-9}$ to $1\times10^{-5}$ mol, particularly preferably $1\times10^{-8}$ to $1\times10^{-6}$ mol, per mole of silver halide.

The iridium compounds used in the present invention include hexachloroiridium, hexabromoiridium, hexaammineiridium, pentachloronitrosyliridium and so forth.

The silver halide emulsion used for the present invention is preferably subjected to chemical sensitization. The chemical sensitization may be performed by using a known method such as sulfur sensitization, selenium sensitization, tellurium sensitization and noble metal sensitization. These sensitization methods may be used each alone or in any combination. When these sensitization methods are used in combination, preferable combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to the sulfur compounds contained in gelatin, various sulfur compounds such as thiosulfates, thioureas, thiazoles and rhodanines, among which thiosulfates and thioureas compounds are preferred. As the thiourea compounds, the tetra-substituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably $10^{-7}$ to $10^{-2}$ mol, more preferably $10^{-5}$ to $10^{-3}$ mol, per mol of silver halide.

The selenium sensitizer used for the present invention may be a known selenium compound. That is, the selenium sensitization is usually performed by adding a labile and/or non-labile selenium compound and stirring the emulsion at a high temperature of 40° C. or above for a predetermined time. Examples of the labile selenium compound include those described in JP-B-44-15748, JP-B-43-13489, JP-A-4-

109240 and JP-A-4-324855. Among these, particularly preferred are those compounds represented by formulas (VIII) and (IX) described in JP-A-4-324855.

The tellurium sensitizer that can be used for the present invention is a compound capable of producing silver telluride, presumably serving as a sensitization nucleus, on the surface or inside of silver halide grains. The formation rate of silver telluride in a silver halide emulsion can be examined according to the method described in JP-A-5-313284.

Specifically, there can be used the compounds described in U.S. Pat. Nos. 1,623,499, 3,320,069 and 3,772,031; British Patents Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds represented by the formulas (II), (III) and (IV) described in JP-A-4-324855 are particularly preferred.

The amount of the selenium or tellurium sensitizer used for the present invention varies depending on silver halide grains used, chemical ripening conditions and so forth. However, it is generally about $10^{-8}$ to about $10^{-2}$ mol, preferably about $10^{-7}$ to about $10^{-3}$ mol, per mol of silver halide. The conditions for chemical sensitization in the present invention are not particularly restricted. However, in general, pH is 5 to 8, pAg is 6 to 11, preferably 7 to 10, and temperature is 40 to 95° C., preferably 45 to 85° C.

Noble metal sensitizers that can be used for the present invention include gold, platinum, palladium, iridium and so forth, and gold sensitization is particularly preferred. Specific examples of the gold sensitizers used for the present invention include chloroauric acid, potassium chloroaurate, potassium aurithiocyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grains may be performed in the presence of a cadmium salt, sulfite, lead salt, thallium salt or the like.

In the present invention, reduction sensitization may be used. Examples of the reduction sensitizer include stannous salts, amines, formamidinesulfinic acid, silane compounds and so forth.

To the silver halide emulsion used in the present invention, a thiosulfonic acid compound may be added according to the method described in EP293917A.

In the silver halide photographic light-sensitive material of the present invention, one to three kinds of silver halide emulsions are preferably used. When two or more kinds of silver halide emulsions are used, for example, those having different average grain sizes, different halogen compositions, those containing different amount and/or types of metal complexes, those having different crystal habits, those subjected to chemical sensitizations with different conditions or those having different sensitivities, may be used in combination. In order to obtain high contrast, it is especially preferable to coat an emulsion having higher sensitivity as it becomes closer to a support as described in JP-A-6-324426.

The photosensitive silver halide emulsion may be spectrally sensitized with a sensitizing dye for comparatively long wavelength, i.e., blue light, green light, red light or infrared light. The compounds of the formula [I] mentioned in JP-A-55-45015 and the compounds of the formula [I] mentioned in JP-A-9-160185 are preferred, and the compounds of the formula [I] mentioned in JP-A-9-160185 are particularly preferred. Specifically, the compounds of (1) to (19) mentioned in JP-A-55-45015, the compounds of 1-1 to I-40 and the compounds of 1-56 to I-85 mentioned in JP-A-9-160185 and so forth can be mentioned.

Examples of the other sensitizing dyes include a cyanine dye, merocyanine dye, complex cyanine dye, complex merocyanine dye, holopolar cyanine dye, styryl dye, hemicyanine dye, oxonol dye, hemioxonol dye and so forth.

Other useful sensitizing dyes that can be used for the present invention are described in, for example, Research Disclosure, Item 17643, IV-A, page 23 (December, 1978); ibid., Item 18341X, page 437 (August, 1979) and references cited in the same.

In particular, sensitizing dyes having spectral sensitivity suitable for spectral characteristics of light sources in various scanners, image setters or photomechanical cameras can also be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to I-18 described in JP-A-59-192242; and E) for a tungsten or xenon light source of a photomechanical camera, besides the aforementioned compounds, Compounds I-41 to I-55 and Compounds I-86 to I-97 described in JP-A-9-160185, and Compounds 4-A to 4-S, Compounds 5-A to 5-Q, and Compounds 6-A to 6-T described in JP-A-6-242547 and so forth may also be advantageously selected.

These sensitizing dyes may be used individually or in combination, and a combination of sensitizing dyes is often used for the purpose of, in particular, supersensitization. In combination with a sensitizing dye, a dye which itself has no spectral sensitization effect, or a material that absorbs substantially no visible light, but exhibits supersensitization effect may be incorporated into the emulsion.

Useful sensitizing dyes, combinations of dyes that exhibit supersensitization effect, and materials that show supersensitization effect are described in, for example, Research Disclosure, Vol. 176, 17643, page 23, Item IV-J (December 1978); JP-B-49-25500, JP-B-43-4933, JP-A-59-19032, JP-A-59-192242 mentioned above and so forth.

The sensitizing dyes used for the present invention may be used in a combination of two or more of them. The sensitizing dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by the method disclosed in U.S. Pat. No. 3,469, 987, in which a dye is dissolved in a volatile organic solvent, the solution is dispersed in water or a hydrophilic colloid and the dispersion is added to the emulsion; the methods disclosed in JP-B-44-23389, JP-B-44-27555, JP-B-57-22091 and so forth, in which a dye is dissolved in an acid and the solution is added to the emulsion, or a dye is made into an aqueous solution in the presence of an acid or base and the solution is added to the emulsion; the method disclosed in U.S. Pat. Nos. 3,822,135, 4,006,025 or the like, in which a dye is made into an aqueous solution or a colloid dispersion in the presence of a surfactant, and the solution or colloid dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of red-shift and the solution is added to the emulsion. Ultrasonic waves may also be used for the preparation of the solution.

The sensitizing dye used for the present invention may be added to a silver halide emulsion at any step known to be useful during the preparation of emulsion. For example, the dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in, for example, JP-A-58-113920. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kinds of compounds or the kinds of the combinations of compounds added as divided portions may be changed.

The addition amount of the sensitizing dye used for the present invention varies depending on the shape, size, halogen composition of silver halide grains, method and degree of chemical sensitization, kind of antifoggant and so forth, but the addition amount may be $4\times10^{-6}$ to $8\times10^{-3}$ mol per mol of silver halide. For example, when the silver halide grain size is from 0.2 to 1.3 μm, the addition amount is preferably from $2\times10^{-7}$ to $3.5\times10^{-6}$, more preferably from $6.5\times10^{-7}$ to $2.0\times10^{-6}$ mol, per $m^2$ of the surface area of silver halide grains.

The silver halide photographic light-sensitive material of the present invention has a characteristic curve with a gamma of 4.0 or more, preferably 5.0 to 100, more preferably 5.0 to 30.

The "gamma" used in the present invention means inclination of a straight line connecting two points corresponding to optical densities of 0.1 and 1.5 on a characteristic curve drawn in orthogonal coordinates of optical density (y-axis) and common logarithm of light exposure (x-axis), in which equal unit lengths are used for the both axes. That is, when the angle formed by the straight line and the x-axis is represented by θ, the gamma is represented by tan θ.

In the present invention, in order to obtain the characteristic curve, the silver halide photographic light-sensitive material is processed by using a developer (QR-$D^1$ produced by Fuji Photo Film Co., Ltd) and a fixer (NF-1 produced by Fuji Photo Film Co., Ltd.) in an automatic developing machine (FG-680AG produced by Fuji Photo Film Co., Ltd) with development conditions of 35° C. for 30 seconds.

Various methods can be used as the method for obtaining a silver halide photographic light-sensitive material having the characteristic curve defined by the present invention. For example, gamma of the silver halide photographic light-sensitive material can be controlled by using silver halide emulsion containing a heavy metal that can realize high contrast (e.g., a metal belonging to Group VIII). It is particularly preferable to use a silver halide emulsion containing a rhodium compound, iridium compound, ruthenium compound or the like. Further, it is also preferable to add at least one kind of compound selected from hydrazine derivatives, amine compounds, phosphonium compounds and so forth as a nucleating agent on the side having an emulsion layer.

The silver halide photographic light-sensitive material of the present invention can contain a hydrazine compound as a nucleating agent. It particularly preferably contains at least one kind of compound represented by the following formula (D).

Formula (D)

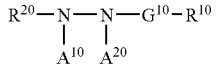

In the formula, $R^{20}$ represents an aliphatic group, an aromatic group or a heterocyclic group, $R^{10}$ represents a hydrogen atom or a blocking group, and $G^{10}$ represents —CO—, —COCO—, —C(=S)—, —$SO_2$—, —SO—, —PO($R^{30}$)— group ($R^{30}$ is selected from the same range of groups defined for $R^{10}$, and $R^{30}$ may be different from $R^{10}$) or an iminomethylene group. $A^{10}$ and $A^{20}$ both represent a hydrogen atom, or one of them represents a hydrogen atom and the other represents a substituted or unsubstituted alkylsulfonyl group, a substituted or unsubstituted arylsulfonyl group or a substituted or unsubstituted acyl group.

In the formula (D), the aliphatic group represented by $R^{20}$ is preferably a substituted or unsubstituted straight, branched or cyclic alkyl, alkenyl or alkynyl group having 1 to 30 carbon atoms.

In the formula (D), the aromatic group represented by $R^{20}$ is a monocyclic or condensed-ring aryl group. Examples of the ring include benzene ring and naphthalene ring. The heterocyclic group represented by $R^{20}$ is a monocyclic or condensed-ring, saturated or unsaturated, aromatic or non-aromatic heterocyclic group. Examples of the ring include pyridine ring, pyrimidine ring, imidazole ring, pyrazole ring, quinoline ring, isoquinoline ring, benzimidazole ring, thiazole ring, benzothiazole ring, piperidine ring, triazine ring and so forth.

$R^{20}$ is preferably an aryl group, especially preferably a phenyl group.

The group represented by $R^{20}$ may be substituted with a substituent. Typical examples of the substituent include, for example, a halogen atom (fluorine, chlorine, bromine or iodine atom), an alkyl group (including an aralkyl group, a cycloalkyl group, an active methine group etc.), an alkenyl group, an alkynyl group, an aryl group, a heterocyclic group, a quaternized nitrogen atom-containing heterocyclic group (e.g., pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing a repeating unit of ethyleneoxy group or propyleneoxy group), an aryloxy group, a heterocyclyloxy group, an acyloxy group, an (alkoxy or aryloxy)carbonyloxy group, a carbamoyloxy group, a sulfonyloxy group, an amino group, an (alkyl, aryl or heterocyclyl)amino group, an N-substituted nitrogen-containing heterocyclic group, an acylamino group, a sulfonamido group, a ureido group, a thioureido group, a isothioureido group, an imido group, an (alkoxy or aryloxy) carbonylamino group, a sulfamoylamino group, a semicarbazido group, a thiosemicarbazido group, a hydrazino group, a quaternary ammonio group, an oxamoylamino group, an (alkyl or aryl)sulfonylureido group, an acylureido group, an N-acylsulfamoylamino group, a nitro group, a mercapto group, an (alkyl, aryl or heterocyclyl)thio group, an (alkyl or aryl)sulfonyl group, an (alkyl or aryl)sulfinyl group, a sulfo group or a salt thereof, a sulfamoyl group, an N-acylsulfamoyl group, a sulfonylsulfamoyl group or a salt thereof, a group having phosphoric acid amide or phosphoric acid ester structure and so forth.

These substituents may be further substituted with any of these substituents.

Preferred examples of the substituent that $R^{20}$ may have include an alkyl group having 1 to 30 carbon atoms (including an active methylene group), an aralkyl group, a heterocyclic group, a substituted amino group, an acylamino group, a sulfonamido group, a ureido group, a sulfamoylamino group, an imido group, a thioureido group, a phosphoric acid amido group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl or heterocyclyl)thio group, a sulfo group or a salt thereof, a sulfamoyl group, a halogen atom, a cyano group, a nitro group and so forth.

In the formula (D), $R^{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group and a hydrazino group.

The alkyl group represented by $R^{10}$ is preferably an alkyl group having 1 to 10 carbon atoms. Examples of the alkyl group include methyl group, trifluoromethyl group, difluoromethyl group, 2-carboxytetrafluoroethyl group, pyridiniomethyl group, difluoromethoxymethyl group, difluorocarboxymethyl group, 3-hydroxypropyl group, methanesulfonamidomethyl group, benzenesulfonamidomethyl group, hydroxymethyl group, methoxymethyl group, methylthiomethyl group, phenylsulfonylmethyl group, o-hydroxybenzyl group and so forth. The alkenyl group is preferably an alkenyl group having 1 to 10 carbon atoms. Examples of the alkenyl group include vinyl group, 2,2-dicyanovinyl group, 2-ethoxycarbonylvinyl group, 2-trifluoro-2-methoxycarbonylvinyl group and so forth. The alkynyl group is preferably an alkynyl group having 1 to 10 carbon atoms. Examples of the alkynyl group include ethynyl group, 2-methoxycarbonylethynyl group and so forth. The aryl group is preferably a monocyclic or condensed-ring aryl group, and especially preferably an aryl group containing a benzene ring. Examples of the aryl group include phenyl group, 3,5-dichlorophenyl group, 2-methanesulfonamidophenyl group, 2-carbamoylphenyl group, 4-cyanophenyl group, 2-hydroxymethylphenyl group and so forth.

The heterocyclic group is preferably a 5- or 6-membered, saturated or unsaturated, monocyclic or condensed-ring heterocyclic group that contains at least one nitrogen, oxygen or sulfur atom, and it may be a heterocyclic group containing a quaternized nitrogen atom. Examples of the heterocyclic group include a morpholino group, a piperidino group (N-substituted), a piperazino group, an imidazolyl group, an indazolyl group (e.g., 4-nitroindazolyl group etc.), a pyrazolyl group, a triazolyl group, a benzimidazolyl group, a tetrazolyl group, a pyridyl group, a pyridinio group (e.g., N-methyl-3-pyridinio group), a quinolinio group, a quinolyl group and so forth. Among these, especially preferred are a morpholino group, a piperidino group, a pyridyl group, a pyridinio group and so forth.

The alkoxy group is preferably an alkoxy group having 1 to 8 carbon atoms. Examples of the alkoxy group include methoxy group, 2-hydroxyethoxy group, benzyloxy group and so forth. The aryloxy group is preferably a phenyloxy group. The amino group is preferably an unsubstituted amino group, an alkylamino group having 1 to 10 carbon atoms, an arylamino group or a saturated or unsaturated heterocyclylamino group (including a quaternized nitrogen atom-containing heterocyclic group). Examples of the amino group include 2,2,6,6-tetramethylpiperidin-4-ylamino group, propylamino group, 2-hydroxyethylamino group, anilino group, o-hydroxyanilino group, 5-benzotriazolylamino group, N-benzyl-3-pyridinioamino group and so forth. The hydrazino group is especially preferably a substituted or unsubstituted hydrazino group, a substituted or unsubstituted phenylhydrazino group (e.g., 4-benzenesulfonamidophenylhydrazino group) or the like.

The group represented by $R^{10}$ may be substituted with a substituent. Preferred examples of the substituent are the same as those exemplified as the substituent of $R^{20}$.

In the formula (D), $R^{10}$ may be a group capable of splitting the $G^{10}$-$R^{10}$ moiety from the residual molecule and subsequently causing a cyclization reaction that produces a cyclic structure containing atoms of the -$G^{10}$-$R^{10}$ moiety. Examples of such a group include those described in, for example, JP-A-63-29751 and so forth.

The hydrazine derivatives represented by the formula (D) may contain an absorptive group capable of being absorbed onto silver halide. Examples of the absorptive group include an alkylthio group, an arylthio group, a thiourea group, a thioamido group, a mercaptoheterocyclic group, a triazole group and so forth, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

$R^{10}$ or $R^{20}$ in the formula (D) may contain a polymer or ballast group that is usually used for immobile photographic additives such as couplers. The ballast group used in the present invention means a group having 6 or more carbon atoms including such a linear or branched alkyl group (or an alkylene group), an alkoxy group (or an alkyleneoxy group), an alkylamino group (or an alkyleneamino group), an alkylthio group or a group having any of these groups as a partial structure, more preferably a group having 7 to 24 carbon atoms including such a linear or branched alkyl group (or an alkylene group), an alkoxy group (or an alkyleneoxy group), an alkylamino group (or an alkyleneamino group), an alkylthio group or a group having any of these groups as a partial structure. Examples of the polymer include those described in, for example, JP-A-1-100530.

$R^{10}$ or $R^{20}$ in the formula (D) may contain a plurality of hydrazino groups as substituents. In such a case, the compound represented by the formula (D) is a multi-mer for hydrazino group. Specific examples of such a compound include those described in, for example, JP-A-64-86134, JP-A-4-16938, JP-A-5-197091, WO95/32452, WO95/32453, JP-A-9-179229, JP-A-9-235264, JP-A-9-235265, JP-A-9-235266, JP-A-9-235267 and so forth.

$R^{10}$ or $R^{20}$ in the formula (D) may contain a cationic group (specifically, a group containing a quaternary ammonio group, a group containing a quaternized phosphorus atom, a nitrogen-containing heterocyclic group containing a quaternized nitrogen atom etc.), a group containing repeating units of ethyleneoxy group or propyleneoxy group, an (alkyl, aryl or heterocyclyl)thio group, or a dissociating group (this means a group or partial structure having a proton of low acidity that can be dissociated with an alkaline developer or a salt thereof, specifically, for example, carboxyl group (—COOH), sulfo group (—$SO_3H$), phosphonic acid group (—$PO_3H$), phosphoric acid group (—$OPO_3H$), hydroxy group (—OH), mercapto group (—SH), —$SO_2NH_2$ group, N-substituted sulfonamido group (—$SO_2NH$—, —$CONHSO_2$— group, —$CONHSO_2NH$— group, —$NHCONHSO_2$— group, —$SO_2NHSO_2$— group), —CONHCO— group, active methylene group, —NH— group contained in a nitrogen-containing heterocyclic group, a salt thereof etc.). Examples of the compounds containing these groups include those described in, for example, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032, JP-A-11-7093 and so forth.

In the formula (D), $A^{10}$ and $A^{20}$ each represent a hydrogen atom or an alkyl- or arylsulfonyl group having 20 or less carbon atoms (preferably, phenylsulfonyl group, or a phenylsulfonyl group substituted with substituent(s) so that the total of the Hammett substituent constant of the substituent(s) should become −0.5 or more), or an acyl group having 20 or less carbon atoms (preferably, benzoyl group, a benzoyl group substituted with substituent(s) so that the total of the Hammett substituent constant of the substituent(s) should become −0.5 or more, or a straight, branched or cyclic, substituted or unsubstituted aliphatic acyl group (examples of the substituent include a halogen atom, an ether group, a sulfonamido group, a carbonamido group, a hydroxyl group, a carboxyl group, a sulfo group etc.)). $A^{10}$ and $A^{20}$ each most preferably represent a hydrogen atom.

Hereafter, hydrazine derivatives especially preferably used for the present invention will be explained.

$R^{20}$ is especially preferably a substituted phenyl group. Particularly preferred as the substituent are a sulfonamido group, an acylamino group, a ureido group, a carbamoyl group, a thioureido group, an isothioureido group, a sulfamoylamino group, an N-acylsulfamoylamino group and so forth, further preferred are a sulfonamido group and a ureido group, and the most preferred is a sulfonamido group.

The hydrazine derivatives represented by the formula (D) particularly preferably have at least one substituent, directly or indirectly on $R^{20}$ or $R^{10}$, selected from the group consisting of a ballast group, a group that can be absorbed on silver halide, a group containing quaternary ammonio group, a nitrogen-containing heterocyclic group containing a quaternized nitrogen atom, a group containing repeating units of ethyleneoxy group, an (alkyl, aryl or heterocyclyl)thio group, a dissociating group capable of dissociating in an alkaline developer, and a hydrazino group capable of forming a multi-mer (group represented by —NHNH-$G^{10}$-$R^{10}$). Furthermore, $R^{20}$ preferably directly or indirectly has one group selected from the aforementioned groups as a substituent, and $R^{20}$ is most preferably a phenyl group substituted with a benzenesulfonamido group directly or indirectly having one of the aforementioned groups as a substituent on the benzene ring.

Among those groups represented by $R^{10}$, when $G^{10}$ is —CO— group, preferred are a hydrogen atom, an alkyl group, an alkenyl group, an alkynyl group, an aryl group and a heterocyclic group, more preferred are a hydrogen atom, an alkyl group or a substituted aryl group (the substituent is especially preferably an electron-withdrawing group or o-hydroxymethyl group), and the most preferred are a hydrogen atom and an alkyl group.

When $G^{10}$ is —COCO— group, an alkoxy group, an aryloxy group and an amino group are preferred, and a substituted amino group, specifically an alkylamino group, an arylamino group and a saturated or unsaturated heterocyclylamino group are especially preferred.

Further, when $G^{10}$ is —$SO_2$— group, $R^{10}$ is preferably an alkyl group, an aryl group or a substituted amino group.

In the formula (D), $G^{10}$ is preferably —CO— group or —COCO— group, especially preferably —CO— group.

Specific examples of the compounds represented by the formula (D) are illustrated below. However, the present invention is not limited to the following compounds.

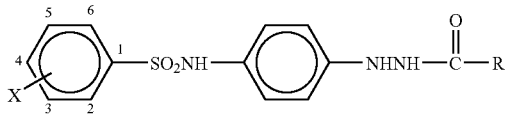
| | X= | R= —H | —$C_2F_4COOH$ (or —$C_2F_4COO^{\ominus}\ {}^{\oplus}K$) | 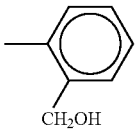 | 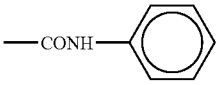 |
|---|---|---|---|---|---|
| D-1 | 3-$NHCOC_9H_{19}$(n) | 1a | 1b | 1c | 1d |
| D-2 | 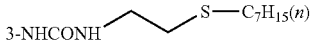 | 2a | 2b | 2c | 2d |
| D-3 | 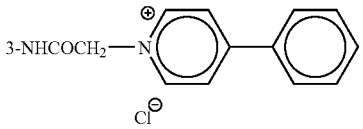 | 3a | 3b | 3c | 3d |
| D-4 | 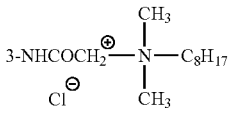 | 4a | 4b | 4c | 4d |
| D-5 | 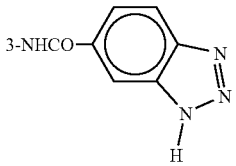 | 5a | 5b | 5c | 5d |
| D-6 | 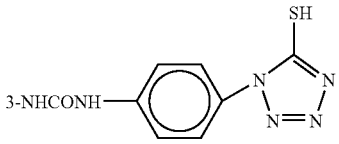 | 6a | 6b | 6c | 6d |
| D-7 | 2,4—$(CH_3)_2$, 3-$SC_2H_4$—$(OC_2H_4)_4$—$OC_8H_{17}$ | 7a | 7b | 7c | 7d |
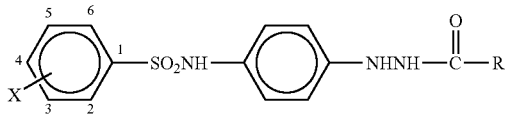
| | X= | R= —H | —$CF_2H$ | 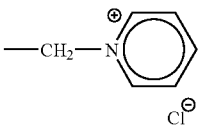 | 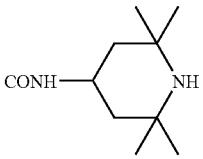 |
|---|---|---|---|---|---|
| D-8 | 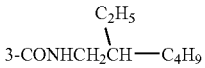 | 8a | 8e | 8f | 8g |
| D-9 | 6-$OCH_3$-3-$C_5H_{11}$(t) | 9a | 9e | 9f | 9g |

-continued
| | | | | | |
|---|---|---|---|---|---|
| D-10 | 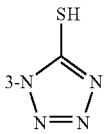 | 10a | 10e | 10f | 10g |
| D-11 | 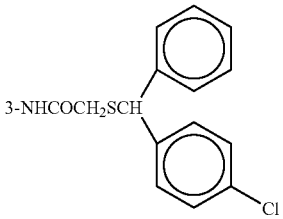 | 11a | 11e | 11f | 11g |
| D-12 | 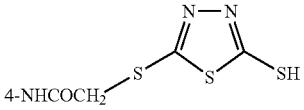 | 12a | 12e | 12f | 12g |
| D-13 | 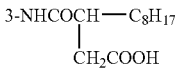 | 13a | 13e | 13f | 13g |
| D-14 | 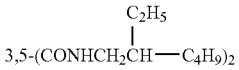 | 14a | 14e | 14f | 14g |
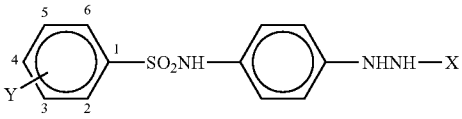
| | Y= | X= —CHO | —$COCF_3$ | —$SO_2CH_3$ | —P(=O)$(OC_2H_5)_2$ |
|---|---|---|---|---|---|
| D-15 | 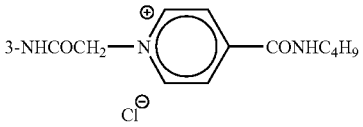 | 15a | 15h | 15i | 15j |
| D-16 | 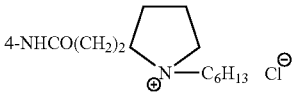 | 16a | 16h | 16i | 16j |
| D-17 | 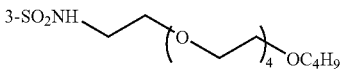 | 17a | 17h | 17i | 17j |
| D-18 | 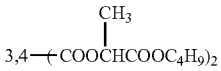 | 18a | 18h | 18i | 18j |
| D-19 | 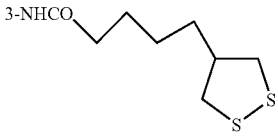 | 19a | 19h | 19i | 19j |
| D-20 | 3-$NHSO_2NH$—$C_8H_{17}$ | 20a | 20h | 20i | 20j |

-continued
| | | | | | |
|---|---|---|---|---|---|
| D-21 | 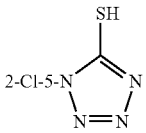 | 21a | 21h | 21i | 21j |
| | | R= | |
|---|---|---|---|
| | | —H | —$CF_2H$ |
| D-22 | 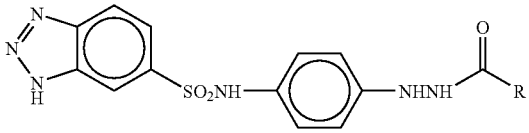 | 22a | 22e |
| D-23 | 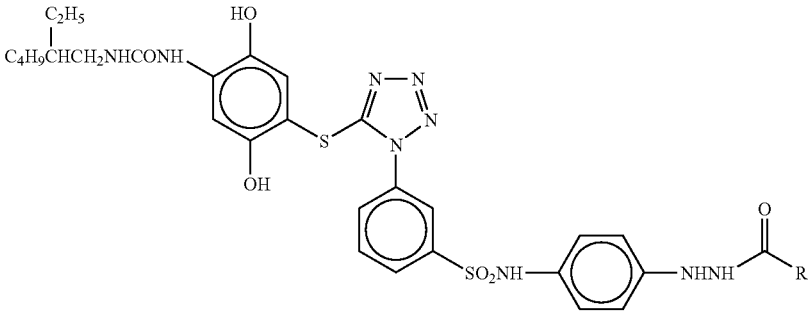 | 23a | 23e |
| D-24 | 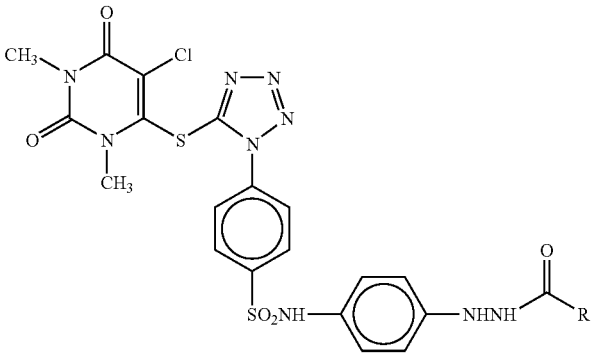 | 24a | 24e |
| D-25 | 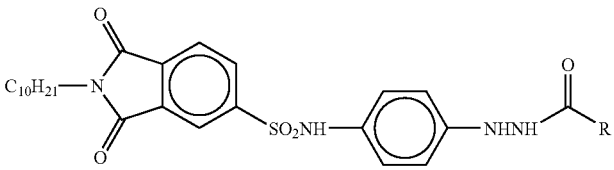 | 25a | 25e |
| D-26 | 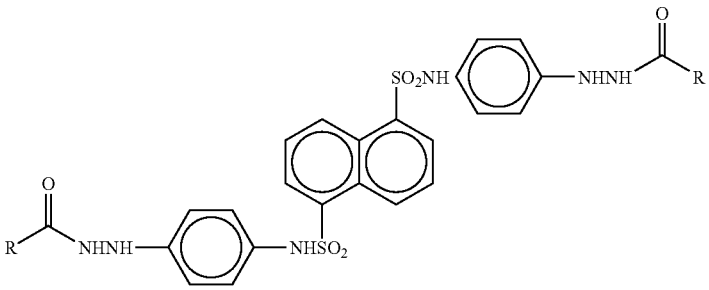 | 26a | 26e |

-continued
D-27 27a 27e
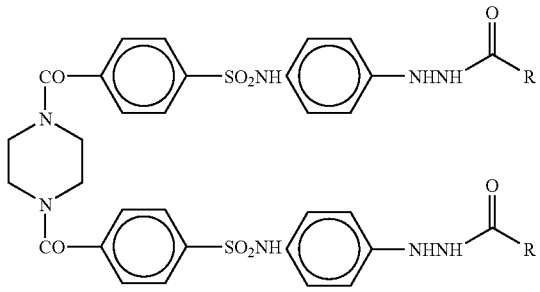
D-28 28a 28e
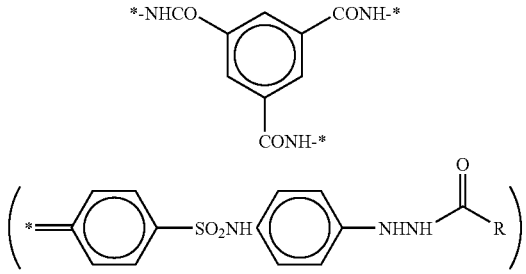
R=
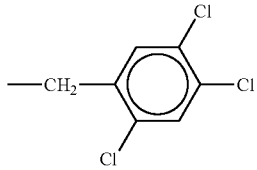
D-22 22k
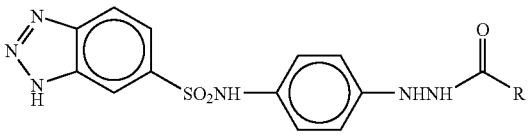
D-23 23k
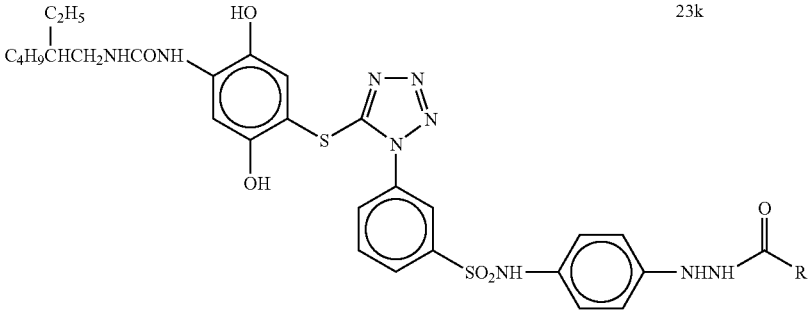
D-24 24k
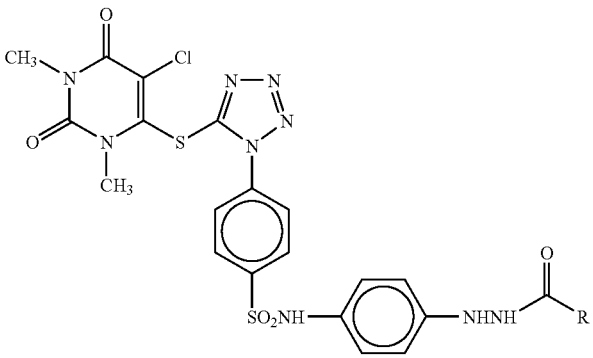

-continued
D-25 25k
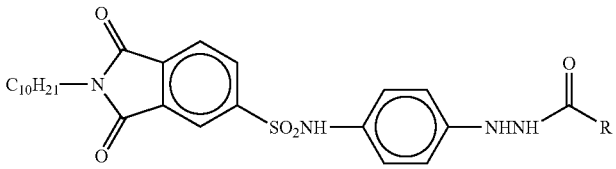
D-26 26k
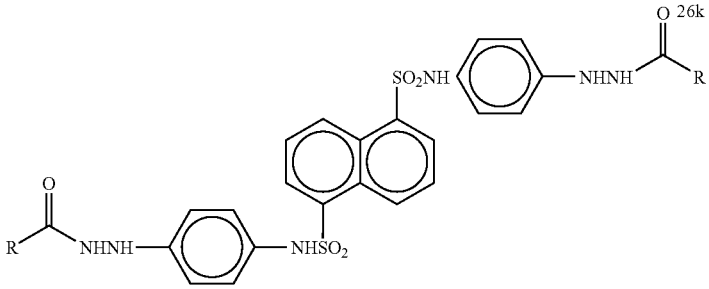
D-27 27k
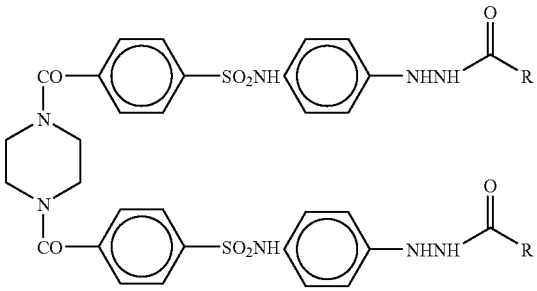
D-28 28k
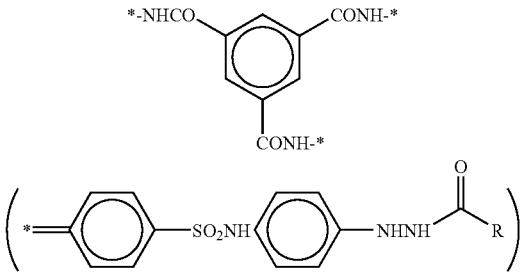
R=
—$CONHC_3H_7$
D-22 22l
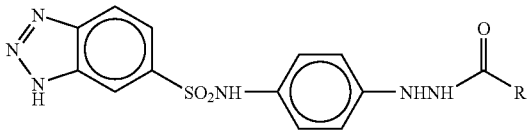
D-23 23l
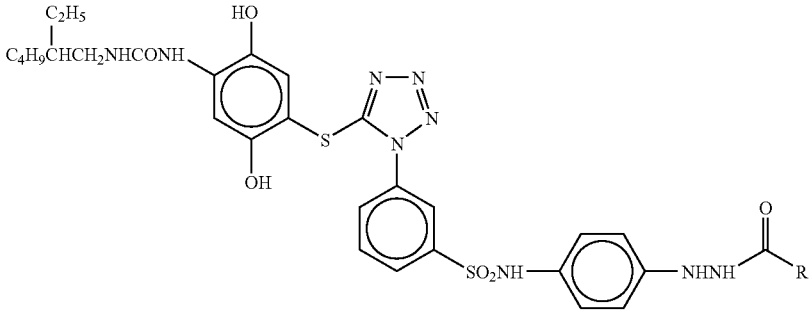

-continued
D-24 241
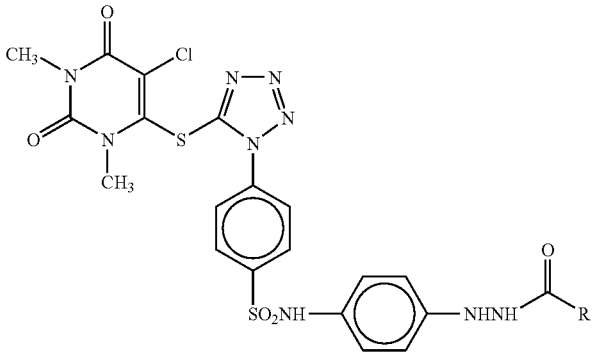
D-25 251
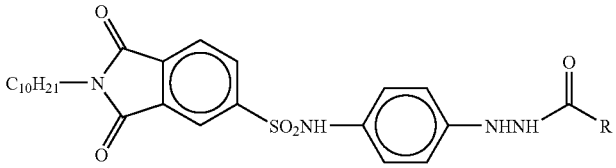
D-26 261
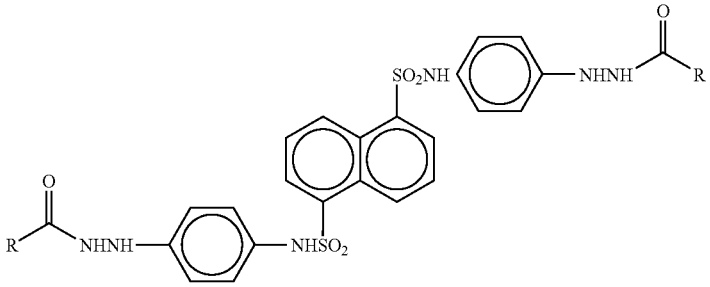
D-27 271
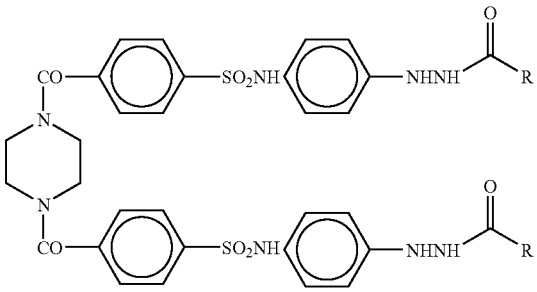
D-28 281
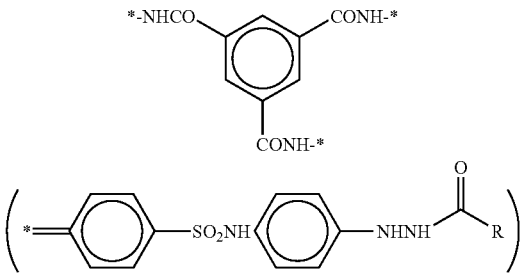

-continued
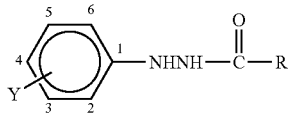
| Y= | R= —H | —$CH_2OCH_3$ | 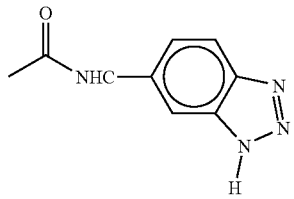 | 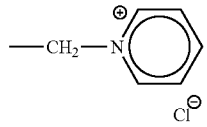 |
|---|---|---|---|---|
| D-29 4-NHC(=S)NH—$C_8H_{17}$(*n*) | 29a | 29m | 29n | 29f |
| D-30 4-NHP(=S)($OCH_2$-Ph)$_2$ | 30a | 30m | 30n | 30f |
| D-31 4-NHCONH—$(CH_2)_3O$-Ph-C(CH$_3$)$_3$ | 31a | 31m | 31n | 31f |
| D-32 4-OH, 3-NHCONH$CH_2$CH($C_2H_5$)—$C_4H_9$ | 32a | 32m | 32n | 32f |
| D-33 4-$NHSO_2(CH_2)_2NHCO$-Ph-(5-SH-tetrazolyl) | 33a | 33m | 33n | 33f |
| D-34 4-$OCH_2$-Ph | 34a | 34m | 34n | 34f |
| D-35 4-NHCONHN(—$CH_2$-Ph)$_2$ | 35a | 35m | 35n | 35f |
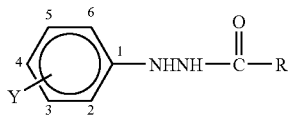
| Y= | R= —H | —$C_3F_4$—COOH | —$CONHCH_2$ | 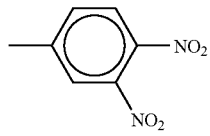 |
|---|---|---|---|---|
| D-36 2-$NHSO_2CH_3$—, 4-$NHCONH(CH_2)_3S$—(H) | 36a | 36o | 36p | 36q |

-continued
| | | | | | |
|---|---|---|---|---|---|
| D-37 | 2-$OCH_2$—<br>4-$NHSO_2C_{12}H_{25}$ | 37a | 37o | 37p | 37q |
| D-38 | 2-$NHCOC_{11}H_{23}$—<br>4-$NHSO_2CF_3$ | 38a | 38o | 38p | 38q |
| D-39 | 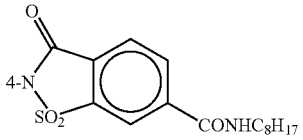 | 39a | 39o | 39p | 39q |
| D-40 | 4-$OCO(CH_2)_2COOC_6H_{13}$ | 40a | 40o | 40p | 40q |
| D-41 | 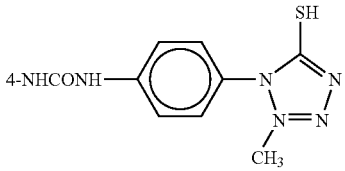 | 41a | 41o | 41p | 41q |
| D-42 | 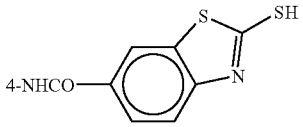 | 42a | 42o | 42p | 42q |
D-43
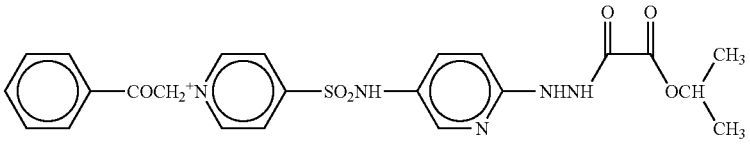
D-44
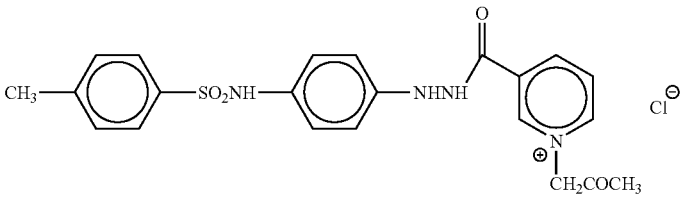
D-45
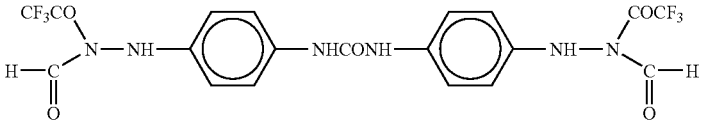
D-46
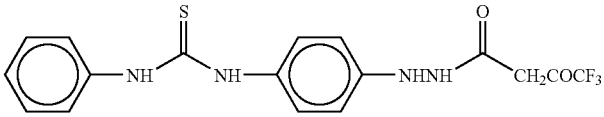
D-47
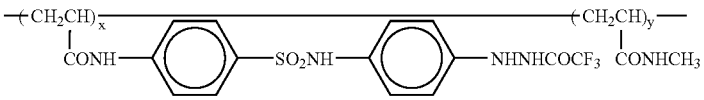
x:y = 3:97
Mw ≈ 100,000
D-48
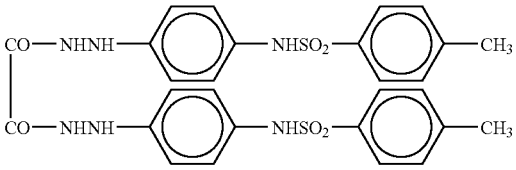

-continued
D-49
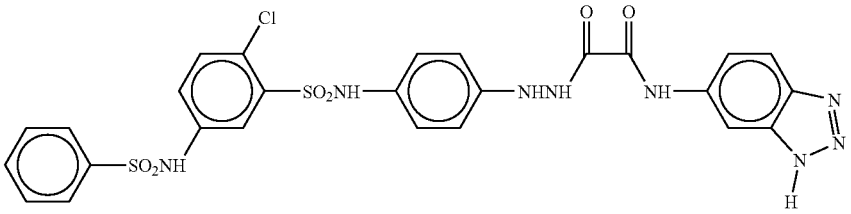
No.
D-50
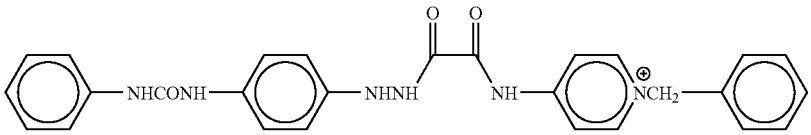
D-51
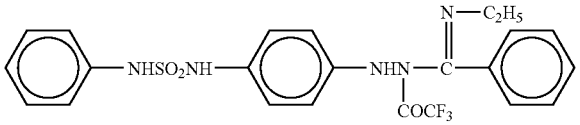
D-52
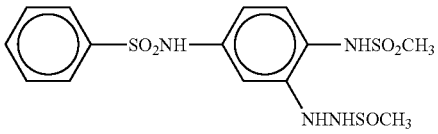
D-53
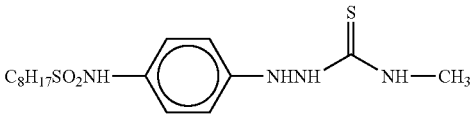
D-54
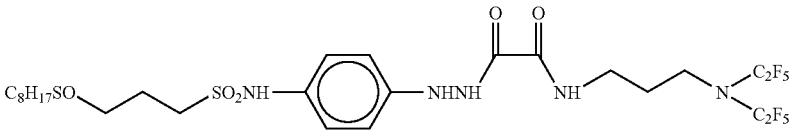
D-55
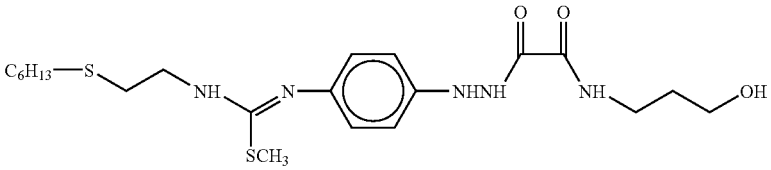
D-56
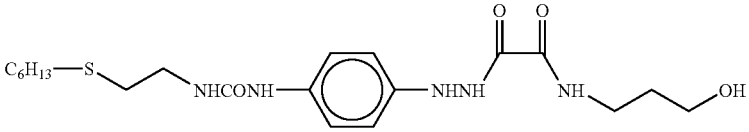
D-57
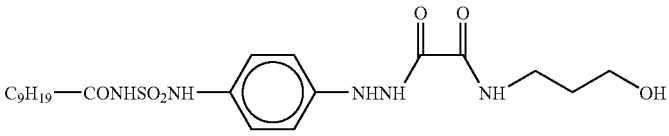

-continued
D-58
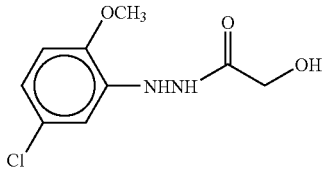
D-59
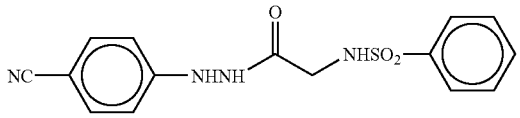
D-60
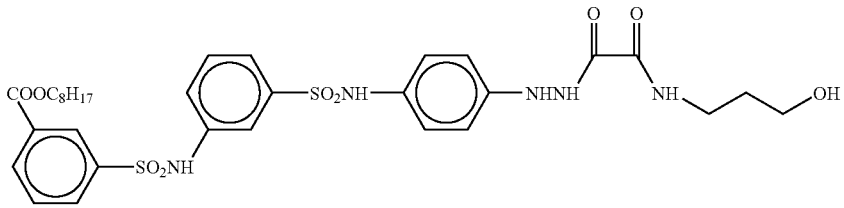
D-61
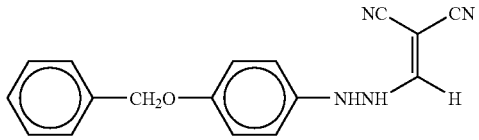
D-62
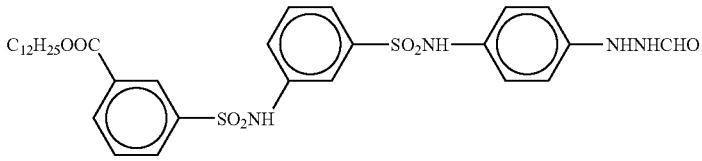
D-63
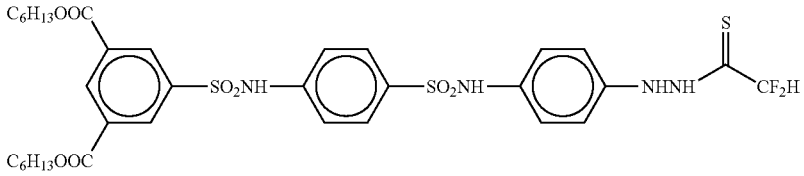
D-64
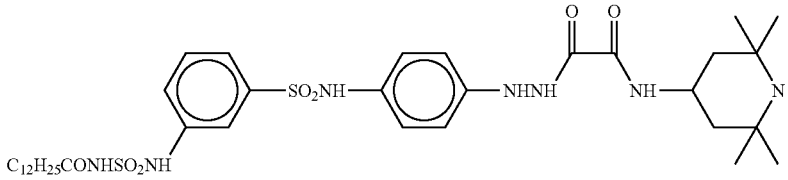
D-65
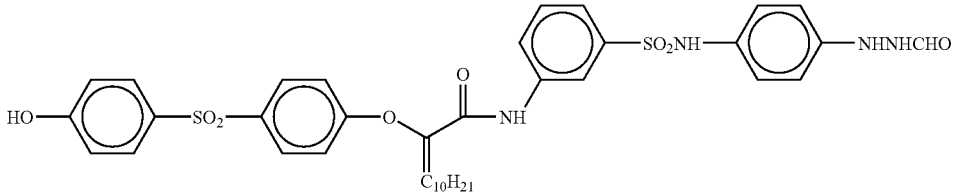

-continued
D-66
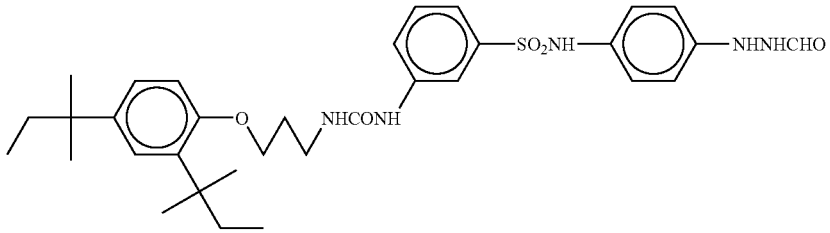
D-67
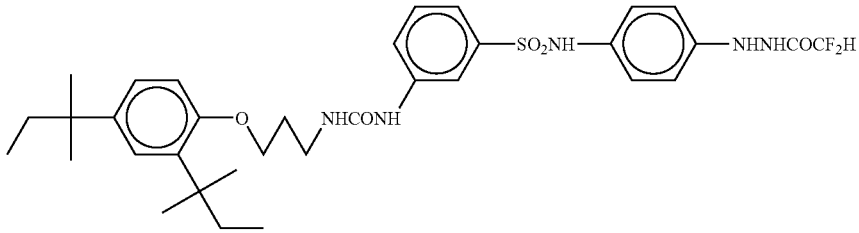
(D-68)
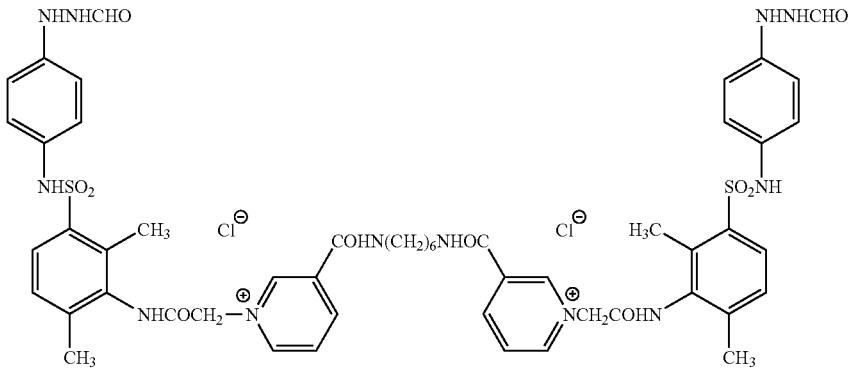
(D-69)
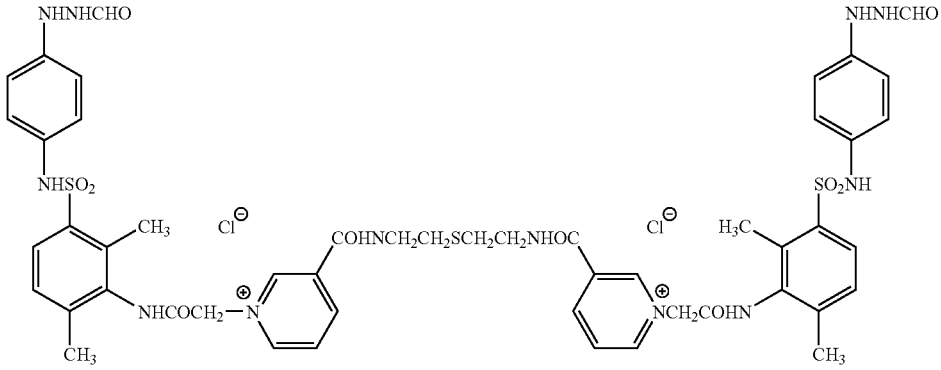
(D-70)
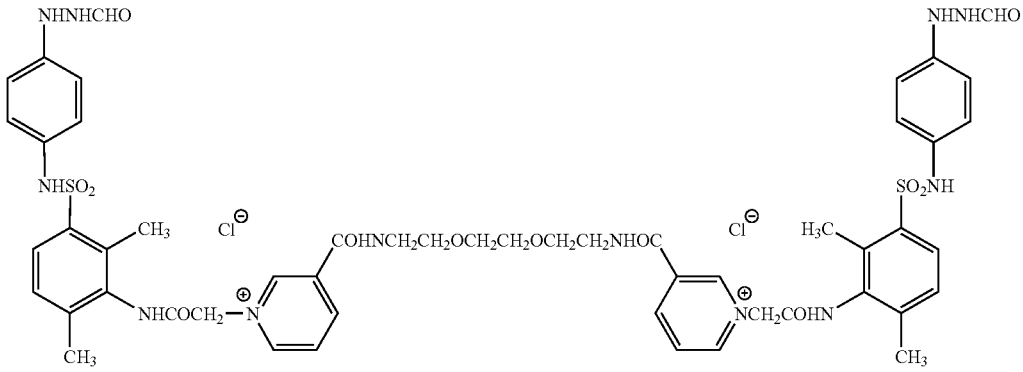

-continued
(D-71)
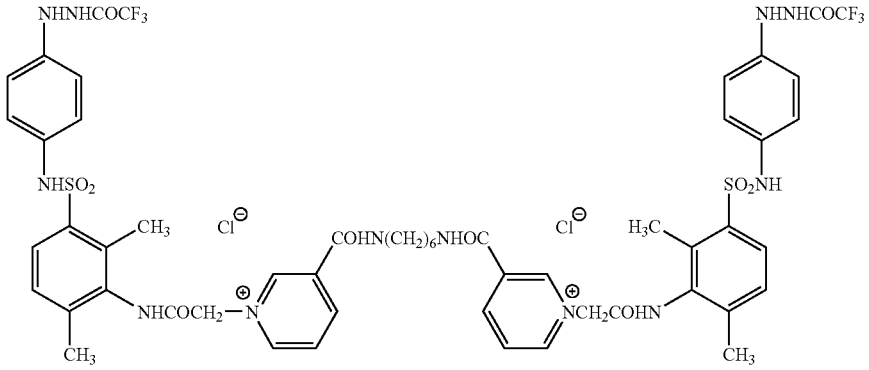
(D-72)
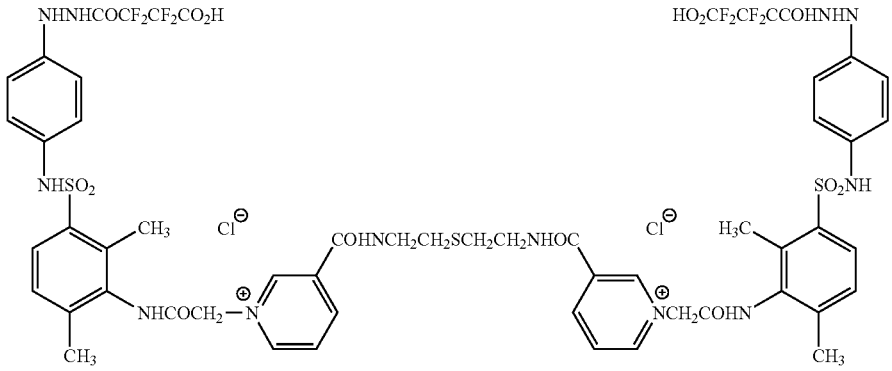
(D-73)
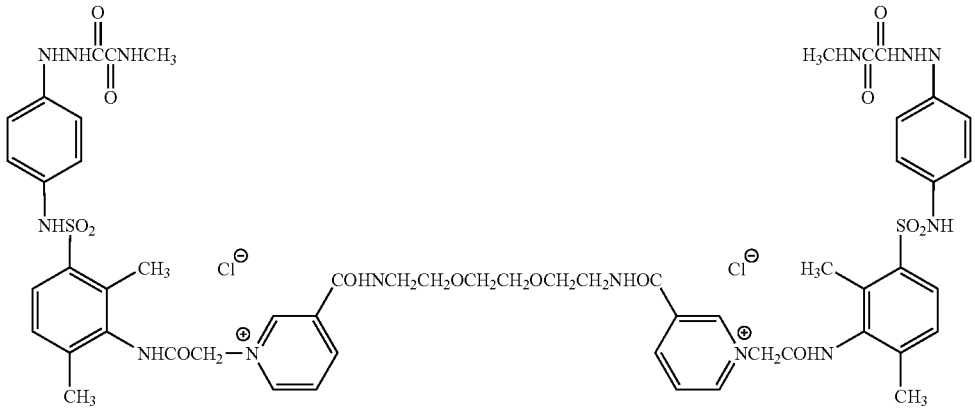
(D-74)
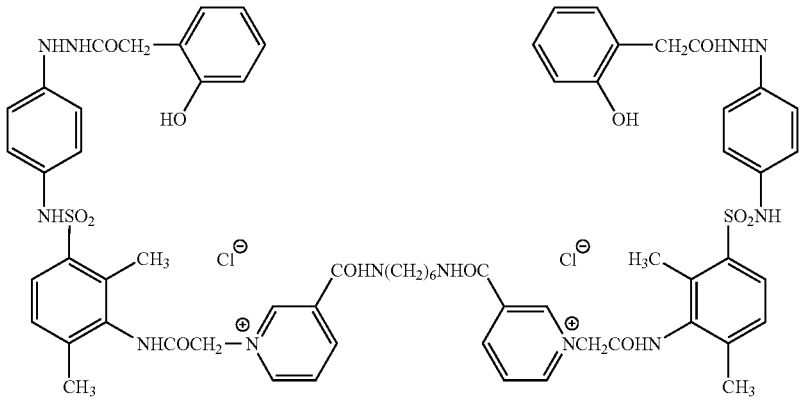

-continued
(D-75)
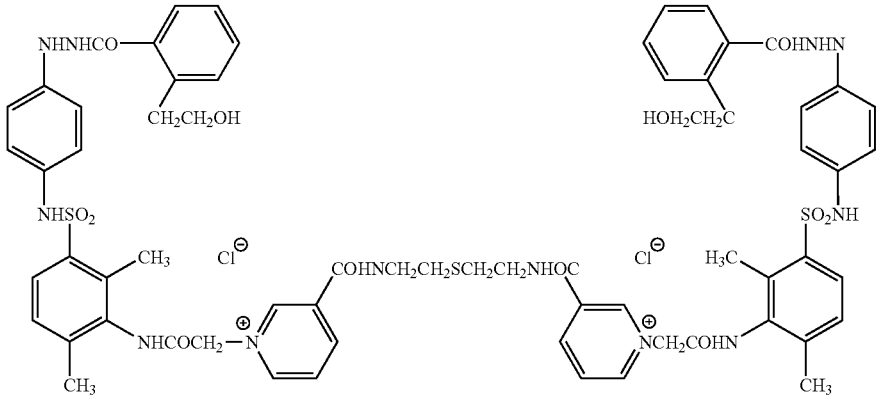
(D-76)
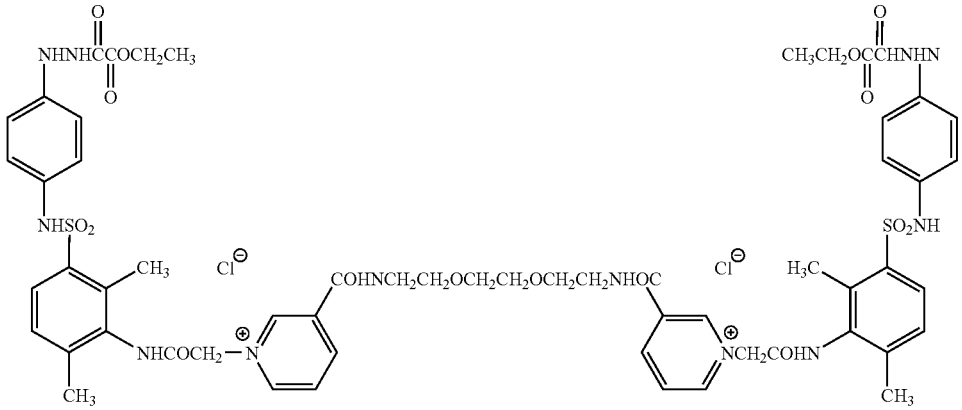
(D-77)
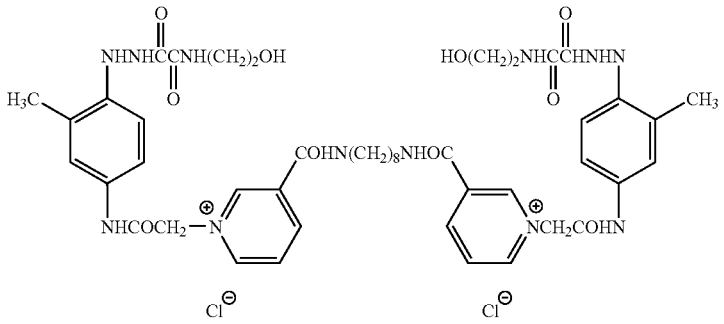
(D-78)
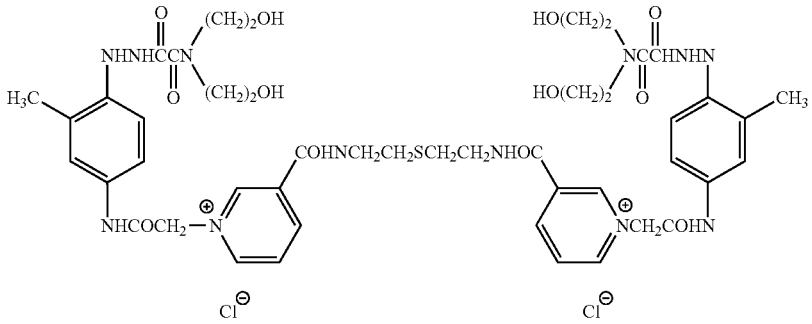

-continued
(D-79)
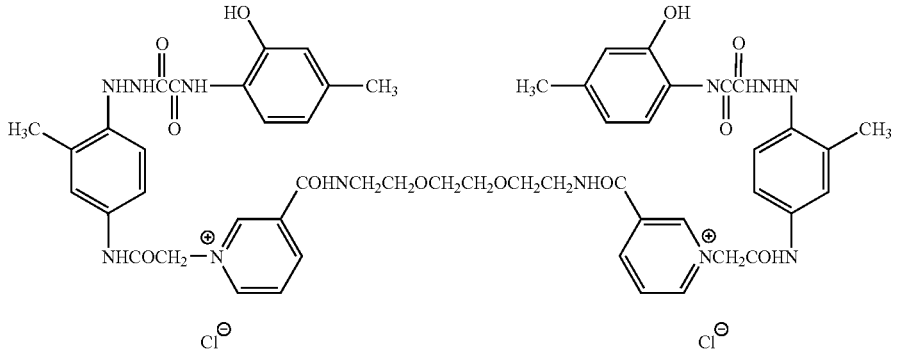
(D-80)
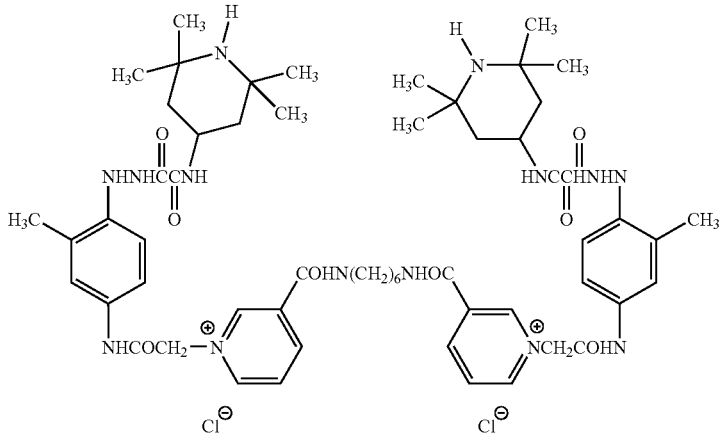
(D-81)
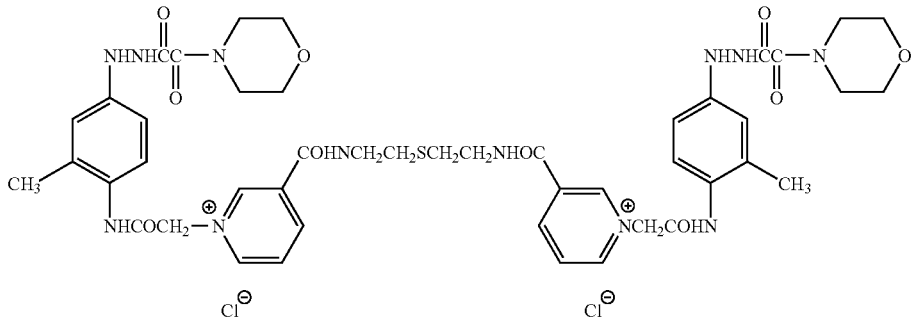
(D-82)
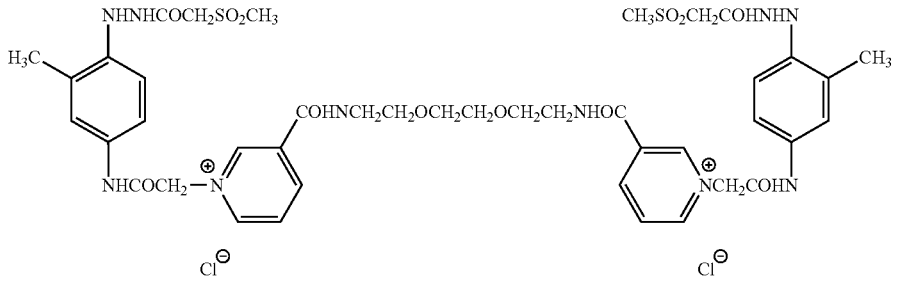

-continued
(D-83)
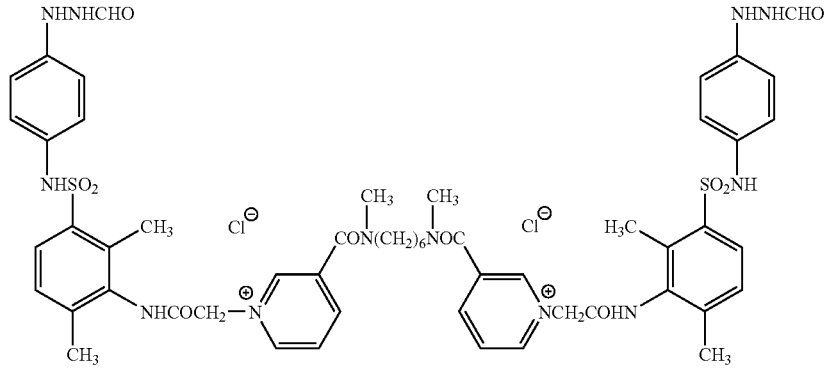
(D-84)
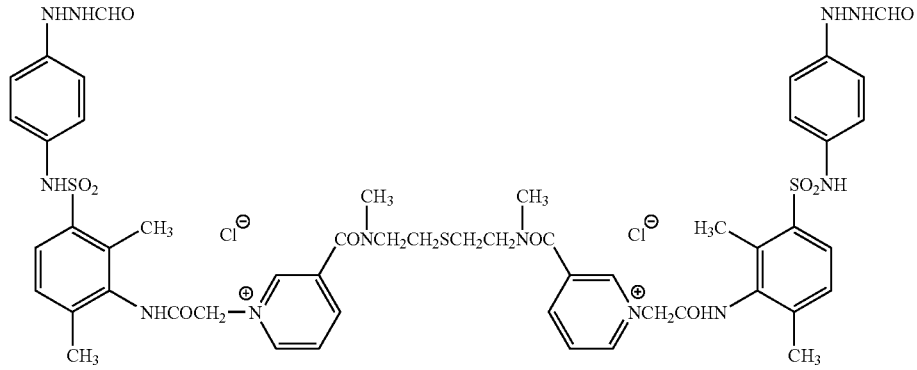
(D-85)
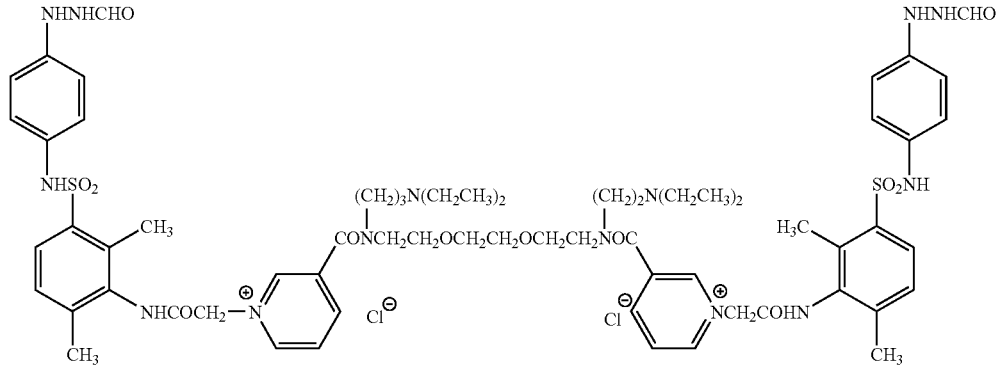
(D-86)
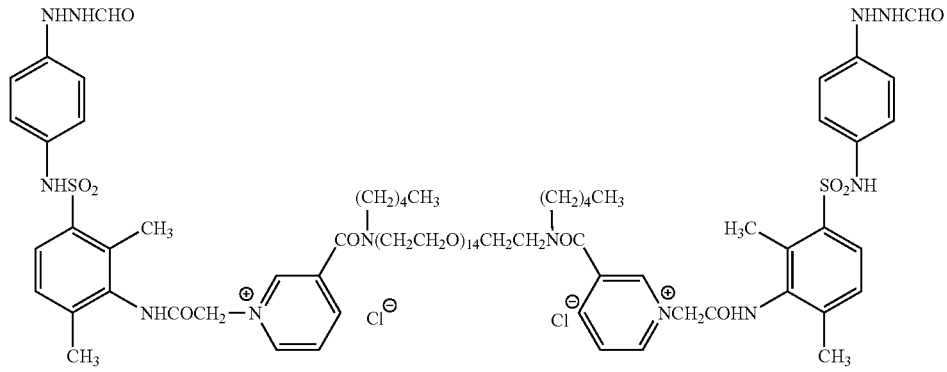

-continued
(D-87)
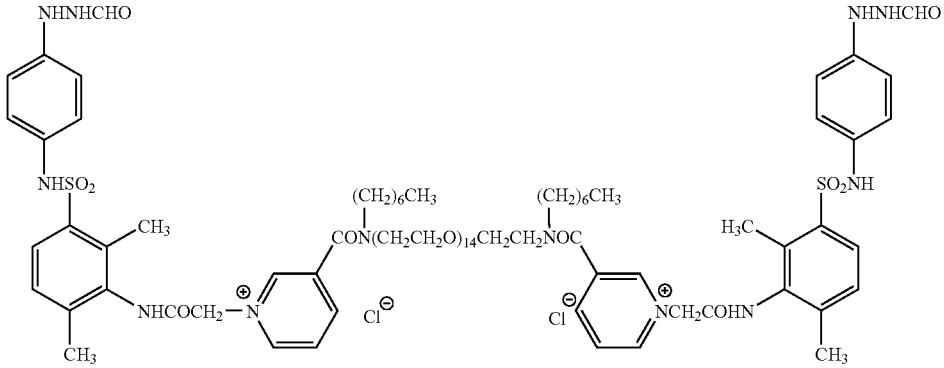
(D-88)
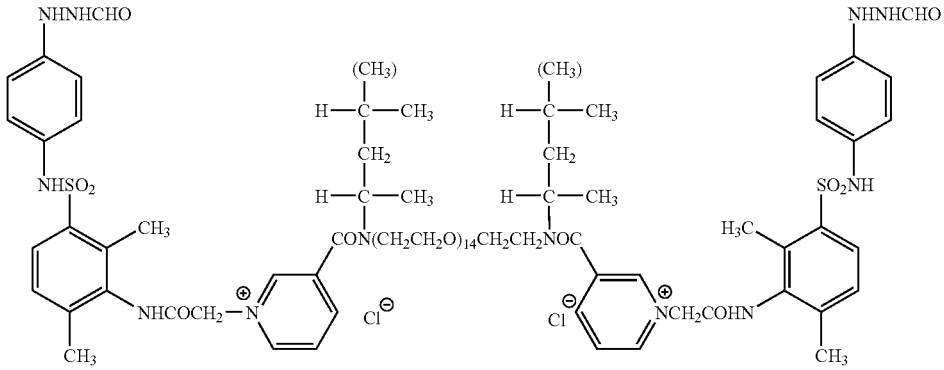
(D-89)
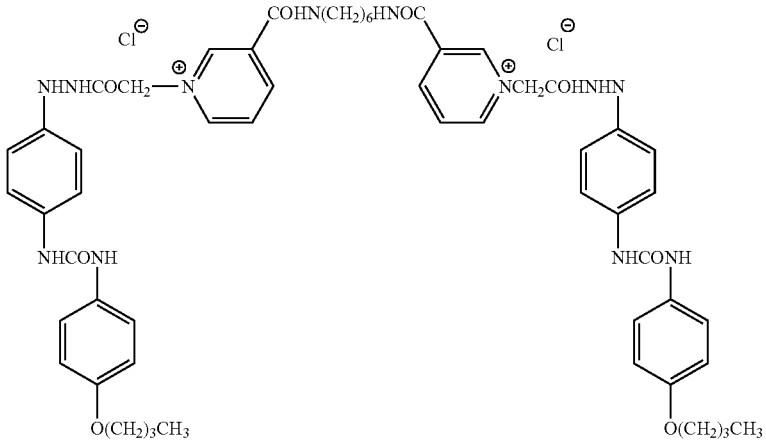
(D-90)
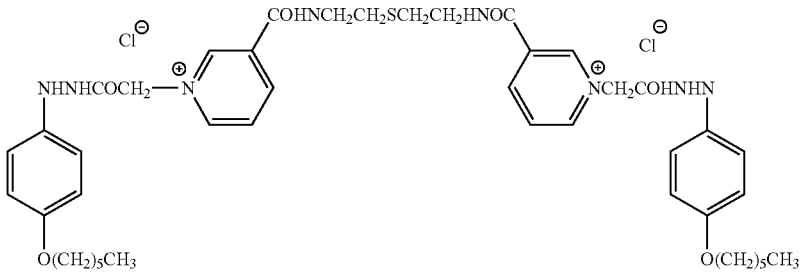

-continued
(D-91)
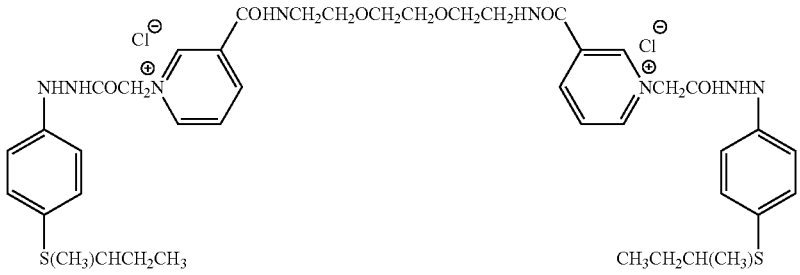
(D-92)
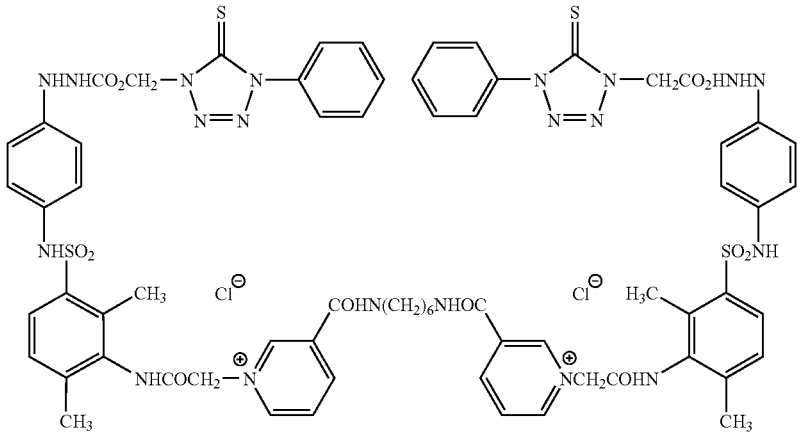
(D-93)
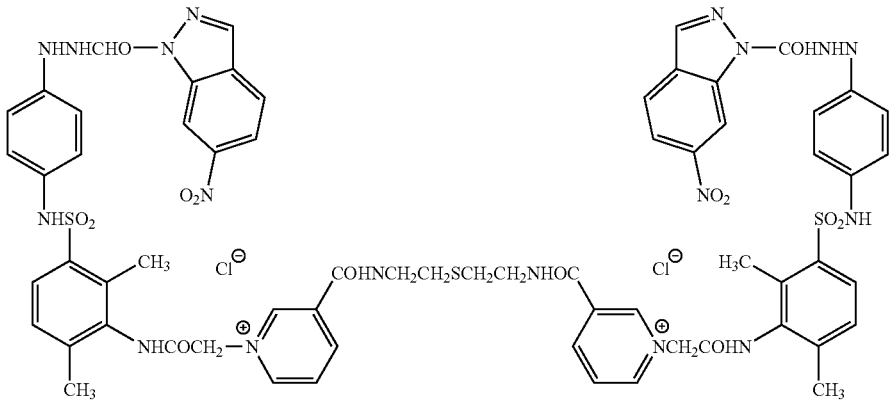
(D-94)
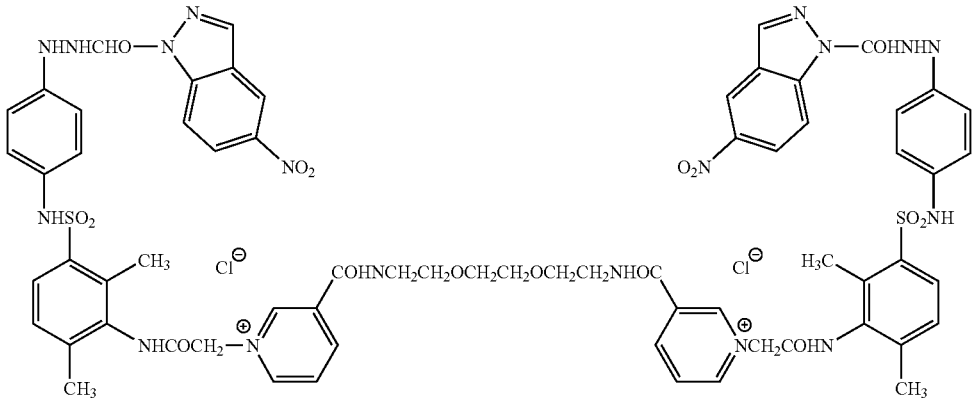

-continued
(D-95)
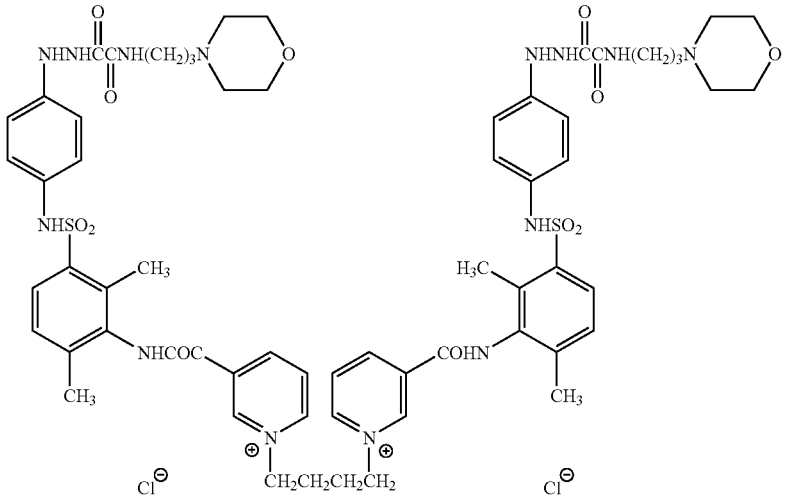
(D-96)
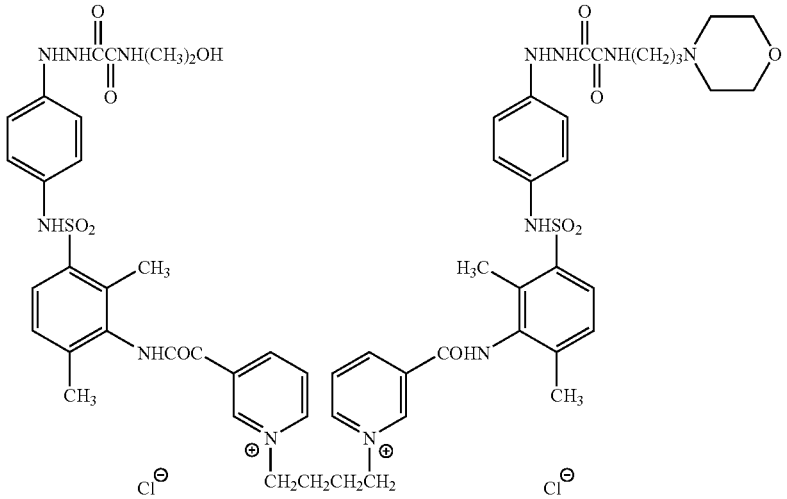
(D-97)
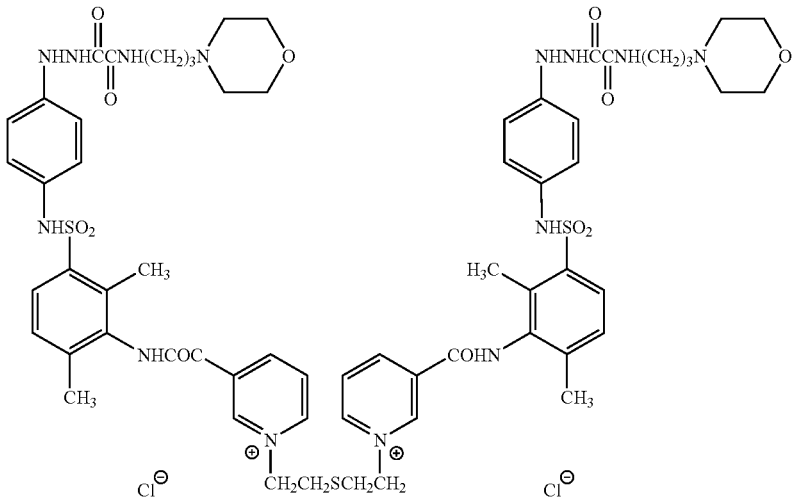

-continued
(D-98)
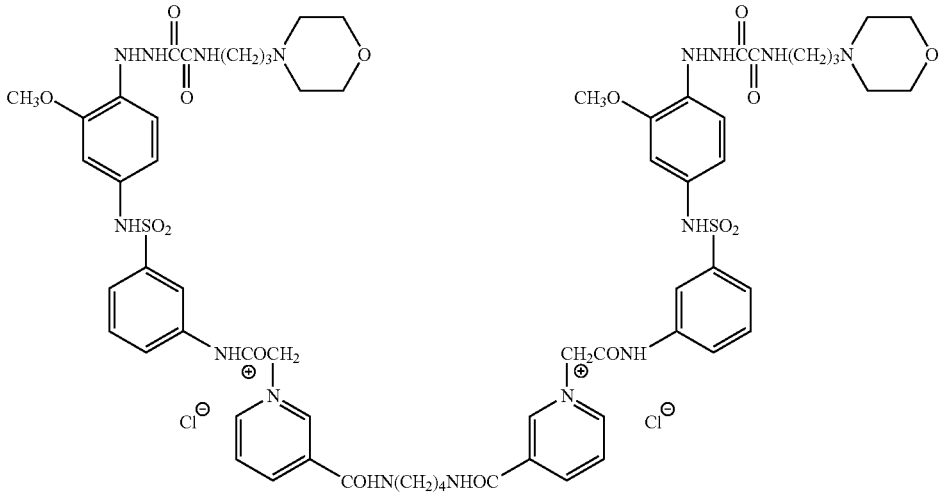
(D-99)
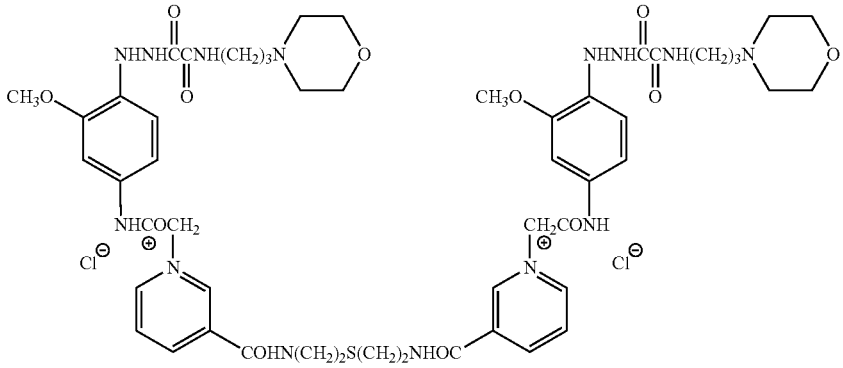
(D-100)
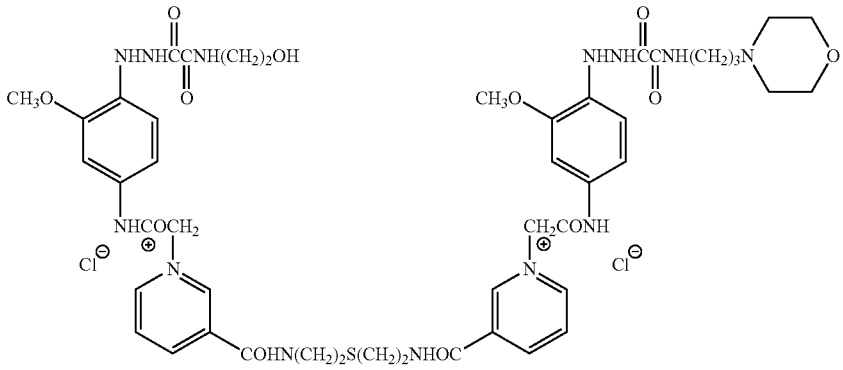

-continued
(D-101)
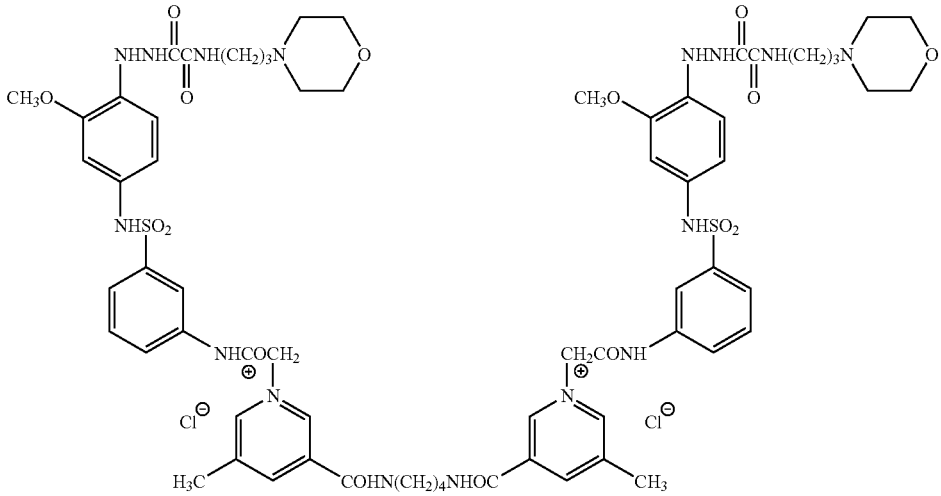
(D-102)
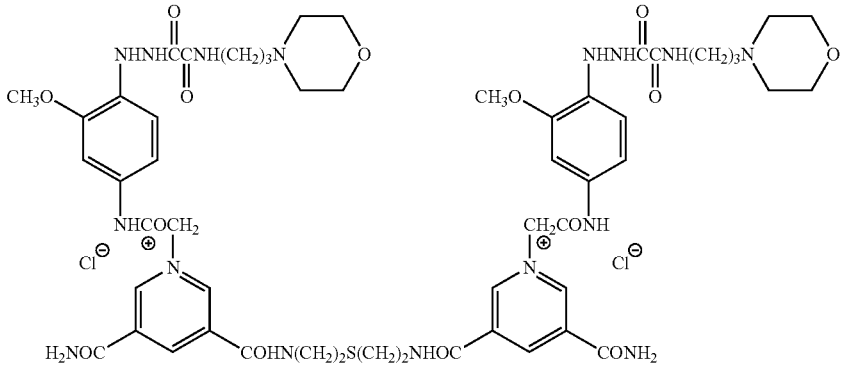
(D-103)
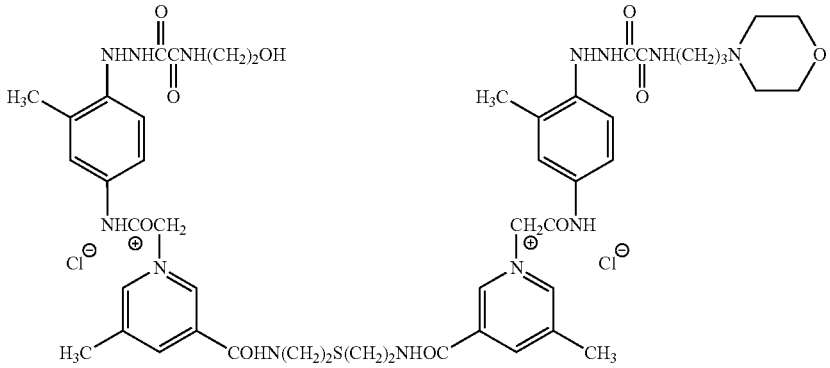

-continued
(D-104)
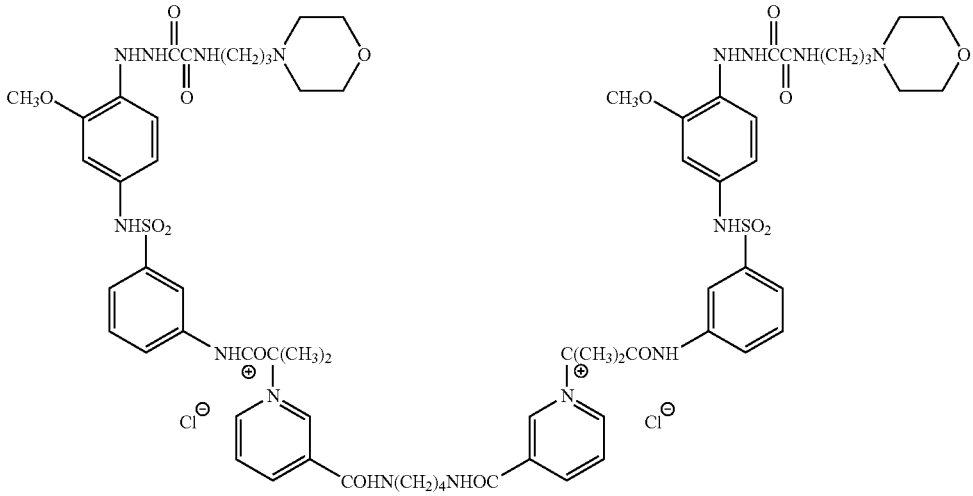
(D-105)
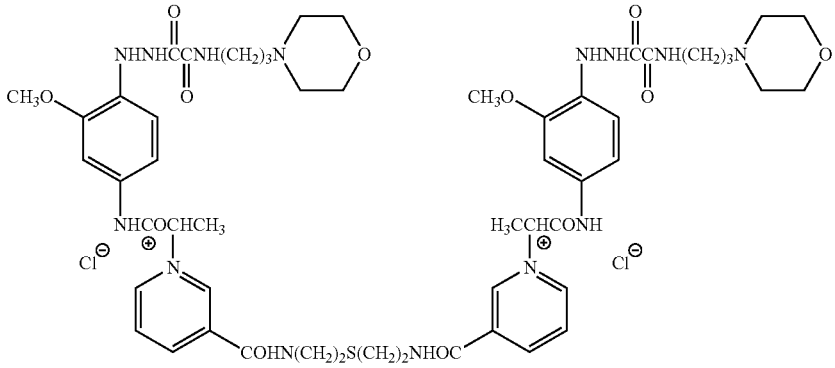
(D-106)
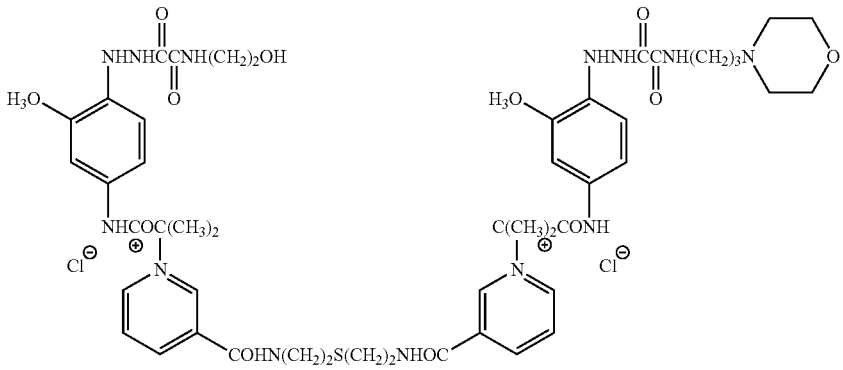

-continued
(D-107)
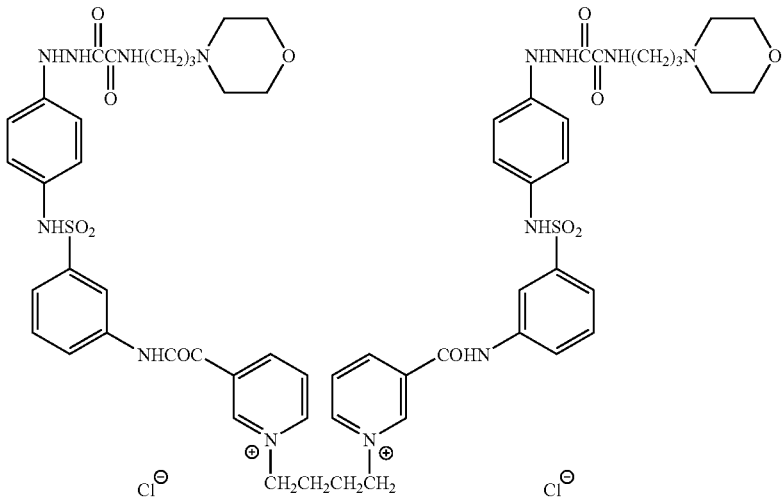
(D-108)
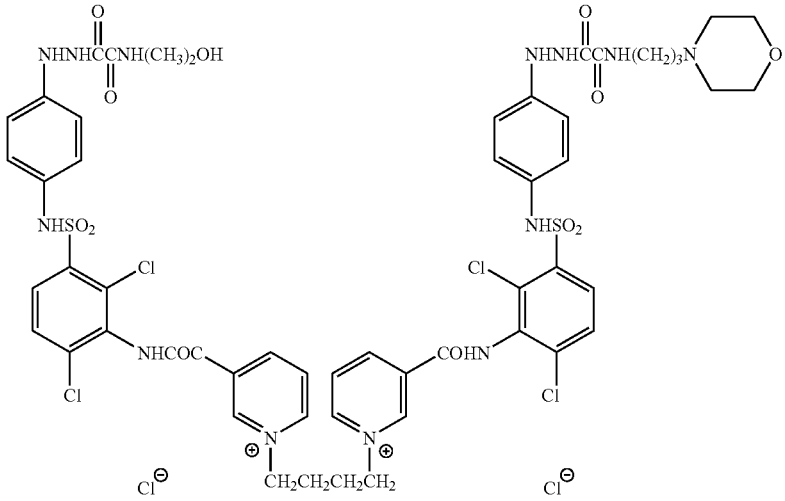
(D-109)
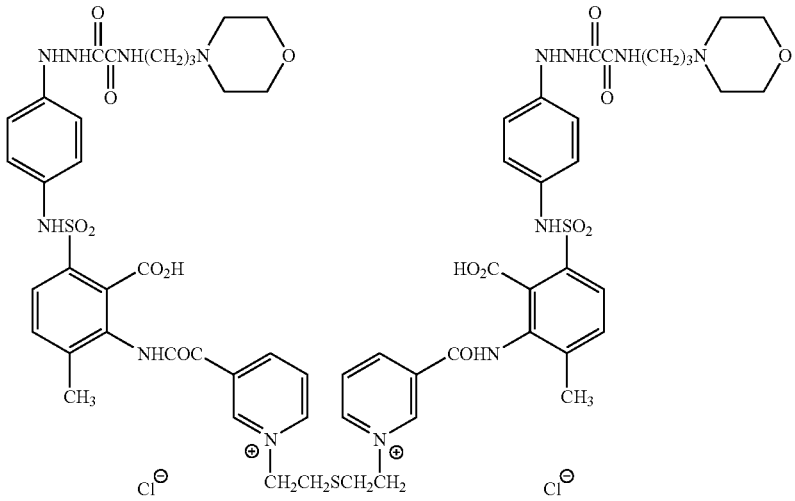

-continued
(D-110)
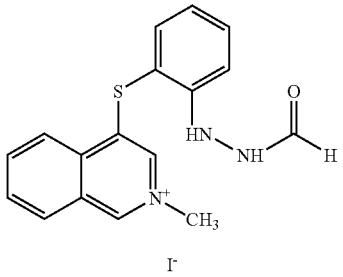
(D-111)
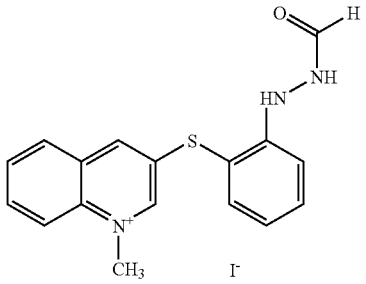
(D-112)
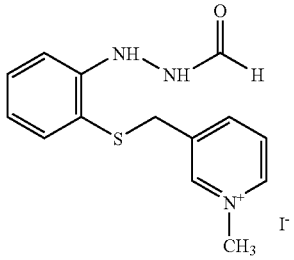
(D-113)
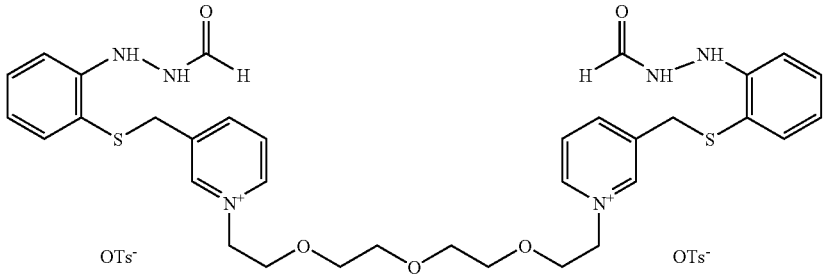
(D-114)
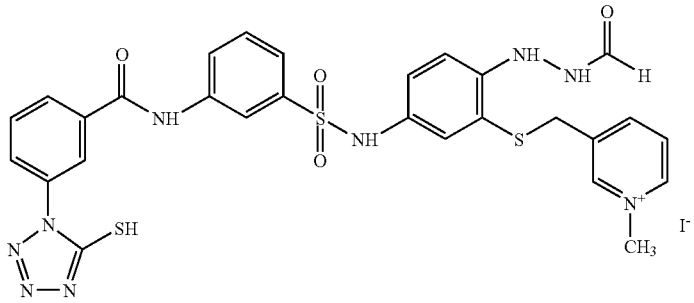

-continued
(D-115)
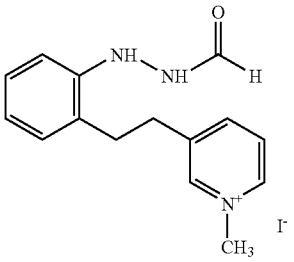
(D-116)
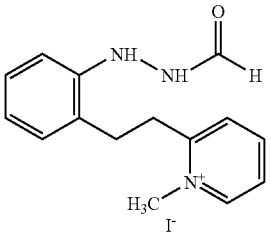
(D-117)
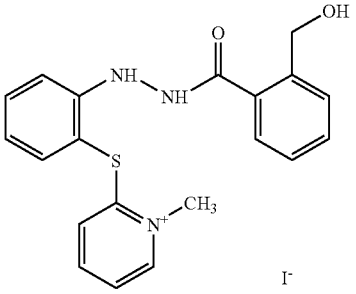
(D-118)
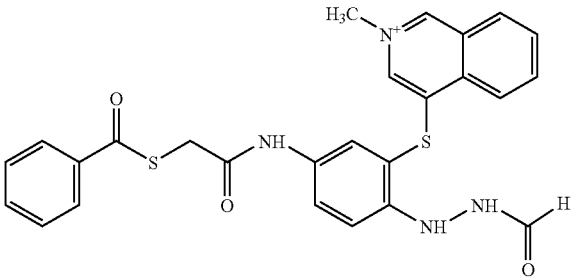
(D-119)
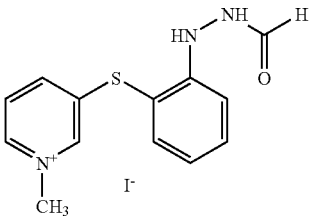
(D-120)
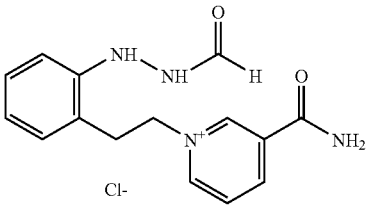

-continued
(D-121)
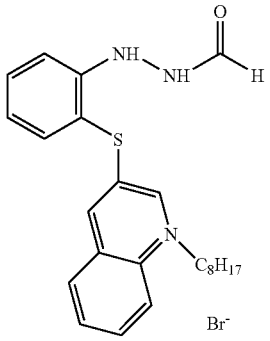
(D-122)
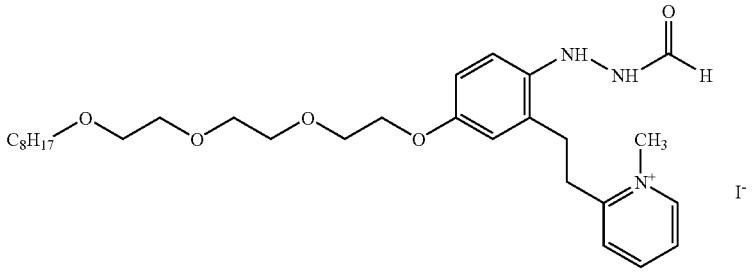
(D-123)
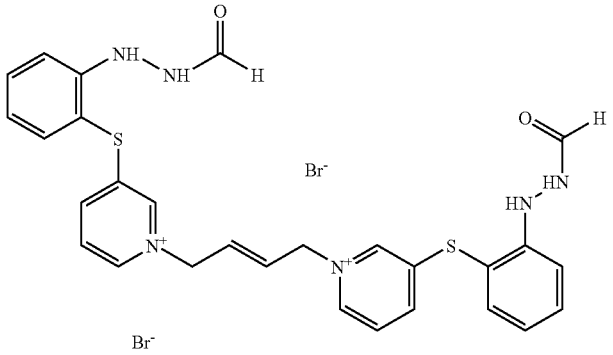
(D-124)
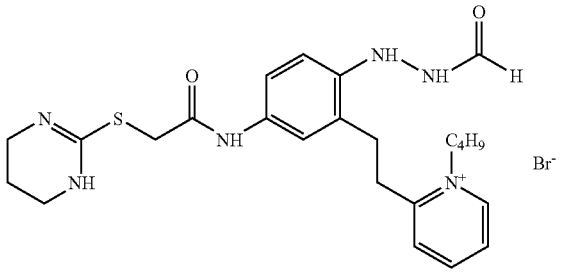
(D-125)
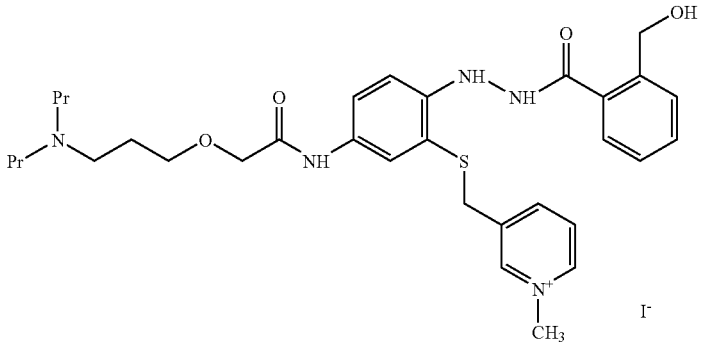

-continued (D-126)

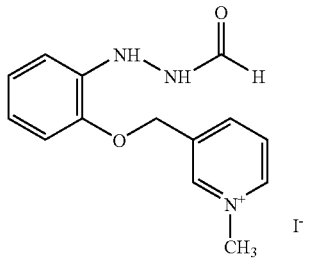

(D-127)

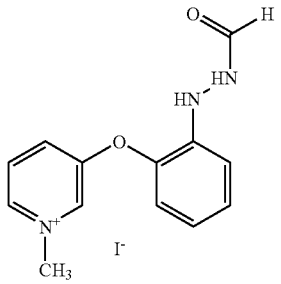

(D-128)

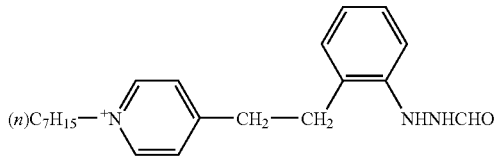

As the hydrazine derivatives used in the present invention, in addition to the above, the following hydrazine derivatives can also preferably be used. The hydrazine derivatives used in the present invention can be synthesized by various methods described in the following patent documents.

There are the compounds represented by (Chemical formula 1) described in JP-B-6-77138, specifically, compounds described on pages 3 and 4 of the same; compounds represented by formula (I) described in JP-B-693082, specifically, Compounds 1 to 38 described on pages 8 to 18 of the same; compounds represented by formulas (4), (5), and (6) described in JP-A-6-230497, specifically, Compound 4-1 to Compound 4-10 described on pages 25 and 26, Compound 5-1 to Compound 5-42 described on pages 28 to 36 and Compound 6-1 to Compound 6-7 described on pages 39 and 40 of the same; compounds represented by formulas (1) and (2) described in JP-A-6-289520, specifically, Compounds 1-1) to 1-17) and 2-1) described on pages 5 to 7 of the same; compounds represented by (Chemical formula 2) and (Chemical formula 3) described in JP-A-6-313936, specifically, compounds described on pages 6 to 19 of the same; compounds represented by (Chemical formula 1) described in JP-A-6-313951, specifically, compounds described on pages 3 to 5 of the same; compounds represented by formula (I) described in JP-A-7-5610, specifically, Compounds I-1 to I-38 described on pages 5 to 10 of the same; compounds represented by formula (II) described in JP-A-7-77783, specifically, Compounds II-1 to II-102 described on pages 10 to 27 of the same; compounds represented by formulas (H) and (Ha) described in JP-A-7-104426, specifically, Compounds H-1 to H-44 described on pages 8 to 15 of the same; compounds that have an anionic group or nonionic group for forming an intramolecular hydrogen bond with the hydrogen atom of the hydrazine in the vicinity of the hydrazine group described in JP-A-9-22082, especially compounds represented by formulas (A), (B), (C), (D), (E) and (F), specifically, Compounds N-1 to N-30 described in the same; compounds represented by formula (1) described in JP-A-9-22082, specifically, Compounds D-1 to D-55 described in the same as well as the hydrazine derivatives described in WO95/32452, WO95/32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

In the present invention, the hydrazine nucleating agents may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine nucleating agents may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of hydrazine nucleating agents may be dispersed in water by means of ball mill, colloid mill or ultrasonic waves according to a method known as solid dispersion method and used.

In the present invention, the hydrazine nucleating agent may be added to any layer on the silver halide emulsion layer side with respect to the support. For example, it can be added to a silver halide emulsion layer or another hydrophilic colloid layer. However, it is preferably added to a silver halide emulsion layer or a hydrophilic colloid layer adjacent thereto. Two or more kinds of hydrazine nucleating agents may be used in combination.

The addition amount of the nucleating agent in the present invention is preferably from $1\times10^{-5}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver halide.

The silver halide photographic light-sensitive material of the present invention may contain a nucleation accelerator.

Examples of the nucleation accelerator used in the present invention include amine derivatives onium salts, disulfide derivatives, hydroxymethyl derivatives and so forth. Specific examples thereof include the compounds described in JP-A-7-77783, page 48, lines 2 to 37, specifically, Compounds A-1) to A-73) described on pages 49 to 58 of the same; compounds represented by (Chemical formula 21), (Chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 mentioned in the same; and nucleation accelerators described in JP-A-9-297377, p.55, column 108, line 8 to p.69, column 136, line 44.

As the nucleation accelerator used for the present invention, the quaternary salt compounds represented by the following formulas (a) to (f) are preferred, and in particular, the compounds represented by the formula (b) are most preferred.

Formula (a)

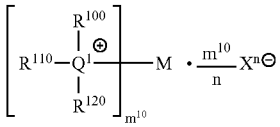

Formula (b)

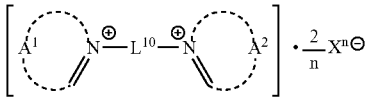

Formula (c)

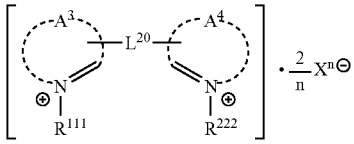

Formula (d)

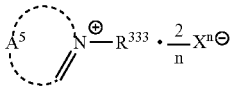

-continued

Formula (e)

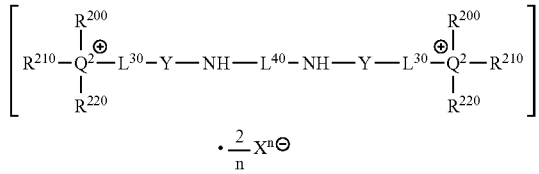

Formula (f)

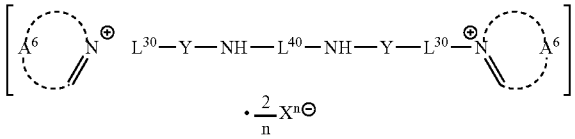

In the formula (a), $Q^1$ represents a nitrogen atom or a phosphorus atom, $R^{100}$, $R^{110}$ and $R^{120}$ each represent an aliphatic group, an aromatic group or a heterocyclic group, and these may bond to each other to form a ring structure. M represents an $m^{10}$-valent organic group bonding to $Q^1$ at a carbon atom contained in M, and $m^{10}$ represents an integer of 1 to 4.

In the formulas (b), (c) and (d), $A^1$, $A^2$, $A^3$, $A^4$ and $A^5$ each represent an organic residue for completing an unsaturated heterocyclic ring containing a quaternized nitrogen atom, $L^{10}$ and $L^{20}$ represent a divalent bridging group, and $R^{111}$, $R^{222}$ and $R^{333}$ represent a substituent.

The quaternary salt compounds represented by the formula (a), (b), (c) or (d) have 20 or more in total of repeating units of ethyleneoxy group or propyleneoxy group in the molecule, and they may contain the units at two or more sites.

In the formula (e), $Q^2$ represents a nitrogen atom or a phosphorus atom. $R^{200}$, $R^{210}$ and $R^{220}$ represent groups having the same meanings of $R^{100}$, $R^{110}$, $R^{120}$ in the formula (a), respectively.

In the formula (f), $A^6$ represents a group having the same meaning of $A^1$ or $A^2$ in the formula (b). However, although the nitrogen-containing unsaturated heterocyclic ring formed with $A^6$ may have a substituent, it does not have a primary hydroxyl group on the substituent. In the formulas (e) and (f), $L^{30}$ represents an alkylene group, Y represents —C(═O)— or —$SO_2$—, and $L^{40}$ represents a divalent bridging group containing at least one hydrophilic group.

In the formulas (a) to (f), $X^{n-}$ represents an n-valent counter anion, and n represents an integer of 1 to 3. However, when another anionic group is present in the molecule and it forms an intramolecular salt with $(Q^1)^+$, $(Q^2)^+$ or $N^+$, $X^{n-}$ is not required.

Examples of the aliphatic group represented by $R^{100}$, $R^{110}$ and $R^{120}$ in the formula (a) include a linear or branched alkyl group such as methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; an aralkyl group such as a substituted or unsubstituted benzyl group; a cycloalkyl group such as cyclopropyl groups, cyclopentyl group and cyclohexyl group; an alkenyl group such as allyl group, vinyl group and 5-hexenyl group; a cycloalkenyl group such as cyclopentenyl group and cyclohexenyl group; an alkynyl group such as phenylethynyl group and so forth. Examples of the aromatic group include an aryl group such as phenyl group, naphthyl group and phenanthoryl group, and examples of the heterocyclic group include pyridyl group, quinolyl group, furyl group, imidazolyl group, thiazolyl group, thiadiazolyl group, benzotriazolyl group, benzothiazolyl group, morpholyl group, pyrimidyl group, pyrrolidyl group and so forth.

Examples of the substituent substituting on these groups include, besides the groups represented by $R^{100}$, $R^{110}$ and $R^{120}$, a halogen atom such as fluorine atom, chlorine atom, bromine atom and iodine atom, a nitro group, an (alkyl or aryl)amino group, an alkoxy group, an aryloxy group, an (alkyl or aryl)thio group, a carbonamido group, a carbamoyl group, a ureido group, a thioureido group, a sulfonylureido group, a sulfonamido group, a sulfamoyl group, a hydroxyl group, a sulfonyl group, a carboxyl group (including a carboxylate), a sulfo group (including a sulfonate), a cyano group, an oxycarbonyl group, an acyl group, a heterocyclic group (including a heterocyclic group containing a quaternized nitrogen atom) and so forth. These substituents may be further substituted with any of these substituents.

The groups represented by $R^{100}$ $R^{110}$ and $R^{120}$ in the formula (a) may bond to each other to form a ring structure.

Example of the group represented by M in the formula (a) include, when $m^{10}$ represents 1, the same groups as the groups defined for $R^{100}$, $R^{110}$ and $R^{120}$. When $m^{10}$ represents an integer of 2 or more, M represents an $m^{10}$-valent bridging group bonding to $Q^1$ at a carbon atom contained in M. Specifically, it represents an $m^{10}$-valent bridging group formed with an alkylene group, an arylene group, a heterocyclic group or a group formed from any of these groups in combination with any of —CO— group, —O— group, —N($R^N$)— group, —S— group, —SO— group, —$SO_2$— group and —P═O— group ($R^N$ represents a hydrogen atom or a group selected from the groups defined for $R^{100}$, $R^{110}$, $R^{120}$, and when a plurality of $R^N$ exist in the molecule, they may be identical to or different from each other or one another, and may bond to each other or one another). M may have an arbitrary substituent, and examples of the substituent include the substituents that can be possessed by the groups represented by $R^{100}$, $R^{110}$ and $R^{120}$.

In the formula (a), $R^{100}$, $R^{110}$ and $R^{120}$ preferably represent a group having 20 or less carbon atoms. When $Q^1$ represents a phosphorus atom, an aryl group having 15 or less carbon atoms is particularly preferred, and when $Q^1$ represents a nitrogen atom, an alkyl group, aralkyl group and aryl group having 15 or less carbon atoms are particularly preferred. $m^{10}$ is preferably 1 or 2. When $m^{10}$ represents 1, M is preferably a group having 20 or less carbon atoms, and an alkyl group, aralkyl group and aryl group having 15 or less carbon atoms in total are particularly preferred. When $m^{10}$ represents 2, the divalent organic group represented by M is preferably a divalent group formed with an alkylene group or an arylene group, or a group formed from either of these groups in combination with any of —CO— group, —O— group, —N(RN) group, —S— group and —$SO_2$— group. When $m^{10}$ represents 2, M is preferably a divalent group having 20 or less carbon atoms and bonding to $Q^1$ at a carbon atom contained in M. When M or $R^{100}$, $R^{110}$ or $R^{120}$ contains a plurality of repeating units of ethyleneoxy group or propyleneoxy group, the preferred ranges for the total carbon numbers mentioned above may not be applied. Further, when $m^{10}$ represents an integer of 2 or more, a plurality of $R^{100}$, $R^{110}$ or $R^{120}$ exist in the molecule. In this case, a plurality of $R^{100}$, $R^{110}$ and $R^{120}$ may be identical to or different from each other or one another.

The quaternary salt compounds represented by the formula (a) contain 20 or more in total of repeating units of ethyleneoxy group or propyleneoxy group in the molecule, and they may exist at one site or two or more site. When $m^{10}$ represents an integer of 2 or more, it is more preferred that 20 or more in total of repeating units of ethyleneoxy group or propyleneoxy group should be contained in the bridging group represented by M.

In the formulas (b), (c) and (d), $A^1$, $A^2$, $A^3$, $A^4$ and $A^5$ represent an organic residue for completing a substituted or unsubstituted unsaturated heterocyclic ring containing a quaternized nitrogen atom, and it may contain a carbon atom, an oxygen atom, a nitrogen atom, a sulfur atom and a hydrogen atom and may be condensed with a benzene ring.

Examples of the unsaturated heterocyclic ring formed by $A^1$, $A^2$, $A^3$, $A^4$ or $A^5$ include pyridine ring, quinoline ring, isoquinoline ring, imidazole ring, thiazole ring, thiadiazole ring, benzotriazole ring, benzothiazole ring, pyrimidine ring, pyrazole ring and so forth. A pyridine ring, quinoline ring and isoquinoline ring are particularly preferred.

The unsaturated heterocyclic ring formed by $A^1$, $A^2$, $A^3$, $A^4$ or $A^5$ together with a quaternized nitrogen atom may have a substituent. Examples of the substituent include the same groups as the substituents that may be possessed by the groups represented by $R^{100}$, $R^{110}$ and $R^{120}$ in the formula (a). The substituent is preferably a halogen atom (in particular, chlorine atom), an aryl group having 20 or less carbon atoms (phenyl group is particularly preferred), an alkyl group, an alkynyl group, a carbamoyl group, an (alkyl or aryl)amino group, an (alkyl or aryl)oxycarbonyl group, an alkoxy group, an aryloxy group, an (alkyl or aryl)thio group, hydroxyl group, a mercapto group, a carbonamido group, a sulfonamido group, a sulfo group (including a sulfonate), a carboxyl group (including a carboxylate), a cyano group or the like, particularly preferably a phenyl group, an alkylamino group, a carbonamido group, a chlorine atom, an alkylthio group or the like, most preferably a phenyl group.

The divalent bridging group represented by $L^{10}$ or $L^{20}$ is preferably an alkylene group, an arylene group, an alkenylene group, an alkynylene group, a divalent heterocyclic group, —$SO_2$—, —SO—, —O—, —S—, —N($R^{N'}$)—, —C(═O)—, —PO— or a group formed by a combination of any of these. $R^{N'}$ represents an alkyl group, an aralkyl group, an aryl group or a hydrogen atom. The divalent bridging group represented by $L^{10}$ or $L^{20}$ may have an arbitrary substituent. Examples of the substituent include the substituents that may be possessed by the groups represented by $R^{100}$, $R^{110}$ and $R^{120}$ in the formula (a). Particularly preferred examples of $L^{10}$ or $L^{20}$ are an alkylene group, an arylene group, —C(═O)—, —O—, —S—, —$SO_2$—, —N($R^{N'}$)— and a group formed by a combination of any of these.

$R^{111}$, $R^{222}$ and $R^{333}$ preferably represent an alkyl group or aralkyl group having 1 to 20 carbon atoms, and they may be identical to or different from one another. $R^{111}$, $R^{222}$ and $R^{333}$ may have a substituent, and examples of the substituent include the substituents that may be possessed by the groups represented by $R^{100}$, $R^{110}$ and $R^{120}$ in the formula (a). $R^{111}$, $R^{222}$ and $R^{333}$ each particularly preferably represent an alkyl group or aralkyl group having 1 to 10 carbon atoms. Preferred examples of the substituent thereof include a carbamoyl group, an oxycarbonyl group, an acyl group, an aryl group, a sulfo group (including a sulfonate), a carboxyl group (including a carboxylate), a hydroxyl group, an (alkyl or aryl)amino group and an alkoxy group.

However, when a plurality of repeating units of ethyleneoxy group or propyleneoxy group are included in $R^{111}$, $R^{222}$ or $R^{333}$, the preferred ranges for the total carbon numbers mentioned above for $R^{111}$, $R^{222}$ and $R^{333}$ shall not be applied.

The quaternary salt compounds represented by the formula (b) or (c) contain 20 or more in total of repeating units of ethyleneoxy group or propyleneoxy group in the molecule, and they may exist at one site or two or more site and may be contained any of $A^1$, $A^2$, $A^3$, $A^4$, $R^{111}$, $R^{222}$, $L^{10}$ and $L^{20}$. However, it is preferred that 20 or more in total of repeating units of ethyleneoxy group or propyleneoxy group should be contained in the bridging group represented by $L^{10}$ or $L^{20}$.

The quaternary salt compounds represented by the formula (d) contain 20 or more in total of repeating units of ethyleneoxy group or propyleneoxy group in the molecule, and they may exist at one site or two or more site and may be contained any of $A^5$ and $R^{333}$. However, it is preferred that 20 or more in total of repeating units of ethyleneoxy group or propyleneoxy group should be contained in the bridging group represented by $R^{333}$.

The quaternary salt compounds represented by the formula (a), (b), (c) or (d) may contain both of a repeating unit of ethyleneoxy group and a repeating unit of propyleneoxy group. Further, when a plurality of repeating units of ethyleneoxy group or propyleneoxy group are contained, number of the repeating units may be defined strictly as one number or defined as an average number. In the latter case, each quaternary salt compound consists of a mixture having a certain degree of molecular weight distribution.

In the present invention, preferably 20 or more, more preferably 20 to 67, in total of repeating units of ethyleneoxy group should be contained.

In the formula (e), $Q^2$ $R^{200}$, $R^{210}$ and $R^{220}$ represent groups having the same meanings as $Q^1$, $R^{100}$, $R^{110}$ and $R^{120}$ in the formula (a), respectively, and the preferred ranges thereof are also the same.

In the formula (f), $A^6$ represents a group having the same meaning as $A^1$ or $A^2$ in the formula (b), and the preferred range thereof is also the same. The nitrogen-containing unsaturated heterocyclic ring formed with $A^6$ in the formula (f) together with a quaternized nitrogen atom may have a substituent, provided that it does not have a substituent containing a primary hydroxyl group.

In the formulas (e) and (f), $L^{30}$ represents an alkylene group. The alkylene group is preferably a linear, branched or cyclic substituted or unsubstituted alkylene group having 1 to 20 carbon atoms. Moreover, it may include not only a saturated alkylene group, of which typical example is ethylene group, but also an alkylene group containing an unsaturated group, of which typical examples are $—CH_2C_6H_4CH_2—$ and $—CH_2CH{=}CHCH_2—$. Further, when $L^{30}$ has a substituent, examples of the substituent include the examples of the substituent that may be possessed by the groups represented by $R^{100}$, $R^{110}$ and $R^{120}$ in the formula (a).

$L^{30}$ is preferably a linear or branched saturated group having 1 to 10 carbon atoms. More preferably, it is a substituted or unsubstituted methylene group, ethylene group or trimethylene group, particularly preferably a substituted or unsubstituted methylene group or ethylene group, most preferably a substituted or unsubstituted methylene group.

In the formulas (e) and (f), $L^{40}$ represents a divalent bridging group having at least one hydrophilic group. The hydrophilic group used herein represents $—SO_2—$, —SO—, —O—, —P(=O)=, —C(=O)—, —CONH—, $—SO_2NH—$, $—NHSO_2NH—$, —NHCONH—, an amino group, a guanidino group, an ammonio group, a heterocyclic group containing a quaternized nitrogen atom or a group consisting of a combination of these groups. $L^{40}$ is formed by an arbitrary combination of any of these hydrophilic groups and an alkylene group, an alkenylene group, an arylene group or a heterocyclic group.

The groups constituting $L^{40}$ such as an alkylene group, an arylene group, an alkenylene group and a heterocyclic group may have a substituent. Examples of the substituent include the substituents that can be possessed by the groups represented by $R^{100}$, $R^{110}$ and $R^{120}$ in the formula (a).

Although the hydrophilic group in $L^{40}$ may exist so as to interrupt $L^{40}$ or as a part of a substituent on $L^{40}$, it is more preferably exist so as to interrupt $L^{40}$. For example, there can be mentioned a case where any one of —C(=O)—, $—SO_2—$, —SO—, —O—, —P(=O)=, —CONH—, $—SO_2NH—$, $—NHSO_2NH—$, —NHCONH—, a cationic group (specifically, a quaternary salt structure of nitrogen or phosphorus or a nitrogen-containing heterocyclic ring containing a quaternized nitrogen atom), an amino group and a guanidine group or a divalent group consisting of an arbitrary combination of these groups exists so as to interrupt $L^{40}$.

One of preferred examples of the hydrophilic group of $L^{40}$ is a group having a plurality of repeating units of ethyleneoxy group or propyleneoxy group consisting of a combination of ether bonds and alkylene groups. The polymerization degree or average polymerization degree of such a group is preferably 2 to 67.

The hydrophilic group of $L^{40}$ also preferably contains a dissociating group obtained as a result of combination of groups such as $—SO_2—$, —SO—, —O—, —P(=O)=, —C(=O)—, —CONH—, $—SO_2NH—$, $—NHSO_2NH—$, —NHCONH—, an amino group, a guanidino group, an ammonio group and a heterocyclic group containing a quaternized nitrogen atom, or as a substituent on $L^{40}$. The dissociating group referred to herein means a group or partial structure having a proton of low acidity that can be dissociated with an alkaline developer, or a salt thereof. Specifically, it means, for example, a carboxy group (—COOH), a sulfo group ($—SO_3H$), a phosphonic acid group ($—PO_3H$), a phosphoric acid group ($—OPO_3H$), a hydroxy group (—OH), a mercapto group (—SH), $—SO_2NH_2$ group, N-substituted sulfonamido group ($—SO_2NH—$, $—CONHSO_2—$ group, $—SO_2NHSO_2—$ group), —CONHCO— group, an active methylene group, —NH— group contained in a nitrogen-containing heterocyclic group, salts thereof etc.

$L^{40}$ consisting of a suitable combination of an alkylene group or arylene group with —C(=O)—, $—SO_2—$, —O—, —CONH—, $—SO_2NH—$, $—NHSO_2NH—$, —NHCONH— or an amino group is preferably used. More preferably, $L^{40}$ consisting of a suitable combination of an alkylene group having 2 to 5 carbon atoms with —C(=O)—, $—SO_2—$, —O—, —CONH—, $—SO_2NH—$, $—NHSO_2NH—$ or —NHCONH— is used.

Y represents —C(=O)— or $—SO_2—$.—C(=O)— is preferably used.

Example of the counter anion represented by $X^{n-}$ in the formulas (a) to formula (f) include a halide ion such as chloride ion, bromide ion and iodide ion, a carboxylate ion such as acetate ion, oxalate ion, fumarate ion and benzoate ion, a sulfonate ion such as p-toluenesulfonate ion, methanesulfonate ion, butanesulfonate ion and benzenesulfonate ion, a sulfate ion, a perchlorate ion, a carbonate ion, a nitrate ion and so forth.

As the counter anion represented by $X^{n-}$, a halide ion, a carboxylate ion, a sulfonate ion and a sulfate ion are preferred, and n is preferably 1 or 2. As $X^{n-}$, a chloride ion or a bromide ion is particularly preferred, and a chloride ion is the most preferred.

However, when another anionic group is present in the molecule and it forms an intramolecular salt with $(Q^1)^+$, $(Q^2)^+$ or $N^+$, $X^{n-}$ is not required.

As the quaternary salt compound used in the present invention, the quaternary salt compounds represented by the formula (b), (c) or (f) are more preferred, and the quaternary salt compounds represented by the formula (b) or (f) are particularly preferred. Further, in the formula (b), preferably 20 or more, particularly preferably 20 to 67, in total of repeating units of ethyleneoxy group should be contained in the bridging group represented by $L^{10}$. Further, in the formula (f), the unsaturated heterocyclic compound formed with $A^6$ particularly preferably represents 4-phenylpyridine, isoquinoline or quinoline.

Specific examples of the quaternary salt compounds represented by any of the formulas (a) to (f) are listed below. In the following formulas, Ph represents a phenyl group. However, the quaternary salt compounds that can be used for the present invention are not limited to the following exemplary compounds.

| | $Q^+—L_0—Q^+ \cdot 2X^-$ | | |
|---|---|---|---|
| No. | $Q^+$ = | $L_0$ = | $X^-$ = |
| 1 | 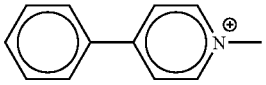 | $—C_2H_4—(OC_2H_4)_n—OC_2H_4—$ n = 20 | $Cl^{\ominus}$ |
| 2 | 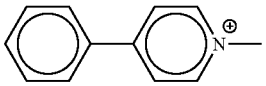 | $—C_2H_4—(OC_2H_4)_n—OC_2H_4—$ $n \approx 32$ | $Cl^{\ominus}$ |
| 3 | 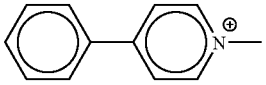 | $—C_2H_4—(OC_2H_4)_n—OC_2H_4—$ $n \approx 43$ | $Cl^{\ominus}$ |
| 4 | 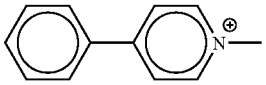 | $—C_2H_4—(OC_2H_4)_n—OC_2H_4—$ $n \approx 62$ | $Cl^{\ominus}$ |
| 5 | 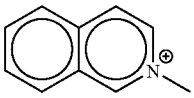 | $—C_2H_4—(OC_2H_4)_n—OC_2H_4—$ $n \approx 21$ | $Cl^{\ominus}$ |
| 6 | 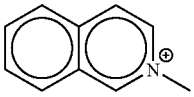 | $—C_2H_4—(OC_2H_4)_n—OC_2H_4—$ $n \approx 43$ | $Cl^{\ominus}$ |
| 7 | 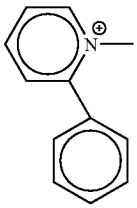 | $—C_2H_4—(OC_2H_4)_n—OC_2H_4—$ n = 20 | $Cl^{\ominus}$ |
| 8 | 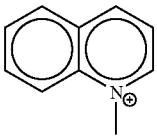 | $—C_2H_4—(OC_2H_4)_n—OC_2H_4—$ $n \approx 43$ | $Cl^{\ominus}$ |
| 9 | 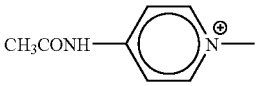 | $—C_2H_4—(OC_2H_4)_n—OC_2H_4—$ $n \approx 21$ | $Cl^{\ominus}$ |
| 10 | 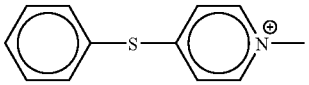 | $—C_2H_4—(OC_2H_4)_n—OC_2H_4—$ $n \approx 43$ | $Cl^{\ominus}$ |

-continued

| | | | |
|---|---|---|---|
| 11 | 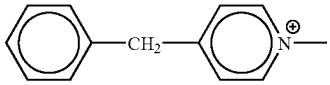 | —$C_2H_4$—$(OC_2H_4)_n$—$OC_2H_4$— <br> $n \approx 67$ | $Cl^{\ominus}$ |
| 12 | 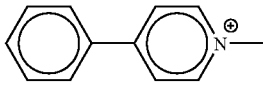 | 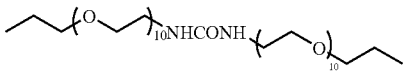 | $Cl^{\ominus}$ |
| 13 | 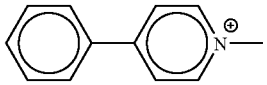 | 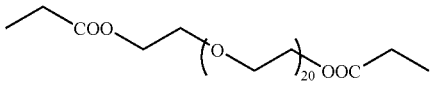 | $Cl^{\ominus}$ |
| 14 | 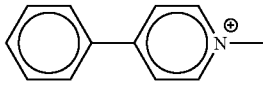 | 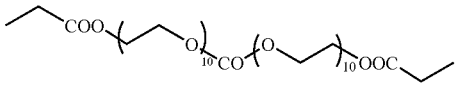 | $Cl^{\ominus}$ |
| 15 | 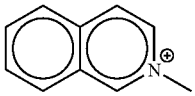 | 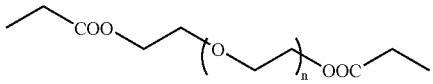 <br> $n \approx 43$ | $Cl^{\ominus}$ |
| 16 | 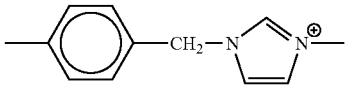 | —$C_2H_4$—$(OC_2H_4)_n$—$OC_2H_4$— <br> $n \approx 42$ | $Cl^{\ominus}$ |
| 17 | 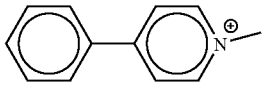 | —$C_2H_4$—$(OC_2H_4)_n$—$OC_2H_4$— <br> $n \approx 62$ | 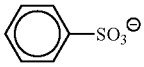 |
| 18 | 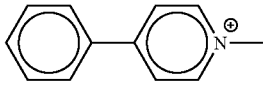 | —$C_2H_4$—$(OC_2H_4)_n$—$OC_2H_4$— <br> $n \approx 43$ | $Br^{\ominus}$ |
| 19 | 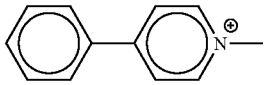 | —$C_2H_4$—$(OC_2H_4)_n$—$OC_2H_4$— <br> n = 20 | $2^{\ominus}$ <br> $(COO)_2$ |
| 20 | 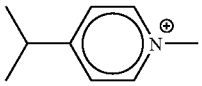 | —$C_2H_4$—$(OC_2H_4)_n$—$OC_2H_4$— <br> $n \approx 34$ | $Cl^{\ominus}$ |
| 21 | 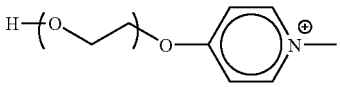 | —$(CH_2)_5$— | $CH_3SO_3^{\ominus}$ |
| 22 | 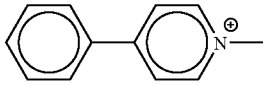 | 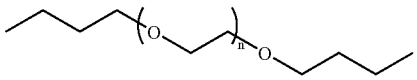 <br> $n \approx 43$ | $Cl^{\ominus}$ |
| 23 | 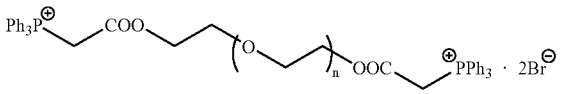 <br> $n \approx 43$ | | |
| 24 | 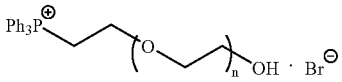 <br> $n \approx 33$ | | |

-continued
25
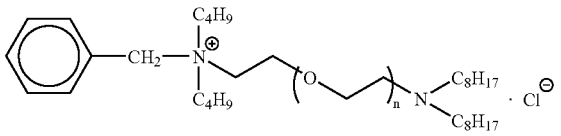
$n \approx 33$
26
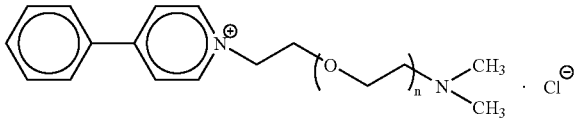
$n \approx 43$
27
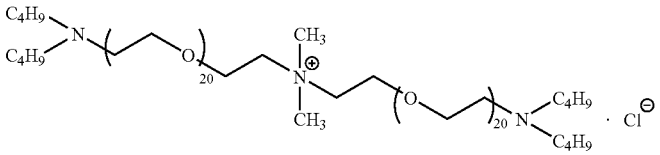
28
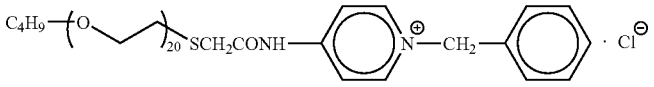
29
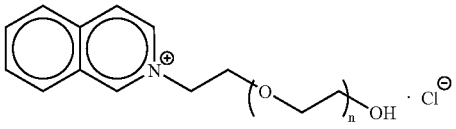
$n \approx 67$
30
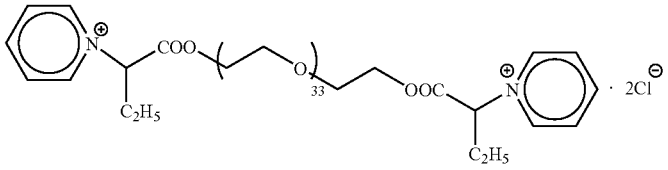
31
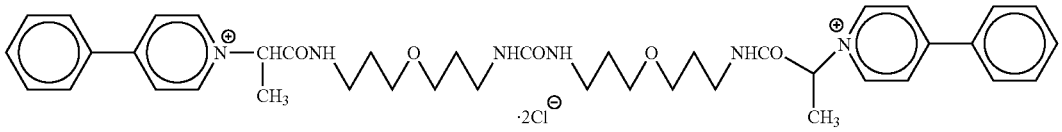
32
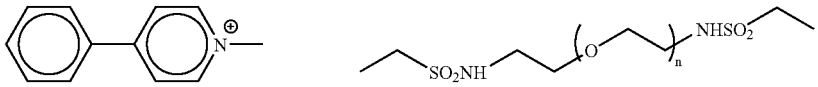
$n = 12$
33
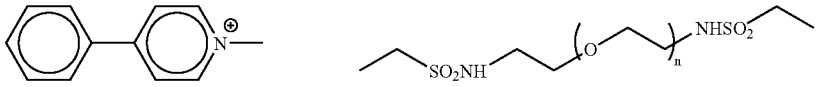
$n \approx 24$
34
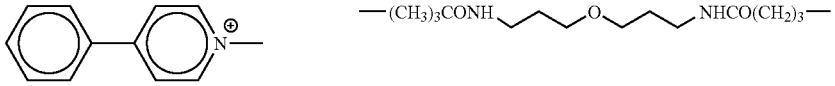
35
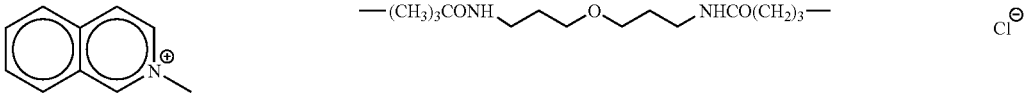

-continued

| | | | |
|---|---|---|---|
| 36 | 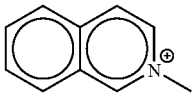 | 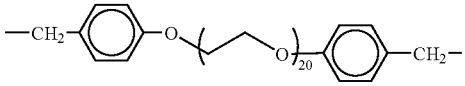 | $Cl^{\ominus}$ |
| 37 | 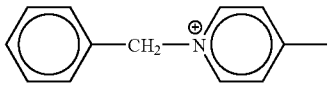 | 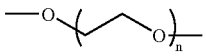 $n \approx 33$ | $Cl^{\ominus}$ |
| 38 | 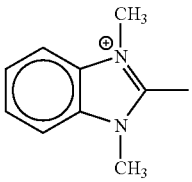 | 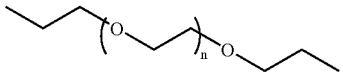 $n \approx 43$ | $Cl^{\ominus}$ |
| 39 | $(C_4H_9)_3N^{\oplus}$— | 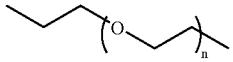 $n = 20$ | $Cl^{\ominus}$ |
| 40 | $(C_8H_{17})_2(CH_3)N^{\oplus}$— | 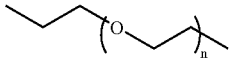 $n \approx 43$ | $Cl^{\ominus}$ |
| 41 | $Ph_3P^{\oplus}$— | 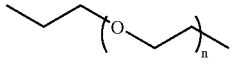 $n = 20$ | $Cl^{\ominus}$ |
| 42 | $Ph_3P^{\oplus}$— | 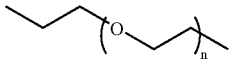 $n \approx 33$ | $Br^{\ominus}$ |

$Q^+—CH_2CONH—L—NHCOCH_2—Q^+ \cdot 2X^-$

| No. | $Q^+$ = | L = | $X^-$ = |
|---|---|---|---|
| 43 | $PhP^{\oplus}$— | —$C_2H_4$—$(OC_2H_4)_n$— $n = 3$ | $Cl^{\ominus}$ |
| 44 | $PhP^{\oplus}$— | —$C_2H_4$—$(OC_2H_4)_n$— $n = 20$ | $Br^{\ominus}$ |
| 45 | $PhP^{\oplus}$— | —$C_2H_4$—$(OC_2H_4)_n$— $n \approx 34$ | $Cl^{\ominus}$ |
| 46 | $PhP^{\oplus}$— | —$C_2H_4$—$(OC_2H_4)_n$— $n \approx 67$ | $Cl^{\ominus}$ |
| 47 | 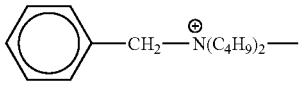 | —$C_2H_4$—$(OC_2H_4)_n$— $n = 12$ | $Cl^{\ominus}$ |
| 48 | 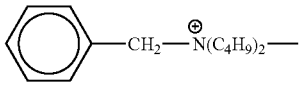 | —$C_2H_4$—$(OC_2H_4)_n$— $n = 30$ | $Br^{\ominus}$ |
| 49 | 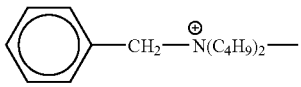 | —$C_2H_4$—$(OC_2H_4)_n$— $n \approx 43$ | 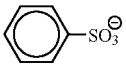 |
| 50 | 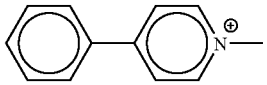 | —$C_2H_4$—$(OC_2H_4)_n$— $n = 3$ | $Cl^{\ominus}$ |

-continued

| | | | |
|---|---|---|---|
| 51 | 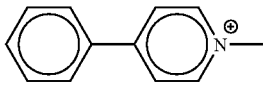 | —$C_2H_4$—$(OC_2H_4)_n$— $n = 12$ | $Cl^{\ominus}$ |
| 52 | 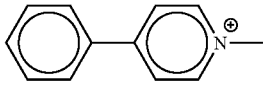 | —$C_2H_4$—$(OC_2H_4)_n$— $n = 20$ | $Cl^{\ominus}$ |
| 53 | 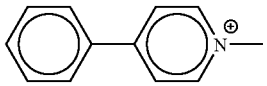 | —$C_2H_4$—$(OC_2H_4)_n$— $n \approx 43$ | $Cl^{\ominus}$ |
| 54 | 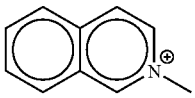 | —$C_2H_4$—$(OC_2H_4)_n$— $n = 2$ | $Cl^{\ominus}$ |
| 55 | 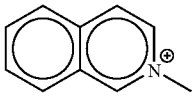 | —$C_2H_4$—$(OC_2H_4)_n$— $n = 12$ | $Br^{\ominus}$ |
| 56 | 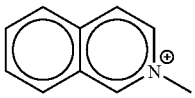 | —$C_2H_4$—$(OC_2H_4)_n$— $n = 30$ | 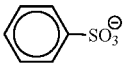 |
| 57 | 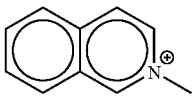 | —$C_2H_4$—$(OC_2H_4)_n$— $n \approx 67$ | $2^{\ominus}$ $(COO)_2$ |
| 58 | 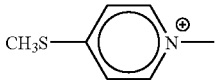 | —$C_2H_4$—$(OC_2H_4)_n$— $n = 12$ | $Cl^{\ominus}$ |
| 59 | 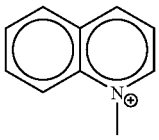 | —$C_2H_4$—$(OC_2H_4)_n$— $n = 20$ | $Cl^{\ominus}$ |
| 60 | 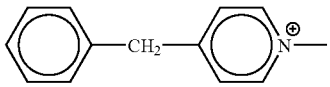 | —$C_2H_4$—$(OC_2H_4)_n$— $n = 30$ | $Cl^{\ominus}$ |
| 61 | 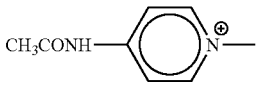 | —$C_2H_4$—$(OC_2H_4)_n$— $n \approx 67$ | $Cl^{\ominus}$ |
| 62 | 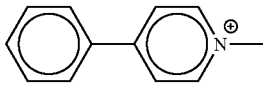 | —$C_3H_6$—$(OC_2H_4)_n$—$OC_3H_6$— $n = 2$ | $Cl^{\ominus}$ |
| 63 | 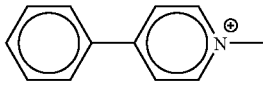 | —$C_3H_6$—$(OC_2H_4)_n$—$OC_3H_6$— $n = 20$ | $Cl^{\ominus}$ |
| 64 | 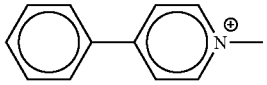 | —$C_3H_6$—$(OC_2H_4)_n$—$OC_3H_6$— $n \approx 43$ | $Cl^{\ominus}$ |
| 65 | $Ph_3P^{\oplus}$— | —$C_3H_6$—$(OC_2H_4)_n$—$OC_3H_6$— $n = 2$ | $Cl^{\ominus}$ |

-continued

| | | | |
|---|---|---|---|
| 66 | $Ph_3P^{\oplus}$— | —$C_3H_6$—$(OC_2H_4)_n$—$OC_3H_6$— <br> $n = 12$ | $Cl^{\ominus}$ |
| 67 | 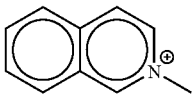 | —$C_3H_6$—$(OC_2H_4)_n$—$OC_3H_6$— <br> $n = 20$ | $Cl^{\ominus}$ |
| 68 | 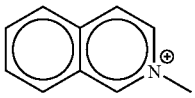 | —$C_3H_6$—$(OC_2H_4)_n$—$OC_3H_6$— <br> $n \approx 43$ | $Cl^{\ominus}$ |
| 69 | $(C_3H_7)_3N^{\oplus}$— | —$C_3H_6$—$(OC_2H_4)_n$—$OC_3H_6$— <br> $n \approx 67$ | $Cl^{\ominus}$ |
| 70 | $(C_3H_7)_3N^{\oplus}$— | —$CH(CH_3)CH_2$—$(OC_2H_4)_n$—$OCH_2CH(CH_3)$— <br> $n = 12$ | $Cl^{\ominus}$ |
| 71 | 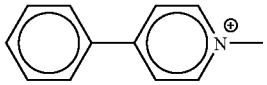 | —$CH(CH_3)CH_2$—$(OC_2H_4)_n$—$OCH_2CH(CH_3)$— <br> $n \approx 18$ | $Cl^{\ominus}$ |
| 72 | 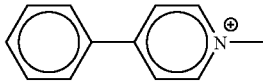 | —$CH(CH_3)CH_2$—$(OC_2H_4)_n$—$OCH_2CH(CH_3)$— <br> $n = 20$ | $Cl^{\ominus}$ |
| 73 | 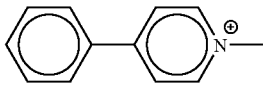 | —$C_2H_4$—$(O$—$CH(CH_3)$—$)_n$ <br> $n = 4$ | $Cl^{\ominus}$ |
| 74 | 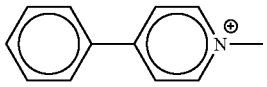 | —$C_2H_4$—$(O$—$CH(CH_3)$—$)_n$ <br> $n \approx 13$ | $Cl^{\ominus}$ |
| 75 | 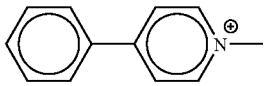 | —$(CH_2)_4$—$(O$—$CH_2)_3$—NHCONH—$(CH_2$—$O)_3$—$(CH_2)_4$— | $Cl^{\ominus}$ |
| 76 | 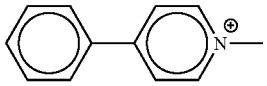 | —$(CH_2)_4$—$NHSO_2NH$—$(CH_2)_4$— | $Cl^{\ominus}$ |
| 77 | 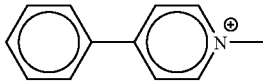 | —$(CH_2)_4$—NHCONH—$(CH_2)_4$— | $Cl^{\ominus}$ |
| 78 | 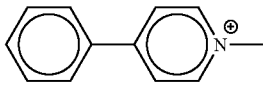 | —$(CH_2)_4$—NH—C(=O)—C(=O)—NH—$(CH_2)_4$— | $Cl^{\ominus}$ |
| 79 | 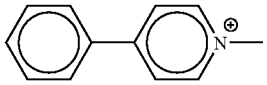 | —$(CH_2)_2$—CONH—$(CH_2)_2$—CONH—$(CH_2)_2$—NHCO—$(CH_2)_2$—NHCO—$(CH_2)_2$— | $Cl^{\ominus}$ |
| 80 | 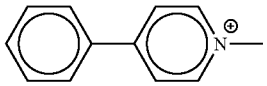 | —$(CH_2)_4$—NHCO—$(CH_2)_2$—CONH—$(CH_2)_4$— | $Cl^{\ominus}$ |

-continued

| | | | |
|---|---|---|---|
| 81 | 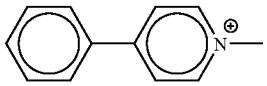 | 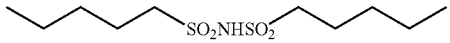 | $Cl^{\ominus}$ |
| 82 | 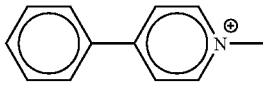 | 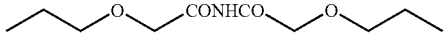 | $Cl^{\ominus}$ |
| 83 | 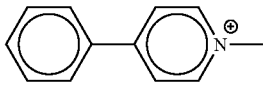 | 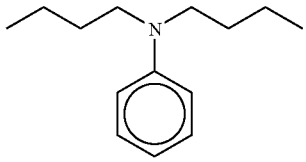 | $Cl^{\ominus}$ |
| 84 | 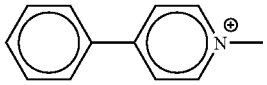 | 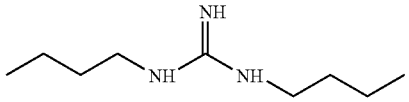 | $Cl^{\ominus}$ |
| 85 | 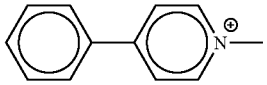 | 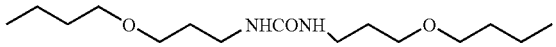 | $Cl^{\ominus}$ |
| 86 | 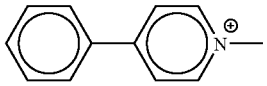 | 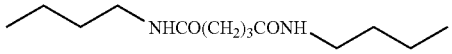 | $Cl^{\ominus}$ |

The quaternary salt compounds represented by the formulas (a) to (f) can be easily synthesized by known methods.

The nucleation accelerator that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethylsulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerator may be dispersed in water by means of ball mill, colloid mill or ultrasonic waves according to a method known as solid dispersion method and used.

The nucleation accelerator that can be used in the present invention is preferably added to a non-photosensitive layer consisting of a hydrophilic colloid layer not containing silver halide emulsion provided on the silver halide emulsion layer side of the support, particularly preferably to a non-photosensitive layer consisting of a hydrophilic colloid layer between a silver halide emulsion layer and the support.

The nucleation accelerator is preferably used in an amount of $1\times10^{-6}$ to $2\times10^{-2}$ mol, more preferably $1\times10^{-5}$ to $2\times10^{-2}$ mol, most preferably $2\times10^{-5}$ to $1\times10^{-2}$ mol, per mol of silver halide. It is also possible to use two or more kinds of nucleation accelerators in combination.

There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19 to page 18, right upper column, line 4; polymer latexes described in JP-A-2-103536, page 18, left lower column, line 12 to left lower column, line 20, polymer latexes having an active methylene group represented by formula (I) described in JP-A-9-179228, specifically, Compounds I-1 to I-16 described in the same, polymer latexes having core/shell structure described in JP-A-9-179228, specifically, Compounds P-1 to P-55 described in the same, and acidic polymer latexes described in JP-A-7-104413, page 14, left column, line 1 to right column, line 30, specifically, Compounds II-1) to II-9) described on page 15 of the same; matting agents, lubricants and plasticizers described in JP-A-2-103536, page 19, left upper column, line 15 to right upper column, line 15; hardening agents described in JP-A-2-103536, page 18, right upper column, line 5 to line 17; compounds having an acid radical described in JP-A-2-103536, page 18, right lower column, line 6 to page 19, left upper column, line 1; conductive materials described in JP-A-2-18542, page 2, left lower column, line 13 to page 3, right upper column, line 7, specifically, metal oxides described in page 2, right lower column, line 2 to line 10 of the same, and conductive polymer compounds P-1 to P-7 described in the same; water-soluble dyes described in JP-A-2-103536, page 17, right lower column, lines 1 to 18; solid dispersion dyes represented by the formulas (FA), (FA1), (FA2) and (FA3) described in JP-A-9-179243, specifically, Compounds F1 to F34 described in the same; Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The swelling ratio of the hydrophilic colloid layers including the emulsion layers and protective layers of the silver halide photographic light-sensitive material of the present invention is preferably in the range of 80 to 150%, more preferably 90 to 140%. The swelling ratio of the hydrophilic colloid layer can be determined in the following manner. The thickness ($d_0$) of the hydrophilic colloid layers including the emulsion layers and protective layers of the silver halide photographic light-sensitive material is measured, and the swollen thickness ($\Delta d$) is measured after the silver halide photographic material is immersed in distilled water at 25° C. for one minute. Then, the swelling ratio is calculated from the following equation: Swelling ratio (%)= $(\Delta d/d_0)\times 100$.

The silver halide photographic light-sensitive material of the present invention preferably has a film surface pH of 7.5 or lower, more preferably 4.5 to 6.0, further preferably 4.8 to 6.0, for the side on which silver halide emulsion layer is coated. If it is less than 4.5, hardening of the emulsion layer tends to be delayed.

Processing chemicals such as developing solution (developer) and fixing solution (fixer) and processing methods that can be used for the silver halide photographic light-sensitive material according to the present invention are described below. However, of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited. However, the developer preferably contains a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid derivative with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones or derivatives thereof as the developing agent used for the present invention include 1-phenyl-3-pyrazolidone, 1-phenyl-4,4-dimethyl-3-pyrazolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, o-methoxy-p-(N-methylamino)phenol etc., and N-methyl-p-aminophenol and aminophenols described in JP-A-9-297377 and JP-A-9-297378 are particularly preferred.

The dihydroxybenzene type developing agent is preferably used in an amount of generally 0.05 to 0.8 mol/L. When a dihydroxybenzene compound and a 1-phenyl-3-pyrazolidone compound or a p-aminophenol compound are used in combination, the former is preferably used in an amount of 0.05 to 0.6 mol/L, more preferably 0.10 to 0.5 mol/L, and the latter is preferably used in an amount of 0.06 mol/L or less, more preferably 0.003 to 0.03 mol/L.

The ascorbic acid derivative developing agent is preferably used in an amount of generally 0.01 to 0.5 mol/L, more preferably 0.05 to 0.3 mol/L. When an ascorbic acid derivative and a 1-phenyl-3-pyrazolidone compound or a p-aminophenol compound are used in combination, the ascorbic acid derivative is preferably used in an amount of from 0.01 to 0.5 mol/L, and the 1-phenyl-3-pyrazolidone compound or p-aminophenol compound is preferably used in an amount of 0.005 to 0.2 mol/L.

The developer used in processing of the silver halide photographic light-sensitive material of the present invention may contain additives (e.g., a developing agent, alkali agent, pH buffer, preservative, chelating agent etc.) that are commonly used. Specific examples thereof are described below. However, the present invention is by no means limited to them.

Examples of the buffer for use in the developer used in development include carbonates, boric acids described in JP-A-62-186259, saccharides (e.g., saccharose) described in JP-A-60-93433, oximes (e.g., acetoxime), phenols (e.g., 5-sulfosalicylic acid), tertiary phosphates (e.g., sodium salt and potassium salt) etc., and carbonates are preferably used. The amount of the buffer, in particular, the carbonates, is preferably 0.05 mol/L or more, particularly preferably 0.08 to 1.0 mol/L.

In the present invention, both the starter developer and the replenisher developer preferably have a property that the solution shows pH increase of 0.8 or less when 0.1 mol of sodium hydroxide is added to 1 L of the solution. As for the method of confirming whether the starter developer or replenisher developer used has the property, pH of the starter developer or replenisher developer to be tested is adjusted to 10.5, 0.1 mol of sodium hydroxide is added to 1 L of the solution, then pH of the solution is measured, and if increase of pH value is in the range of 0.8 or less, the solution is determined to have the property defined above. In the present invention, it is particularly preferable to use a starter developer and replenisher developer showing pH increase of 0.7 or less in the aforementioned test.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. A sulfite is used in an amount of preferably 0.2 mol/L or more, particularly preferably 0.3 mol/L or more. However, if it is added in an unduly large amount, silver staining in the developer is caused. Accordingly, the upper limit is preferably 1.2 mol/L. The amount is particularly preferably 0.35 to 0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03 to 0.12, particularly preferably 0.05 to 0.10, in terms of molar ratio with respect to the dihydroxybenzene type developing agent. When an ascorbic acid derivative is used as the preservative, the developer preferably does not contain a boron compound.

Examples of additives to be used other than those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc. and an imidazole and derivatives thereof, and an agent for preventing uneven physical development such as a heterocyclic mercapto compound (e.g., sodium 3-(5-mercaptotetrazol-1-yl)benzenesulfonate, 1-phenyl-5-mercaptotetrazole etc.) and the compounds described in JP-A-62-212651.

Further, a mercapto compound, indazole compound, benzotriazole compound or benzimidazole compound may be added as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, 2-mercaptobenzotriazole and so forth. The addition amount thereof is generally 0.01 to 10 mmol, preferably 0.1 to 2 mmol, per liter of the developer.

Further, various kinds of organic or inorganic chelating agents can be used individually or in combination in the developer used for the present invention.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycol ether-tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent Publication No. 2,227,369, and the compounds described in Research Disclosure, Vol. 181, Item 18170 (May, 1979) and so forth.

Examples of the aminophosphonic acid include aminotris(methylenephosphonic acid), ethylenediaminetetramethylenephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

The organic and/or inorganic chelating agents are not limited to those described above. The organic and/or inorganic chelating agents may be used in the form of an alkali metal salt or an ammonium salt. The amount of the chelating agent added is preferably $1\times10^{-4}$ to $1\times10^{-1}$ mol, more preferably $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215; triazines having one or more mercapto groups (for example, the compounds described in JP-B-6-23830, JP-A-3-282457 and JP-A-7-175178); pyrimidines having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, the compounds described in JP-A-9-274289 etc.); pyridines having one or more mercapto groups (e.g., 2-mercaptopyridine, 2,6-dimercaptopyridine, 3,5-dimercaptopyridine, 2,4,6-trimercaptopyridine, compounds described in JP-A-7-248587 etc.); pyrazines having one or more mercapto groups (e.g., 2-mercaptopyrazine, 2,6-dimercaptopyrazine, 2,3-dimercaptopyrazine, 2,3,5-trimercaptopyrazine etc.); pyridazines having one or more mercapto groups (e.g., 3-mercaptopyridazine, 3,4-dimercaptopyridazine, 3,5-dimercaptopyridazine, 3,4,6-trimercaptopyridazine etc.); the compounds described in JP-A-7-175177, polyoxyalkylphosphonic acid esters described in U.S. Pat. No. 5,457,011 and so forth. These silver stain inhibitors may be used individually or in combination of two or more of these. The addition amount thereof is preferably 0.05 to 10 mmol, more preferably 0.1 to 5 mmol, per liter of the developer.

The developer may also contain the compounds described in JP-A-61-267759 as a dissolution aid.

Further, the developer may also contain a toning agent, surfactant, defoaming agent, hardening agent or the like, if necessary.

The developer preferably has a pH of 9.0 to 12.0, more preferably 9.0 to 11.0, particularly preferably 9.5 to 11.0. As the alkali agent used for adjusting pH, a usual water-soluble inorganic alkali metal salt (e.g., sodium hydroxide, potassium hydroxide, sodium carbonate, potassium carbonate etc.) may be used.

As for the cation of the developer, potassium ion less inhibits development and causes less indentations, called fringes, on peripheries of blackened portions, compared with sodium ion. Further, when the developer is stored as a concentrated solution, potassium salt is generally preferred, because of its higher solubility. However, since, in the fixer, potassium ion causes fixing inhibition on the same level as silver ion, a high potassium ion concentration in the developer disadvantageously causes increase of the potassium ion concentration in the fixer because of carrying over of the developer by the silver halide photographic light-sensitive material. In view of the above, the molar ratio of potassium ion to sodium ion in the developer is preferably between 20:80 and 80:20. The ratio of potassium ion to sodium ion can be freely controlled within the above-described range by a counter cation such as those derived from a pH buffer, pH adjusting agent, preservative, chelating agent or the like.

The replenishing amount of the developer is generally 470 mL or less, preferably 30 to 325 mL, per $m^2$ of the silver halide photographic light-sensitive material. The replenisher developer may have the same composition and/or concentration as the starter developer, or it may have a different composition and/or concentration from those of the starter developer.

Examples of the fixing agent in the fixing processing agent that can be used for the present invention include ammonium thiosulfate, sodium thiosulfate and ammonium sodium thiosulfate. Although the amount of the fixing agent may be varied appropriately, it is generally about 0.7 to 3.0 mol/L.

The fixer that can be used for the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01 to 0.15 mol/L in terms of aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02 to 0.3 mol/L), pH buffer (e.g., acetic acid, sodium acetate, sodium carbonate, sodium hydrogencarbonate, phosphoric acid, succinic acid, adipic acid etc. in an amount of generally 0.1 to 1 mol/L, preferably 0.2 to 0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001 to 0.5 mol/L, preferably 0.005 to 0.3 mol/L). However, in view of environmental protection recently concerned, it is preferred that a boron compound is not contained.

In addition, the fixing processing agent may contain the compounds described in JP-A-62-78551, pH adjusting agent (e.g., sodium hydroxide, ammonia, sulfuric acid etc.), surfactant, wetting agent, fixing accelerator etc. Examples of the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535 and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645 and JP-A-3-101728; mesoionic compounds and thiocyanates described in JP-A-4-170539.

pH of the fixer used for the present invention is preferably 4.0 or more, more preferably 4.5 to 6.0. pH of the fixer rises with processing by the contamination of developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 500 mL or less, more preferably 390 mL or less, still more preferably 80 to 325 mL, per $m^2$ of the silver halide photographic light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co.; Ltd. and so forth.

Further, removal of dyes and so forth using an adsorptive filter such as those comprising activated carbon is also preferred.

When the developing and fixing processing chemicals used in the present invention are solutions, they are preferably preserved in packaging materials of low oxygen permeability as disclosed in JP-A-61-73147. Further, when these solutions are concentrated solutions, they are diluted with water to a predetermined concentration in the ratio of 0.2 to 3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Known coating agents and auxiliary granulating agents can be used, and polyvinylpyrrolidone, polyethylene glycol, polystyrenesulfonic acid and vinyl compounds are preferably used. Further, JP-A-5-45805, column 2, line 48 to column 3, line 13 can be referred to.

When a multilayer structure is used, components that do not react with each other on contact may be sandwiched with components that react with each other and made into tablets or briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5 to 6.0 g/$cm^3$, in particular, the bulk density of tablets is preferably 1.0 to 5.0 g/$cm^3$, and that of granules is preferably 0.5 to 1.5 g/$cm^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous, etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of these packaging materials for processing chemicals may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and a method in which processing chemicals are fed to a circulating system of an automatic processor and dissolved and replenished, or processing chemicals are fed to a dissolving tank provided in an automatic processor with progress of the processing of silver halide photographic light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

A silver halide photographic light-sensitive material is subjected to washing or stabilizing processing after being developed and fixed (hereinafter washing includes stabilization processing, and a solution used therefor is called water or washing water unless otherwise indicated). The water used for washing may be any of tap water, ion exchange water, distilled water and stabilized solution. The replenishing rate therefor is, in general, about 8 to 17 liters per $m^2$ of the silver halide photographic light-sensitive material. However, washing can be carried out with a replenishing rate less than the above. In particular, with a replenishing rate of 3 liters or less (including zero, i.e., washing in a reservoir), not only water saving processing can be carried out, but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 or the like. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution, which becomes a problem when washing is carried out with a small amount of water, and to prevent generation of scale.

As a method of reducing the replenishing amount of the washing water, a multistage countercurrent system (e.g., two stages or three stages) has been known for a long time. The replenishing amount of the washing water in this system is preferably 50 to 200 mL per $m^2$ of the silver halide photographic light-sensitive material. This effect can also similarly be obtained in an independent multistage system (a method in which a countercurrent is not used, and fresh solutions are separately replenished to multistage washing tanks).

Further, means for preventing generation of scale may be included in a washing process. The means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of silver halide photographic light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the above-described oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system so as to prevent stains due to a dye dissolved out from the silver halide photographic light-sensitive material.

The overflow solution from the washing with water step may be partly or wholly used by mixing it with the processing solution having fixing ability, as described in JP-A-60-235133. It is also preferable, in view of protection of the natural environment, to reduce the biochemical oxygen demand (BOD), chemical oxygen demand (COD), iodine consumption or the like in waste water before discharge by subjecting the solution to microbial treatment (for example, activated sludge treatment, treatment with a filter comprising a porous carrier such as activated carbon or ceramic carrying microorganisms such as sulfur-oxidizing bacteria etc.), electrification or oxidation treatment with an oxidizing agent before discharge, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed subsequent to the washing with water, and as an example thereof, a bath containing the compounds described in JP-A-2-201357, JP-A-2-132435, JP-A-1-102553 and JP-A-46-44446 may be used as a final bath of the silver halide photographic light-sensitive material. This stabilization bath may also contain, if desired, an ammonium compound, metal compound such as those of Bi or Al, fluorescent brightening agent, various chelating agents, film pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned development and fixing processing agents.

Waste solutions of the developer, fixer, washing water or stabilizing solution used for the present invention are preferably burned for disposal. The waste solutions can also be concentrated or solidified by a concentrating apparatus such as those described in JP-B-7-83867 and U.S. Pat. No. 5,439,560, and then disposed.

When the replenishing amount of the processing agents is reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation-type automatic processor. This automatic processor performs four steps of development, fixing, washing with water and drying, and it is most preferable to follow this four-step processing also in processing of the silver halide photographic light-sensitive material of the present invention, although other steps (e.g., stopping step) are not excluded. Further, a rinsing bath, tank for washing with water or washing tank may be provided between the development and fixing and/or between the fixing and washing with water.

In the development of the silver halide photographic light-sensitive material of the present invention, the dry-to-dry time from the start of processing to finish of drying is preferably 25 to 160 seconds, the development time and the fixing time are each preferably 40 seconds or less, more preferably 6 to 35 seconds, and the temperature of each solution is preferably 25 to 50° C., more preferably 30 to 40° C. The temperature and the time of washing with water are preferably 0 to 50° C. and 40 seconds or less, respectively. According to this method, the silver halide photographic light-sensitive material after development, fixing and washing with water may be passed between squeeze rollers for squeezing washing water, and then dried. The drying is generally performed at a temperature of from about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

The present invention will be specifically explained with reference to the following examples and comparative examples. The materials, amounts, ratios, types and procedures of processes and so forth shown in the following examples can be optionally changed so long as such change does not depart from the spirit of the present invention. Therefore, the scope of the present invention should not be construed in any limitative way based on the following examples. The term "part" used in the examples means part by weight unless otherwise indicated.

EXAMPLE 1

<<Preparation of Emulsion A>>

| | |
|---|---|
| Solution 1 | |
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | $6.0 \times 10^{-7}$ mol/Ag mol |
| $(NH_4)_3[RhCl_5(H_2O)]$ (0.001% in 20% NaCl aqueous solution) | $2.5 \times 10^{-7}$ mol/Ag mol |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.21 μm. Subsequently, Solution 4 and Solution 5 shown below were added over 8 minutes. Further, the remaining 10% portions of Solution 2 and Solution 3 were added over 2 minutes to allow growth of the grains to a diameter of 0.23 μm. Further, 0.15 g of potassium iodide was added, and ripening was allowed for 5 minutes to complete the grain formation.

| Solution 4 | |
|---|---|
| Water | 100 mL |
| Silver nitrate | 50 g |
| **Solution 5** | |
| Water | 100 mL |
| Sodium chloride | 13 g |
| Potassium bromide | 11 g |
| $K_4[Fe(CN)_6].3H_2O$ (potassium ferrocyanide) | $8.0 \times 10^{-7}$ mol/Ag mol |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 15 mg of sodium thiosulfate pentahydrate and 4.0 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.24 μm with a variation coefficient of 9%. The emulsion finally showed pH of 5.7, pAg of 7.5, electric conductivity of 40 μS/m, density of 1.2 to $1.25\times10^3$ kg/m$^3$ and viscosity of 50 mPa·s. The molar amount of silver in the internal portions containing the metal complex corresponded to 92.5% of the total silver amount.

Anionic precipitating agent 1

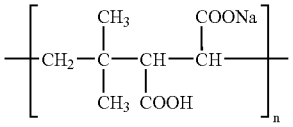

Average molecular weight: 120,000

<<Preparation of Emulsion B>>

Emulsion B was prepared in the same manner as the preparation of Emulsion A except that the amount of silver bromide is changed to 55 mol %, the average grain size was changed to 0.21 μm, and the doping amount of $K_4[Fe(CN)_6].3H_2O$ (potassium ferrocyanide) was changed to $3.0\times10^{-5}$ mol/Ag mol. The halogen composition was controlled by changing addition amounts of sodium chloride and potassium bromide in Solutions 3 and 5, and the grain size was controlled by changing addition amount of sodium chloride and preparation temperature for Solution 1.

<<Preparation of Coating Solutions>>

The silver halide photographic light-sensitive materials prepared in this example had a structure where UL layer, emulsion layer, lower protective layer and upper protective layer were formed in this order on one surface of the following polyethylene terephthalate film support having moisture-proof layers comprising vinylidene chloride on the both surfaces, and an electroconductive layer and back layer were formed in this order on the opposite surface.

Compositions of coating solutions used for forming the layers are shown below.

| Coating solution for UL layer | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| 5-Methylbenzotriazole | 20 mg/m$^2$ |
| Antiseptic (Proxcel, ICI Co., Ltd.) | 1.5 mg/m$^2$ |
| **Coating solution for emulsion layer** | |
| Emulsion A (type is mentioned in Table 1) | 2.9 g/m$^2$ |
| Spectral sensitization dye (SD-1) | $5.7 \times 10^{-4}$ mol/Ag mol |
| KBr | $3.4 \times 10^{-4}$ mol/Ag mol |
| Compound (Cpd-1) | $2.0 \times 10^{-4}$ mol/Ag mol |
| Compound (Cpd-2) | $2.0 \times 10^{-4}$ mol/Ag mol |
| Compound (Cpd-3) | $8.0 \times 10^{-4}$ mol/Ag mol |
| 4-Hydroxy-6-methyl-1,3,3a,7-tetrazaindene | $1.2 \times 10^{-4}$ mol/Ag mol |
| Hydroquinone | $1.2 \times 10^{-2}$ mol/Ag mol |
| Citric acid | $3.0 \times 10^{-4}$ mol/Ag mol |
| 5-Methylbenzotriazole | 20 mg/m$^2$ |
| Hydrazine compound (Cpd-4) | $6.0 \times 10^{-4}$ mol/Ag mol |
| Nucleation accelerator (Cpd-5) | $5.0 \times 10^{-4}$ mol/Ag mol |
| 2,4-Dichloro-6-hydroxy-1,3,5-triazine sodium salt | 90 mg/m$^2$ |
| Aqueous latex (Cpd-6) | 100 mg/m$^2$ |
| Polyethyl acrylate latex | 150 mg/m$^2$ |
| Colloidal silica (particle size: 10 μm) | 15 weight % as for gelatin |
| Compound (Cpd-7) | 4 weight % as for gelatin |
| Latex of copolymer of methyl acrylate, 2-acrylamido-2-methypropanesulfonic acid sodium salt and 2-acetoxyethyl methacrylate (weight ratio = 88:5:7) | 150 mg/m$^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/m$^2$ |

pH of the coating solution was adjusted to 5.6 by using citric acid.

The coating solution for emulsion layer prepared as described above was coated on the support mentioned below so that the coated silver amount and coated gelatin amount should become 2.9 g/m$^2$ and 1.2 g/m$^2$, respectively.

Cpd-1

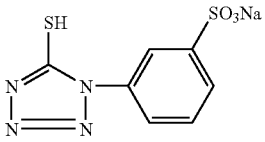

Cpd-2

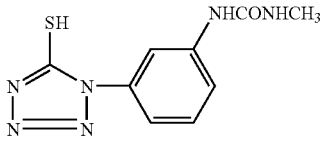

Cpd-3

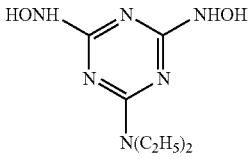

Cpd-4

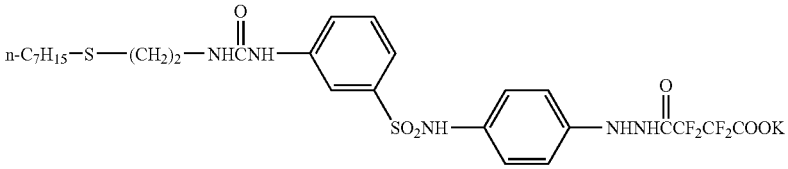

Cpd-5

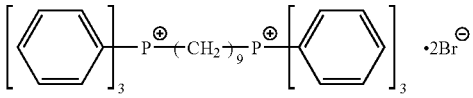

cpd-6

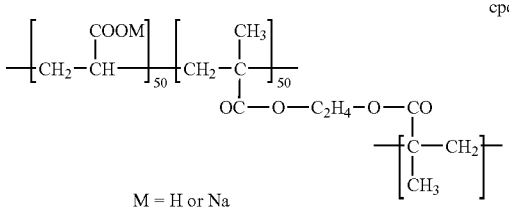

M = H or Na

Cpd-7

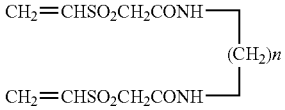

(n = 2):(n = 3) = 3:1

Spectral Sensitization Dye (SD-1)

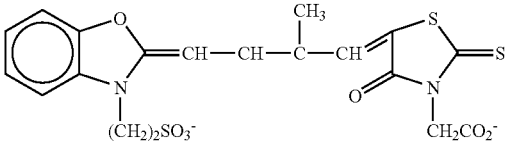

$[(C_2H_5)_2N^+H]_2$

| Coating solution for lower protective layer | |
|---|---|
| Gelatin | 0.5 g/m$^2$ |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI Co., Ltd.) | 1.5 mg/m$^2$ |
| **Coating solution for upper protective layer** | |
| Gelatin | 0.3 g/m$^2$ |
| Amorphous silica matting agent (average particle size: 3.5 μm) | 25 mg/m$^2$ |
| Compound (Cpd-8) (gelatin dispersion) | 20 mg/m$^2$ |

-continued

| | |
|---|---|
| Colloidal silica (particle size: 10 to 20 μm, Snowtex C, Nissan Chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Antiseptic (Proxcel, ICI Co., Ltd.) | 1 mg/m$^2$ |

Viscosity of the coating solutions for the layers was adjusted by adding Thickener Z mentioned below.

Cpd-8

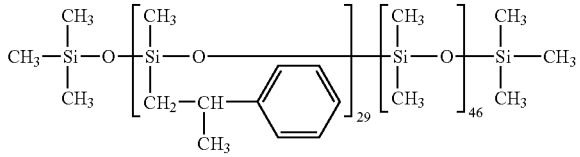

Cpd-9

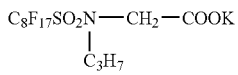

Cpd-10

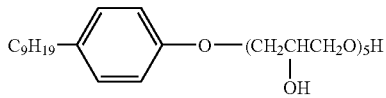

-continued

Cpd-11

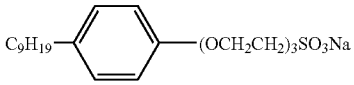

Cpd-12

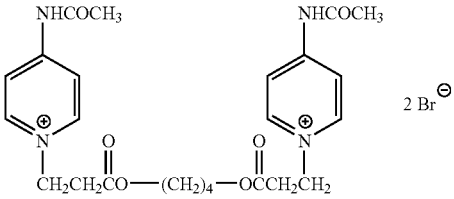

Cpd-13

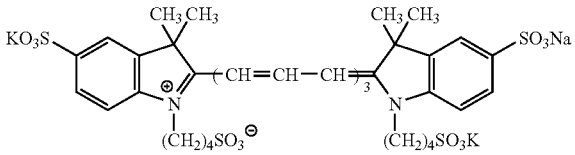

Cpd-14

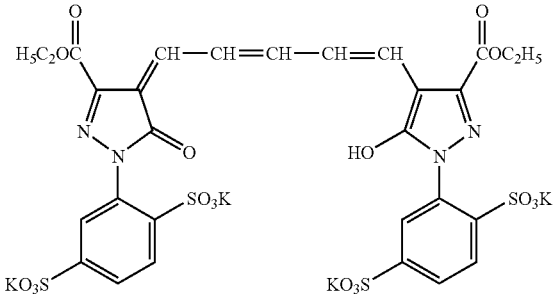

Thickener Z

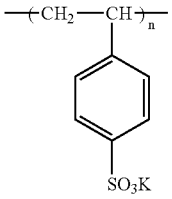

| Coating solution for back layer | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 μm) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 μm) | 15 weight % as for gelatin |
| Calcium nitrate | 20 mg/m$^2$ |
| Antiseptic (Proxcel, ICI Co., Ltd.) | 12 mg/m$^2$ |
| **Coating solution for electroconductive layer** | |
| Gelatin | 0.1 g/m$^2$ |
| Sodium dodecylbenzenesulfonate | 20 mg/m$^2$ |

-continued

| | |
|---|---|
| $SnO_2$/Sb (weight ratio = 9:1, average particle size: 0.25 μm) | 200 mg/m$^2$ |
| Antiseptic (Proxcel, ICI Co., Ltd.) | 0.3 mg/m$^2$ |

Cpd-15

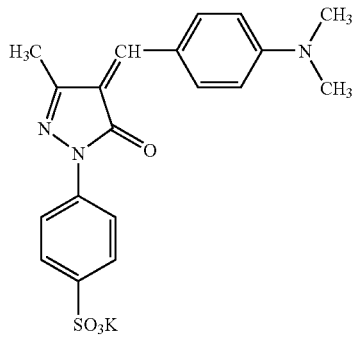

Cpd-16

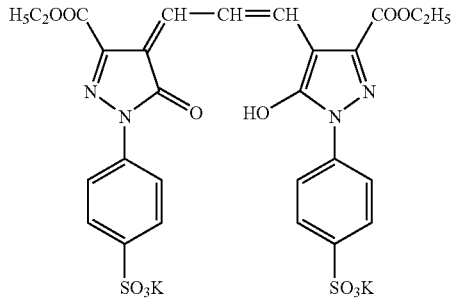

Cpd-17

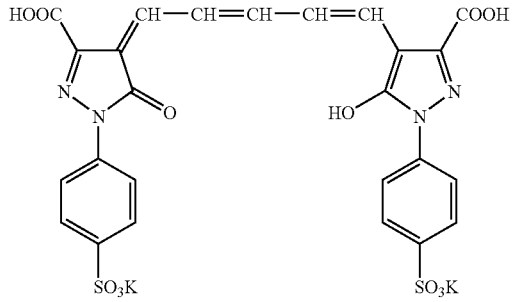

Cpd-18

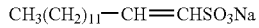

Cpd-19

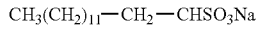

Cpd-20

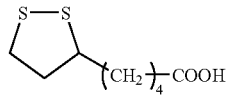

<<Support>>

PREPARATION EXAMPLE 1

Polyethylene Terephthalate Film

In an amount of 4 g of montmorillonite (Kunipia F, Kunimine Industries) was dispersed in 200 mL of water, added with 2.5 g of n-dodecyltrimethylammonium chloride and dispersed in a homomixer for 1 hour. The dispersion was subjected to suction filtration using a membrane filter with sufficient washing with water, and the residue was dried under vacuum at 100° C. for 24 hours to obtain Montmorillonite (A) coated with the organic ammonium salt.

Ethylene glycol was charged at a proportion of 1.6 moles per one mole of terephthalic acid, and the aforementioned montmorillonite (Kunipia F, Kunimine Industries) coated with an organic compound was charged in an amount of 2 parts by weight with respect to 100 parts by weight of the polymer to be theoretically produced. The reaction was performed at 255° C. for 2 hours to produce an oligomer containing bishydroxyethyl terephthalate as a main component. Then, antimony trioxide was added as a catalyst in an amount of 100 ppm with respect to the molar number of the terephthalic acid, the reaction was performed at 275° C. for 4 hours under reduced pressure, and a melted polymer was discharged from a discharge port, cooled and cut into pellets.

The pellets were dried at 80° C. for 10 hours, then fed into an extruder, melted by heating at 270° C. and extruded into a sheet shape from a die orifice of T-die. The film was rolled around a cooling drum having a surface temperature of 10° C. and thereby cooled to prepare an unstretched film. Subsequently, the unstretched film was stretched 3 times along the longitudinal direction at a stretching temperature of 90° C. by using a roller and then 3.3 times along the transverse direction by using a tenter and subsequently subjected to a heat treatment at 230° C. at a relaxation ratio of 5% to obtain a polyethylene terephthalate film (PET-A) having a thickness of 175 μm.

PREPARATION EXAMPLE 2

Polyethylene Naphthalate Film

Pellets of polyethylene-2,6-naphthalate were produced in the same manner as Preparation Example 1 mentioned above except that 2,6-naphthalenedicarboxylic acid was used instead of the terephthalic acid, and a polyethylene naphthalate film (PEN-A) was obtained with the same filler under the same conditions as those used in Preparation Example 1 except that the melting temperature was changed to 290° C.

PREPARATION EXAMPLE 3

Syndiotactic Polymer Film (1) Preparation of Catalytic Product of Trimethylaluminum and Water To an argon-substituted glass vessel having an internal volume of 500 mL, 17.8 g (71 mmol) of copper sulfate pentahydrate ($CuSO_4.5H_2O$), 200 mL of toluene and 24 mL (250 mmol) of trimethylaluminum were introduced and reacted at 40° C. for 8 hours. Then, the solid portion was removed from the reaction mixture to obtain a solution, and toluene was evaporated from the obtained solution at room temperature under reduced pressure to obtain 6.7 g of a catalytic product. The molecular weight of this catalytic product was measured by the cryoscopic method and found to be 610.

(2) Production of Styrene Polymer

To a reaction vessel having an internal volume of 2 L, 950 mL of purified styrene, 50 mL of p-methylstyrene, 5 mmol in terms of aluminum atom of the catalytic product obtained in (1) mentioned above, 5 mmol of triisobutylaluminum and 0.025 mmol of pentamethylcyclopentadienyltitanium trimethoxide were introduced, and a polymerization reaction was performed at 90° C. for 5 hours. After completion of the reaction, the catalyst component was decomposed with a sodium hydroxide solution in methanol, and then the product was repeatedly washed with methanol and dried to obtain 308 g of polymer. It could be confirmed by $^{13}C$-NMR that the obtained copolymer had a co-syndiotactic structure and contained 9.5 mol % p-methylstyrene units. Further, the weight average molecular weight was 438,000, and the ratio of weight average molecular weight/number average molecular weight was 2.51.

The styrene polymer produced in (2) and the aforementioned montmorillonite (Kunipia F, Kunimine Industries) coated with the organic compound in an amount of 2 parts by weight with respect to 100 parts by weight of the polymer to be theoretically formed were charged, dried at 150° C. under reduced pressure and pelletized by using a single screw extruder with a vent. The pellets were crystallized under a hot air blow at 130° C. with stirring. The styrene monomer content in the crystallized pellets was 1,100 ppm. Then, these pellets were extruded by using an apparatus comprising an extruder having a filter inside and a T-die at the tip end. The melting temperature for this operation was 300° C. The sheet of molten state was molded into a transparent sheet having a thickness of 1400 μm and a crystallinity of 9% by using the electrostatic adhesion method. The obtained sheet was stretched 3.5 times at 110° C. along the longitudinal direction and 4 times at 120° C. along the transverse direction and subjected to a heat treatment at 240° C. for 10 seconds under a fixed tension state and for 20 seconds under 5%-limited contraction state. The obtained film had a thickness of 175 μm and a haze of 1.0%.

The both surfaces of the obtained support (SPS support) were subjected to a glow discharge treatment under the following conditions. Four of cylindrical electrodes having a cylindrical shape with a sectional diameter of 2 cm and a length of 150 cm and having a hollow serving as a cooling medium flow pass were fixed on an insulation board with intervals of 10 cm. This electrode board was fixed in a vacuum tank, and the biaxially stretched film was transported so that the film should face the electrode plane with a spacing of 15 cm. The transportation speed was controlled so that the surface treatment should be performed for 2 seconds. A temperature-controlled heating roller having a diameter of 50 cm was provided so that the film should contact with the heating roller for ¾ round of the roller immediately before the film passed the electrodes, and the film surface temperature was controlled to be 115° C. by monitoring it with a thermoelectric thermometer contacted with the film surface between the heating roller and the electrode zone. The pressure in the vacuum chamber was 0.2 Torr, and the $H_2O$ partial pressure in the atmospheric gas was 75%. The discharge frequency was 30 kHz, the output was 2500 W, and the treatment intensity was 0.5 kV·A·minute/$m^2$. The support after the discharge treatment was brought into contact with a temperature-controlled cooling roller having a diameter of 50 cm so that the surface temperature should become 30° C. before the support was rolled, and then the support was rolled (SPS-A).

PREPARATION EXAMPLE 4

Other Supports of the Present Invention

The other supports of the present invention mentioned in Table 1 were produced by performing the same procedure as those of Preparation Examples 1 to 3 except that the dispersion time of the filler added at the time of the preparation of the supports was changed as shown in Table 1.

PREPARATION EXAMPLE 5

Supports for Comparison

Supports for comparison were prepared in the same manner as those of Preparation Examples 1 to 3 except that any filler was not added at the time of preparation of the supports.

(Coating on Support)

On both surfaces of each of the supports mentioned above (thickness: 175 μm), the coating solutions for first undercoat layer and second undercoat layer having the following compositions were successively coated in this order as the first and second layers.

| Coating solution for first undercoat layer | |
|---|---|
| Core/shell type vinylidene chloride copolymer (i) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70 to 100 μm Snowtex ZL, Nissan Chemical) | 0.12 g |
| Water | Amount making total amount 100 g |

The coating solution adjusted to pH 6 with further addition of 10 weight % of KOH was coated so that a dry thickness of 0.9 μm should be obtained after drying at a drying temperature of 180° C. for 2 minutes.

| Coating solution for second undercoat layer | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Proxcel, ICI Co., Ltd.) | $3.5 \times 10^{-3}$ g |
| Acetic acid | 0.2 g |
| Water | Amount making total amount 100 g |

This coating solution was coated so that a dry thickness of 0.1 μm should be obtained after drying at a drying temperature of 170° C. for 2 minutes.

Core/Shell Type Vinylidene Chloride Copolymer (i)

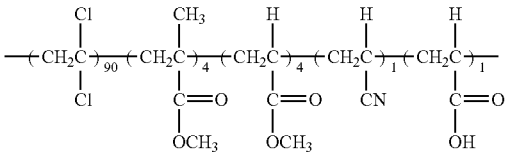

VDC MMa MA AN AA

Core: VDC/MMA/MA (80 weight %)

Shell: VDC/AN/AA (20 weight %)

Average particle size: 70 nm

Compound (Cpd-21)

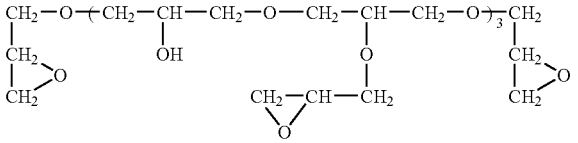

Compound (Cpd-22)

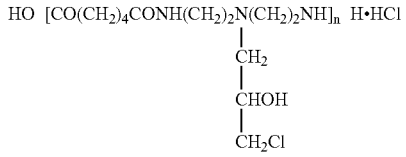

n = 10

<<Method for Coating on Support>>

First, on the aforementioned support coated with the undercoat layers, for the emulsion layer side, four layers of UL layer, emulsion layer, lower protective layer and upper protective layer were simultaneously coated as stacked layers in this order from the support at 35° C. by the slide bead coating method while adding a hardening agent solution, and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the layers coated on the both surfaces of the support were simultaneously dried in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point where the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

This silver halide photographic light-sensitive material was rolled up at 25° C. and relative humidity of 55%, cut under the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare each of Sample 1 to 18 mentioned in Table 1.

Humidity in the barrier bag was measured and found to be 45%. The obtained samples had a film surface pH of 5.5 to 5.8 for the emulsion layer side and 6.0 to 6.5 for the back side. The absorption spectra of the emulsion layer side and the back layer side were as shown in FIG. 1.

<<Evaluation>>

<Measurement of Thickness and Aspect Ratio of Filler in Undercoat Layer>

A film containing particles as the object of measurement and stretched 3.2 times or more along either the longitudinal or transverse direction was sliced with a microtome, and a slice was observed by using a transmission electron microscope (TEM H-800, Hitachi) at a magnification of 20,000 to 30,000. Diameter as plate and thickness of at least 30 or more of particles observable in the slice were measured to obtain an aspect ratio as the ratio of them.

<Measurement of Dimensional Change Ratio>

For the obtained samples, dimensional change observed with change of environmental humidity in a room was measured as follows. Two of holes having a diameter of 8 mm were formed on each sample with a spacing of 200 mm, and the sample was subjected to the following development treatment. The sample after the processing was left in a room of 25° C. and 60% relative humidity for 24 hours, and then the spacing of two of the holes was accurately measured by the pin-gauging method of 1/1000 mm precision in a room of 25° C. and 60% relative humidity. The length measured at this time was represented as X mm. Subsequently, the sample after the processing was immediately transferred into a room of 25° C. and 40% relative humidity and left for 15 minutes or 4 hours. Then, the spacing was measured and represented as Y mm. Ratio (%) of the dimensional change caused by change of environmental humidity in the room was calculated in accordance with the following equation: Dimensional change ratio=(Y-X)×100/200 (%).

<Method for Development>

Each sample was processed with development conditions of 35° C. for 30 seconds by using a developer QR-D1 (Fuji Photo Film Co., Ltd.), a fixer NF-1 (Fuji Photo Film Co., Ltd.) and an automatic developing machine FG-680AG (Fuji Photo Film Co., Ltd.). The drying temperature was 45° C.

The samples of the present invention containing a filler in the support (Nos. 1 to 15) exhibited superior dimensional stability. In particular, dimensional stability of Samples Nos. 1 to 5 and 7 to 14, in which the thickness of the filler was 0.5 to 5 nm, and the aspect ratio was in the range of 50 to 10000, was excellent.

Dimensional stability of Samples Nos. 16 to 18 not containing any filler in the support was poor.

EXAMPLE 2

Samples Nos. 21 to 29 were prepared and evaluated in the same manner as that of Example 1 except that the support was changed to those mentioned below. The evaluation results were as shown in Table 2.

<<Support>>

On both surfaces of a biaxially stretched polyethylene terephthalate support (thickness: 175 μm), the coating solutions for first undercoat layer, second undercoat layer and third undercoat layer having the following compositions were successively coated in this order as the first, second and third layers.

Coating Solution for First Undercoat Layer

In an amount of 4 parts of montmorillonite (Kunipia G, Kunimine Industries) was dispersed in 200 parts of water, added with 2.5 parts of n-dodecyltrimethylammonium chloride and stirred at room temperature for 1 hour. The mixture was subjected to suction filtration using a membrane filter with sufficient washing with water, and the residue was dried under vacuum at 100° C. for 24 hours to obtain organic montmorillonite coated with the organic ammonium salt. Further, 2 parts of the obtained organic montmorillonite and 100 parts of water-dispersible polyester resin (2,6-naphthalenedicarboxylic acid/ethylene glycol/sodium sulfoterephthalate copolymer) were dispersed in water at a concentration of 10 weight % to prepare a coating solution for undercoat layer. This coating solution for undercoat layer was coated so that a thickness of 0.5 μm should be obtained after drying.

TABLE 2

<<Evaluation>>

| | | First undercoat layer | | | | | Dimensional change (%) | | |
|---|---|---|---|---|---|---|---|---|---|
| | | Filler | | | | Coated | | | |
| Sample No. | Emulsion | Type | Dispersion time (hr) | Thickness (nm) | Aspect ratio | thickness (μm) | After 15 minutes | After 4 hours | Note |
| 21 | A | A | 1.0 | 1.7 | 1000 | 0.5 | 0.000 | −0.003 | Invention |
| 22 | B | A | 1.0 | 1.7 | 1000 | 0.5 | 0.000 | −0.003 | Invention |
| 23 | B | A | 1.5 | 1.5 | 500 | 0.5 | 0.000 | −0.003 | Invention |
| 24 | B | A | 2.0 | 1.2 | 250 | 0.5 | 0.000 | −0.002 | Invention |
| 25 | B | A | 4.0 | 1.1 | 100 | 0.5 | 0.000 | −0.002 | Invention |
| 26 | B | A | 1.5 | 1.5 | 500 | 1.0 | 0.000 | −0.002 | Invention |
| 27 | B | B | — | 5.0 | 1 | 0.5 | −0.001 | −0.006 | Invention |
| 28 | B | None | — | — | — | — | −0.002 | −0.011 | Comparative |
| 29 | B | None | — | — | — | 0.5 | −0.002 | −0.011 | Comparative |

| Coating solution for second undercoat layer | |
|---|---|
| Core/shell type vinylidene chloride copolymer (i) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70 to 100 μm Snowtex ZL, Nissan Chemical) | 0.12 g |
| Water | Amount making total amount 100 g |

The coating solution adjusted to pH 6 with further addition of 10 weight % of KOH was coated so that a dry thickness of 0.9 μm should be obtained after drying at a drying temperature of 180° C. for 2 minutes.

| Coating solution for third undercoat layer | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Proxcel, ICI Co., Ltd.) | $3.5 \times 10^{-3}$ g |
| Acetic acid | 0.2 g |
| Water | Amount making total amount 100 g |

This coating solution was coated so that a dry thickness of 0.1 μm should be obtained after drying at a drying temperature of 170° C. for 2 minutes.

Samples Nos. 22 to 26 were prepared in the same manner as that used for Sample No. 21 except that the dispersion time of the filler added to the first undercoat layer to be coated on the support and the coating thickness were changed as shown in Table 1.

Sample No. 27 was prepared in the same manner as that used for Sample No. 21 except that the filler contained in the undercoat layer was changed to Aerosil having an average primary particle size of 5 nm.

Sample No. 28 was prepared in the same manner as that used for Sample No. 21 except that the first undercoat layer was not provided.

Sample No. 29 was prepared in the same manner as that used for Sample No. 21 except that the first undercoat layer did not contain any filler.

TABLE 1

| | | Support | | | | Dimensional change (%) | | |
|---|---|---|---|---|---|---|---|---|
| | | | Filler | | | | | |
| Sample No. | Emulsion | Type | Dispersion time (hr) | Thickness (nm) | Aspect ratio | After 15 minutes | After 4 hours | Note |
| 1 | A | PET-A | 1.0 | 1.7 | 1000 | 0.000 | −0.003 | Invention |
| 2 | B | PET-A | 1.0 | 1.7 | 1000 | 0.000 | −0.003 | Invention |
| 3 | B | PET-B | 1.5 | 1.5 | 500 | 0.000 | −0.002 | Invention |
| 4 | B | PET-C | 2.0 | 1.2 | 250 | 0.000 | −0.002 | Invention |
| 5 | B | PET-D | 4.0 | 1.1 | 100 | 0.000 | −0.002 | Invention |
| 6 | B | PET-F | 0.0 | 100.0 | 1 | −0.002 | −0.007 | Invention |
| 7 | A | PEN-A | 1.0 | 1.7 | 1000 | −0.001 | −0.005 | Invention |
| 8 | B | PEN-A | 1.0 | 1.7 | 1000 | −0.001 | −0.005 | Invention |
| 9 | B | PEN-B | 4.0 | 1.1 | 100 | −0.001 | −0.005 | Invention |
| 10 | A | SPS-A | 1.0 | 1.7 | 1000 | 0.000 | −0.002 | Invention |
| 11 | B | SPS-A | 1.0 | 1.7 | 1000 | 0.000 | −0.002 | Invention |
| 12 | B | SPS-B | 1.5 | 1.5 | 500 | 0.000 | −0.002 | Invention |
| 13 | B | SPS-C | 2.0 | 1.2 | 250 | 0.000 | −0.002 | Invention |
| 14 | B | SPS-D | 4.0 | 1.1 | 100 | 0.000 | −0.002 | Invention |
| 15 | B | SPS-F | 0.0 | 100.0 | 1 | −0.002 | −0.007 | Invention |
| 16 | B | PET | — | — | — | −0.002 | −0.011 | Comparative |
| 17 | B | PEN | — | — | — | −0.002 | −0.011 | Comparative |
| 18 | B | SPS | — | — | — | −0.002 | −0.009 | Comparative |

Samples Nos. 21 to 27 having an undercoat layer containing a clay compound coated with an organic substance exhibited superior dimensional stability. In particular, dimensional stability of Samples Nos. 21 to 26, which contained a clay compound coated with an organic substance having a thickness of 0.5 to 5 nm and an aspect ratio in the range of 50 to 10000, was excellent.

Dimensional stability of Sample No. 27, which did not have the first undercoat layer, and Sample No. 28, which did not contain any filler in the undercoat layer, was poor.

The present disclosure relates to the subject matter contained in Japanese Patent Application No. 095122/2003 filed Mar. 31, 2003 and Japanese Patent Application No. 095123/2003 filed Mar. 31, 2003, which are expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A silver halide photographic light-sensitive material for forming a silver image, comprising:

at least one silver halide emulsion layer on a side of a support, at least one nucleating agent on the side having the emulsion layer, and wherein the support contains a filler treated with an organic onium ion.

2. The silver halide photographic light-sensitive material according to claim 1, wherein the filler has an aspect ratio of 50 to 10000.

3. The silver halide photographic light-sensitive material according to claim 1, wherein the filler has a thickness of 0.5 to 5 nm.

4. The silver halide photographic light-sensitive material according to claim 1, wherein the filler has an average particle size of 25 to 10000 nm.

5. The silver halide photographic light-sensitive material according to claim 1, wherein the filler is a clay compound treated with an organic onium ion.

6. The silver halide photographic light-sensitive material according to claim 5, wherein the filler is a smectite group clay compound treated with an organic onium ion.

7. The silver halide photographic light-sensitive material according to claim 1, wherein the filler is a swellable mineral treated with an organic onium ion.

8. The silver halide photographic light-sensitive material according to claim 7, wherein the filler is swellable mica treated with an organic onium ion.

9. The silver halide photographic light-sensitive material according to claim 7, wherein the filler is swellable vermiculite treated with an organic onium ion.

10. The silver halide photographic light-sensitive material according to claim 1, which shows a gamma of 4.0 or more for the optical density range of 0.1 to 1.5 on a characteristic curve drawn in orthogonal coordinates of common logarithm of light exposure (x-axis) and optical density (y-axis) using equal unit lengths for the both axes.

11. A silver halide photographic light-sensitive material for forming a silver image, comprising:

at least one silver halide emulsion layer on a support and a back layer on the side of the support opposite to the side having the emulsion layer, at least one nucleating agent on the side having the emulsion layer, and an undercoat layer containing a clay compound coated with an organic substance between the support and the emulsion layer or between the support and the back layer.

12. The silver halide photographic light-sensitive material according to claim 11, wherein the clay compound coated with an organic substance has an aspect ratio of 50 to 10000.

13. The silver halide photographic light-sensitive material according to claim 11, wherein the clay compound coated with an organic substance has a thickness of 0.5 to 5 nm.

14. The silver halide photographic light-sensitive material according to claim 11, wherein the clay compound coated with an organic substance is a layered silicate compound treated with an organic onium ion.

15. The silver halide photographic light-sensitive material according to claim 14, wherein the clay compound coated with an organic substance is a smectite group clay compound treated with an organic onium ion.

16. The silver halide photographic light-sensitive material according to claim 14, wherein the clay compound coated with an organic substance is swellable mica treated with an organic onium ion.

17. The silver halide photographic light-sensitive material according to claim 14, wherein the clay compound coated with an organic substance is swellable vermiculite treated with an organic onium ion.

18. The silver halide photographic light-sensitive material according to claim 11, which has undercoat layers containing a clay compound coated with an organic substance between the support and the emulsion layer and between the support and the back layer.

19. The silver halide photographic light-sensitive material according to claim 11, which shows a gamma of 4.0 or more for the optical density range of 0.1 to 1.5 on a characteristic curve drawn in orthogonal coordinates of common logarithm of light exposure (x-axis) and optical density (y-axis) using equal unit lengths for the both axes.

20. A silver halide photographic light-sensitive material having a property of forming a silver image through development by a developer having a pH of 9.0 to 11.0, wherein the silver halide photographic light-sensitive material comprises at least one silver halide emulsion layer on a support, and the support comprises a filler.

21. A silver halide photographic light-sensitive material comprising at least one silver halide emulsion layer on a support, wherein the support comprises a filler treated with an alkylamine ion or an ammonium ion having both of an alkyl group and a glycol chain, or a filler treated with a phosphonium ion, a sulfonium ion or an onium ion derived from a heteroaromatic ring.

22. A silver halide photographic light-sensitive material for forming a silver image comprising:

at least one silver halide emulsion layer on a support, and at least one nucleating agent on the side having the emulsion layer;

wherein the support comprises a polyester comprising a filler treated with an organic onium ion.

23. A silver halide photographic light-sensitive material comprising at least one silver halide emulsion layer on a support, wherein the support comprises a filler, and wherein the support has a Young's modulus of 4400 to 15000 MPa in the portion containing the filler.

24. A silver halide photographic light-sensitive material having a property of forming a silver image through development by a developer having a pH of 9.0 to 11.0, wherein the silver halide photographic light-sensitive material comprises:

at least one silver halide emulsion layer on a support and a back layer on the side of the support opposite to the side having the emulsion layer, and an undercoat layer comprising a clay compound coated with an organic substance between the support and the emulsion layer or between the support and the back layer.

25. A silver halide photographic light-sensitive material having a property of forming a silver image through development by a developer having a pH of 9.0 to 11.0, wherein the silver halide photographic light-sensitive material comprises:

at least one silver halide emulsion layer on a support and a back layer on the side of the support opposite to the side having the emulsion layer, at least one nucleating agent on the side having the emulsion layer, an undercoat layer comprising a clay compound coated with an organic substance between the support; and wherein the support is free from fillers.

26. A silver halide photographic light-sensitive material comprising:

at least one silver halide emulsion layer on a support and at least one undercoat layer and a back layer on the side of the support opposite to the side having the emulsion layer;

wherein at least one undercoat layer comprises a clay compound coated with an organic substance between the support and the emulsion layer or between the support and the back layer, and wherein the support has a Young's modulus of 4400 to 15000 MPa in a portion containing a filler.

27. A silver halide photographic light-sensitive material comprising:

at least one silver halide emulsion layer on a support, and at least one undercoat layer and a back layer on the side of the support opposite to the side having the emulsion layer;

wherein an undercoat layer is formed by coating between the support and the emulsion layer or between the support and the back layer, and wherein the undercoat layer comprises a clay compound coated with an organic substance and at least one compound selected from the group consisting of polyester resin, polyamidoimide resin, polyurethane resin, vinyl chloride type resin, vinylidene chloride resin, phenol resin, epoxy resin, urea resin, melamine resin, formaldehyde resin, silicone resin, starch, denatured starch compound, alginic acid compound, casein, pullulan, dextran, chitin, chitosan, rubber latex, gum arabic, gumweed, natural gum, dextrin, denatured cellulosic resin, polyvinyl alcohol type resin, polyacrylic acid type resin, polyvinylpyrrolidone, polyethyleneimine, polyvinyl ether, polymaleate copolymer, polyacrylamide and alkyd resin.

* * * * *